US010422136B2

(12) United States Patent
LeBlang

(10) Patent No.: US 10,422,136 B2
(45) Date of Patent: Sep. 24, 2019

(54) METAL FRAMING CONNECTIONS BETWEEN MEMBERS

(71) Applicant: Dennis LeBlang, La Quinta, CA (US)

(72) Inventor: Dennis LeBlang, La Quinta, CA (US)

( * ) Notice: Subject to any disclaimer, the term of this patent is extended or adjusted under 35 U.S.C. 154(b) by 0 days.

(21) Appl. No.: 15/724,137

(22) Filed: Oct. 3, 2017

(65) Prior Publication Data

US 2019/0242130 A1 Aug. 8, 2019

Related U.S. Application Data

(63) Continuation-in-part of application No. 15/430,781, filed on Feb. 13, 2017.

(51) Int. Cl.

| | |
|---|---|
| ***E04C 3/07*** | (2006.01) |
| ***E04B 1/41*** | (2006.01) |
| ***E04B 2/62*** | (2006.01) |
| ***E04B 1/24*** | (2006.01) |
| *E04B 1/38* | (2006.01) |

(52) U.S. Cl.

CPC ..... *E04C 3/07* (2013.01); *E04B 1/2403* (2013.01); *E04B 1/40* (2013.01); *E04B 2/62* (2013.01); *E04B 2001/2409* (2013.01); *E04B 2001/2415* (2013.01); *E04B 2001/405* (2013.01)

(58) Field of Classification Search

CPC ..... E04C 3/07; E04B 1/40; E04B 2/58; E04B 1/7608; E04B 1/7654; E04B 2001/405

USPC ... 52/653.1, 654.1, 667, 712, 243, 317, 349, 52/481.1, 655.1, 696, 713–715

See application file for complete search history.

(56) References Cited

U.S. PATENT DOCUMENTS 3,708,941 A 1/1973 Cuckson
4,007,570 A 2/1977 Hunter
(Continued)

*Primary Examiner* — William V Gilbert

(57) ABSTRACT

The self-locking metal framing connections between support members and the crossing longitudinal spacing-bracing members can occur at the hole, at the top and bottom ends of the support members as well as the end-to-end connections between longitudinal spacing-bracing members. Connecting the hook tab with a notched-tab to a receiver hole in the adjacent web allows the longitudinal spacer brace to pivot horizontally and if the hook tongue with the notched tab and the receiver hole are in the flanges, the spacer braces can pivot vertically. Short longitudinal spacer braces with receiver holes and hook tongues with notched-tabs, key hole bendable tabs, different shaped spacer braces, different variations in the hole notches, notched tabs in the hole bottom edge, diagonal framing between holes and longitudinal spacing-bracing members having notched-tab receivers can be installed in the lip notches or the horizontal spacing-bracing member and/or into the slot holes of the flanges of another spacing-bracing member. Double lip flanges with notches at the end of the lips, bent upward or downward or having the notches penetrate both lips all adds strength. Additional configurations showing bent webs, bent flanges and bent lips to form curved longitudinal spacing-bracing members. The notched-tab can also be installed in the support member allowing the notched-tab to be installed through slot holes at the flanges or web to secure the spacer brace to the support members which is ideal for fabricating metal framing in a horizontal position then installed vertically.

8 Claims, 37 Drawing Sheets

(56) References Cited

U.S. PATENT DOCUMENTS

| | | | | |
|---|---|---|---|---|
| 4,160,344 | A | 7/1979 | Brugman | |
| D293,416 | S * | 12/1987 | Krueger | 52/696 |
| 4,805,364 | A | 2/1989 | Smolik | |
| 4,809,476 | A | 3/1989 | Satchell | |
| 5,058,352 | A | 10/1991 | Loiselle | |
| 5,127,760 | A | 7/1992 | Brady | |
| 5,157,883 | A | 10/1992 | Meyer | |
| 5,325,651 | A | 7/1994 | Meyer | |
| 5,291,717 | A | 8/1994 | Turner | |
| 5,581,953 | A | 10/1996 | Ruff | |
| 5,720,138 | A | 2/1998 | Johnson | |
| 5,749,192 | A | 5/1998 | Menchetti | |
| 5,797,233 | A | 8/1998 | Hascall | |
| 5,839,848 | A | 11/1998 | Sahramaa | |
| 5,943,838 | A | 8/1999 | Madsen | |
| 6,094,877 | A | 8/2000 | White | |
| 6,138,359 | A | 10/2000 | Mears | |
| 6,176,053 | B1 | 1/2001 | St. Germain | |
| 6,260,318 | B1 | 7/2001 | Herren | |
| 6,301,854 | B1 | 10/2001 | Daudet | |
| 6,374,558 | B1 | 4/2002 | Surowiecki | |
| 6,434,908 | B1 | 8/2002 | Ferrante | |
| 6,557,254 | B1 | 5/2003 | Johnson | |
| 6,578,335 | B2 | 7/2003 | Poliquin | |
| 6,637,173 | B1 | 10/2003 | Wheeler | |
| 6,655,100 | B1 | 12/2003 | Andino | |
| 6,694,695 | B2 | 2/2004 | Collins | |
| 6,707,689 | B2 | 3/2004 | diGirolamo | |
| 6,739,562 | B2 | 5/2004 | Rice | |
| 6,748,705 | B2 | 6/2004 | Orszulak | |
| 6,761,005 | B1 | 7/2004 | Daudet | |
| 7,073,299 | B1 | 7/2006 | diGirolamo | |
| 7,159,365 | B2 | 1/2007 | Colen | |
| 7,293,392 | B2 | 11/2007 | Krumbacher | |
| 7,428,804 | B2 | 9/2008 | Surowiecki | |
| 7,451,573 | B2 | 11/2008 | Orszulak | |
| 7,596,921 | B1 | 10/2009 | diGirolamo | |
| 7,797,901 | B2 | 9/2010 | Near | |
| 7,832,171 | B2 | 11/2010 | Erickson | |
| 7,836,657 | B1 | 11/2010 | diGirolamo | |
| 7,866,112 | B2 | 1/2011 | Edmondson | |
| 8,011,160 | B2 | 9/2011 | Rice | |
| 8,205,402 | B1 | 6/2012 | diGirolamo | |
| 8,245,466 | B2 | 8/2012 | Wright | |
| 8,453,403 | B2 | 6/2013 | Wheeler | |
| 8,615,959 | B2 | 12/2013 | Ferguson | |
| 8,621,823 | B2 | 1/2014 | Mears | |
| 8,733,044 | B2 | 5/2014 | Dollerup | |
| 8,869,484 | B2 | 10/2014 | Gulbrandsen | |
| 9,045,898 | B2 | 6/2015 | Ravnaas | |
| 9,109,361 | B2 | 8/2015 | Daudet | |

* cited by examiner

METAL FRAMING CONNECTIONS BETWEEN MEMBERS

CROSS REFERENCED TO RELATED APPLICATION

This application U.S. Ser. No. 15/724,137 is a continuation-in-part pending application U.S. Ser. No. 15/430,781 and has priority status:
continuation-in-part pending application U.S. Ser. No. 15/724,137 filed Nov. 3, 2017 that included provisional application U.S. 62/485,114 filed Apr. 13, 2017 and provisional application U.S. 62/490,917 filed Apr. 27, 2017 and provisional application U.S. 62/533,092 filed Jul. 16, 2017 and a continuous-in-part pending application U.S. Ser. No. 15/430,781 filed Feb. 13, 2017 and provisional application U.S. 62/264,033 filed Jul. 15, 2015 and provisional application U.S. 62/274,134 filed Dec. 31, 2015 and provisional application U.S. 62/294,756 filed Feb. 12, 2016 and provisional application U.S. 62/298,782 filed Feb. 23, 2016 and provisional application U.S. 62/308,520 filed Mar. 15, 2016 and provisional application U.S. 62/345,153 filed Jun. 3, 2015 and provisional application U.S. 62/385,932 filed Sep. 9, 2016 and provisional application U.S. 62/339,434 filed Sep. 15, 2016 and continuation-in-part pending application U.S. Ser. No. 15/295,172 filed Oct. 17, 2016 that included provisional application U.S. 62/242,705 filed Oct. 16, 2015 and provisional application U.S. 62/244,135 filed Oct. 20, 2015 and provisional application U.S. 62/264,033 dated Dec. 7, 2015 and provisional application U.S. 62/274,134 filed Dec. 15, 2015 and provisional application 62/345,153 filed Mar. 6, 2016 and a continuous-in-part of pending application Ser. No. 15/090,460 filed Nov. 19, 2015 that included provisional application U.S. 62/143,097 files Apr. 4, 2015 and provisional application U.S. 62/208,766 filed Aug. 23, 2015 and provisional application U.S. 62/242,705 filed Nov. 16, 2015 and a continuous-in-part of pending application U.S. Ser. No. 14/946,378 filed Mar. 3, 2015 and provisional application U.S. 62/083,276 filed Nov. 23, 2014 and provisional application 62/139,913 dated Mar. 30, 2015 and provisional application 62/170,269 filed Jun. 15, 2015 and continuous-in-part pending application U.S. Ser. No. 15/449,250 filed Mar. 3, 2017 that included provisional application U.S. 61/629,044 filed Oct. 24, 2011 and provisional application U.S. 61/629,552 filed Nov. 22, 2011 and provisional application U.S. 61/001,566 filed May 21, 2014 and provisional application U.S. 62/170,269 filed Jun. 3, 2015 and provisional application U.S. 62/175,195 filed Jun. 12, 2015 and provisional application U.S. 62/378,615 filed Aug. 23, 2016 and US patent application U.S. Ser. No. 13/398,243 filed Feb. 16, 2012 now abandoned the disclosures of the above cited US Patent Applications and US Provisional Applications of the Applicant, including all drawings and all the specifications, are hereby incorporated by reference in their entireties into this US Patent Application.

FEDERALLY SPONSORED RESEARCH OR DEVELOPMENT

Not applicable

PARTIES OR JOINT RESEARCH

Not applicable

FIELD OF THE INVENTION

The present invention relates to forming self-locking fixed or self-locking swivel connections between spacer braces as well as connecting longitudinal spacing-bracing members ends to an adjacent longitudinal spacing-bracing members whether the connection is within the hole opening in the support member or at the top or bottom member of the metal framing. The longitudinal spacing-bracing metal framing or spacer braces can be installed individually between support members or in multiple locations using the lip notches of the longitudinal spacing-bracing members. The spacer braces can have different configuration like double lip flanges with notches at the end of the lips or the notch installed through both lips. Other additional configurations showing bent webs, bent flanges and bent lips to form curved longitudinal spacing-bracing members. The configuration shapes of the spacer brace where the flanges and lips are bent at angles, but still conform to the reverse lip shape of the spacer brace. Another alternate shape is having the web of the space brace conform to the shape of the bottom edge of the hole having a notched-tab and the web of the spacer brace having a notched-tab allowing the side head of the web space brace to be installed in the notched-tab of the hole bottom edge. The notched-tab can also be installed in the support member allowing the notched-tab to be installed through slot holes at the flanges or web to secure the spacer brace to the support members which is ideal for fabricating metal framing in a horizontal position then installed vertically. The bottom hole edge, side hole edge and the top hole edge has to be slightly smaller than the required dimension of the hole edge, especially since the structural calculations are based on a certain size hole for its structural capabilities. When installing metal framing the spacer brace can be installed diagonally between the horizontal spacer braces by using notched-tab receivers that can be installed in the lip notches or the horizontal spacing-bracing member and/or into the slot holes of the flanges of another spacing-bracing member. The spacer braces can also be installed as headers above doors or window where the header snaps into the cripple without using fasteners.

DESCRIPTION OF PRIOR ART

Prior building construction methods used screws or welding to connect metal framing together. When metal framing components are allowed to move, slot holes have been used and screws are required to secure the metal framing together. Angles are installed between crossing members and screws have been installed. Diagonal spacer braces uses punched holes between the base and spacer brace for alignment and screws are installed. Curved walls have used rivets that swivel between spacer braces to form a bend between spacer braces or machines bend the metal channels to form as curve metal. Insulating material has been used to separate metal framing, but always require fasteners for installation. Framing member both vertically and diagonally have required fasteners not screw-less framing connections. Headers used above door or window frames always required fasteners to connect support members and cripples together.

This application includes figure drawings, specifications and claims from earlier provisional applications that have not been claimed or shown in previous applications but pertain to this application.

SUMMARY OF THE INVENTION

The invention is directed towards connecting support members to a longitudinal spacing-bracing framing member when passing through the hole of the support members individually or in tandem as well as at the top and bottom of the support members to the longitudinal spacing-bracing members. In addition, the wall configurations can be arched vertically or horizontally to have a serpentine curved wall configuration.

Another aspect of the invention is that spacer braces between the longitudinal ends of adjacent longitudinal spacing bracing framing members has a hook tongue connection extending upward or downward with an extension with a notched-tab end at the web of the spacer brace for an adjacent space brace with an extension with a receiving hole having grooves for the notched-tab to fit into and allowing the spacer braces to pivot horizontal between each other. On the other hand the flanges can each have an extension with notched-tabs and extensions in the opposing flange ends for receiver holes to connect allowing vertical movement between spacer braces.

Another aspect of the invention is the longitudinal spacer bracing member connection between to support members has flanges extending from the web with lips having lip notches at the longitudinal side edges for the support members with gaps and web notches in the web so that lip notches at the longitudinal side edges of the lips can extend into the gaps of the support member.

The gaps in the web and the web notches form an L-shape gap where the lip notches from the longitudinal spacer-bracing member fit into the web notches. A C shaped spacer brace or a reverse lip spacer brace will interlock into the web notches. The webs in the longitudinal spacer-bracing member can also have a notched-tab profile for additional strength or for additional connectional means by using slot holes or notched-tabs for other connections of various configurations. There are many different hole configurations where the hole side edges conform to the horizontal spacing-bracing member configurations. Some of the hole configurations like a notched-tab having a notched-tab notch with a wider width head for a horizontal spacing-bracing member forms the shape of a notched tab. On the other hand the L-shaped gap where the gap configuration is the profile is a mirror image shape of a notched-tab profile of a horizontal spacer-bracing member with the interior of the gap side edges conform to the spacer brace profile.

The L-shaped gap can be located in the flange of U-shaped spacer brace where the flange gap has a flange notch to connect the lip notches of a crossing framing member. Wider lip notches and flange gaps are used for different shaped crossing framing members.

Another aspect of making a connection between the spacer brace and the hole in the support member is using the side edges of the key hole as well as lip notches in the spacer brace and slot holes in the flanges for the spacer brace to be secured to the support member.

The shape of the hole in the support member is another aspect of connecting the support member and the spacer brace. The hole side edges and the hole bottom edge can be configured differently allowing the spacer brace to be secured differently with the hole configuration at the web of the support members. By having a bent lip with notches the hole side edges might be larger and only the free edge of the lip is notched. On the other hand the entire lip could be notched making a double lip for extra strength. By changing the hole side edges and or the hole bottom edges the spacer brace can have multiple web edges for a notched-tab hole bottom edge to fit into. Another aspect would allow the spacer brace to have bent flanges as well as an angled notched lip for the spacer brace to be secured to the hole in the web of the support member. The different groove or notches in the hole edges of the support member should be configured within the structural configurations of the hole size for the support member.

Another method to secure the ends of two longitudinal ends of spacer braces at the support member is having extensions at the longitudinal ends at the web so the head at the sides of the notched-tab can extend around the hole side edges and allowing the notched-tabs to overlap each other to form another type of connection between the longitudinal end of the spacer braces. When the notched-tab ends overlap each other, the notched-tab notches can interlock to deep hole notches allowing two spacer braces to be installed into the same hole notch. The notched-tabs could be connected together by screws or the head of the notched-tab could be bent to create greater horizontal resistance between the support members and the spacer braces.

Another aspect of the invention is connecting horizontal spacing-bracing members together by having lip notched receiver ends at the ends of the longitudinal spacer-bracing members where the receiver arms and receiver elbows wrap around the lips notches or the flange slot holes to connect the spacer braces at a diagonal to help strengthen the wall framing from bending. The diagonal spacer brace framing can be secured at one end while the opposing end is connected to a sliding connector that fits between another spacer brace that has a smaller width that will slide between flanges brace to form a tight connection between spacer braces and is then secured by fasteners.

There are many different hole configurations where the hole side edges conform to the horizontal spacing-bracing member configurations. Some of the hole configurations like a notched-tab having a notched-tab notch with a wider width head for a horizontal spacing-bracing member forms the shape of a notched tab. On the other hand the L-shaped gap where the gap configuration is the profile is a mirror image shape of a notched-tab profile of a horizontal spacer-bracing member with the interior of the gap side edges conform to the spacer brace profile.

Another aspect of the invention is the shape of the spacer braces and how the spacer braces can be used to form headers above doors but shown as header configuration having a more structural configuration. The same configurations of the horizontal spacing-bracing members and/or the hole side edge at both the interior and exterior side edges can be used to form the beam headers. Also the interlocking connections between a beam insert can also be used to interlock the beam insert.

Another aspect of the invention relates to forming self-locking screw-less metal framing connections between two crossing members where one member is a U shaped spacer brace having a web with two extending flanges having receiver gaps with flange-notches and the other crossing member having at least one web with one flange and at least one lip with or without lip notches. The U shape spacer brace with the receiver gap and flange-notches at both flanges cross a reverse lip spacer brace with a web, a pair of flanges and extending lips so the flanges with the lips can extend into the receiver gap with flanges notches can interlock into the U shaped spacer brace. The protruding lips of the reverse lip spacer brace functions the same as the ledge or rim in the hole of a support member. The support member can be vertically orient typical known in the trades a stud or vertical C channel or horizontal like a floor joist, ceiling joists, rafters or components of floor or roof trusses. By inverting the reverse lip spacer braces the reverse lip spacer brace is a crossing-brace between the bottom chord of a truss or the crossing brace for metal joists when metal joists that have a rim. The same interlocking fusion between spacer braces also occurs when the web forms a perpendicular ledge that engages the flanges of the crossing reverse lip spacer brace. A reverse lip spacer brace can be joined to any shape of spacer braces as long as at least one side has a longitudinal lip that can interlock with the flanges of a crossing reverse lip spacer brace where the flanges has a receiver gap with flange-notch shown as an L-shaped gap with notches for the crossing metal framing members can engage each other. The reverse lip spacer braces can also be connected in tandem by using the receiver hole and the notched tab from a hooked tongue.

BRIEF DESCRIPTION OF THE DRAWINGS

In FIGS. 4 & 5 the notched-tabs extending through the receiver holes, however the width of the spacer brace in FIG. 6 shows is wider than the width of the support members and the extensions at the receiver hole and the hook tongue are tapered so the notched-tabs can pivot for a curved wall.

FIG. 4 shows a hole notch at the lip notch so the lip notch can be secured vertically in the hole notch.

FIGS. 16 & 17 shows the double lip with the free edge facing downward and the lip notches engage the bottom edge of the hole notches.

FIG. 26 shows an elevation of the hole in the support member with some of the various hole edge configurations that the notches could show. The inside edges of the hole can vary in shape and location depending on the shape of the spacer brace and where the hole notches in the protrusion are located. The protrusions and notches accomplish the same function as they both keep the spacer brace lodged in the hole notches or the side or bottom edges of the hole.

FIGS. 32-36 are similar except sometime the lip notched-receiver would be connected from the top side and the notches would be connecting to the lip notches. On the other hand the lip notched-receiver would be connected from the bottom side of a spacer bracer and the notches of the notched-receiver would be extending into the slot holes in the flanges.

FIG. 59 shown the framing member engaging the raised web with angled slot holes that intersect the notched tabs of the framing members.

DESCRIPTION OF THE PREFERRED EMBODIMENTS

Figure 1:
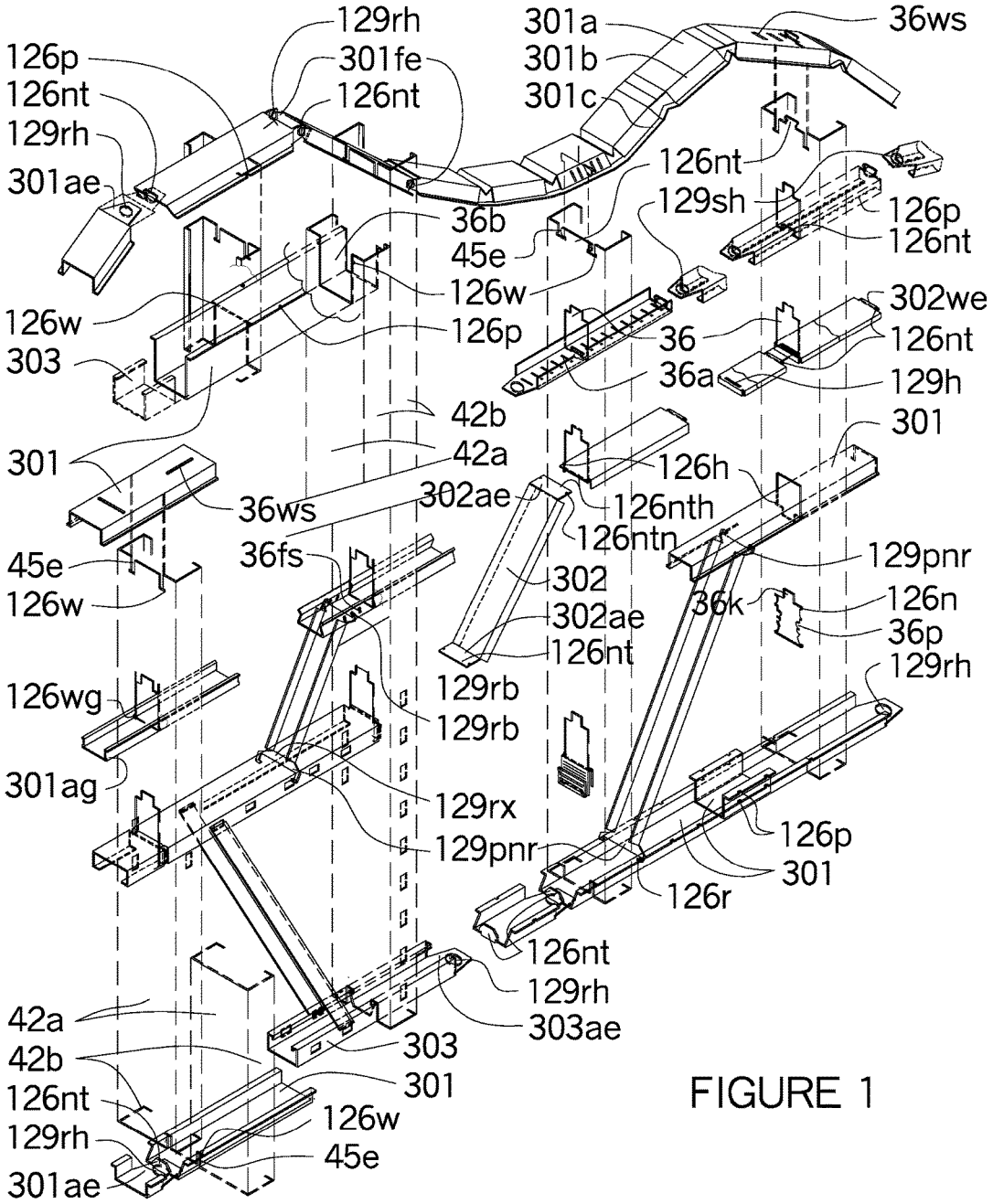
FIG. 1 shows an isometric view of four support members having various configurations and crossing members all having various self-locking connections using support tabs, notched-tabs extending from hook tongues at the webs or notched-tabs extending from hook tongues at the flanges into receiver holes at the webs of flanges, or notched-tabs extending from the hole bottom edges into web slot holes or into lip notches of a C shaped spacer braces. Web notched-tabs at the longitudinal end of adjacent spacer braces can overlap adjacent spacer braces at the holes in support members, Diagonal reverse lip spacer braces with lip notches can have lip-notched receivers attached to lip notches or can be attached at the flange receiver slot holes at the opposing ends. Notched-tab can extend from the web of the support member into the slot holes of the reverse lip spacer braces or the flanges slot holes at both flanges. The spacer braces can have bend in the web, flanges or lips of the spacer braces to obtain short radius curves. Headers over doors and windows can be installed with the base spacer brace bearing into the cut out with notches in the cripple at the base of the opening. Notches can be installed protruding from the hole edges so different configured spacer braces can be installed in the hole side edges without using lip notches and spacer braces can be smaller and can slide between the flanges of a larger spacer brace.

FIG. 1 shows an isometric view of four support members having various configurations and crossing members all having various self-locking connections, using notched-tabs 126*nt* extending from hook tongues 128 at the webs 301*a* or the webs 301*a* or 302*a* with bent extensions 301*ae* or 302*ae* having notched-tabs 126*nt* ends overlapping holes 36 with or without hole notches 126*h* or notched-tabs 126*nt* extending from hook tongues 128 at the flanges 301*b* into receiver holes 129*h* at the webs 301*a* or flanges 301*b*, or notched-tabs 126*nt* extending from the hole bottom edges 36*be* into web slot holes 36*ws* or into lip notches 126*p* of a C shaped spacer braces 302. The notched-tabs 126*nt* at the ends of adjacent spacer braces at the webs of either 301*a* or 302*a* can overlap adjacent spacer braces at the holes 36 in support members. A diagonally oriented reverse lip spacer brace 301 with lip notches 126*p* can have lip-notched receivers 129*pnr* attached to lip notches 126*p* or can be attached at the flange slot holes 36*fs* at the opposing ends. Notched-tabs 126*nt* can extend from the web 42*a* of the support member into the web slot holes 36*ws* of the reverse lip spacer braces 301 or the flanges slot holes 36*fs* at both flanges 301*b*. The spacer braces can have bend in the web, flanges or lips of the spacer braces to obtain short radius curves. Headers over doors and windows can be installed with the base spacer brace bearing into the cut out with web notches 126*w* in the cripple at the base of the opening. Notches can be installed protruding from the hole edges so different configured spacer braces can be installed in the hole side edges without using lip notches 126*p* and spacer braces can be smaller and can slide between the flanges 301*b* of a larger spacer brace.

Figure 2:
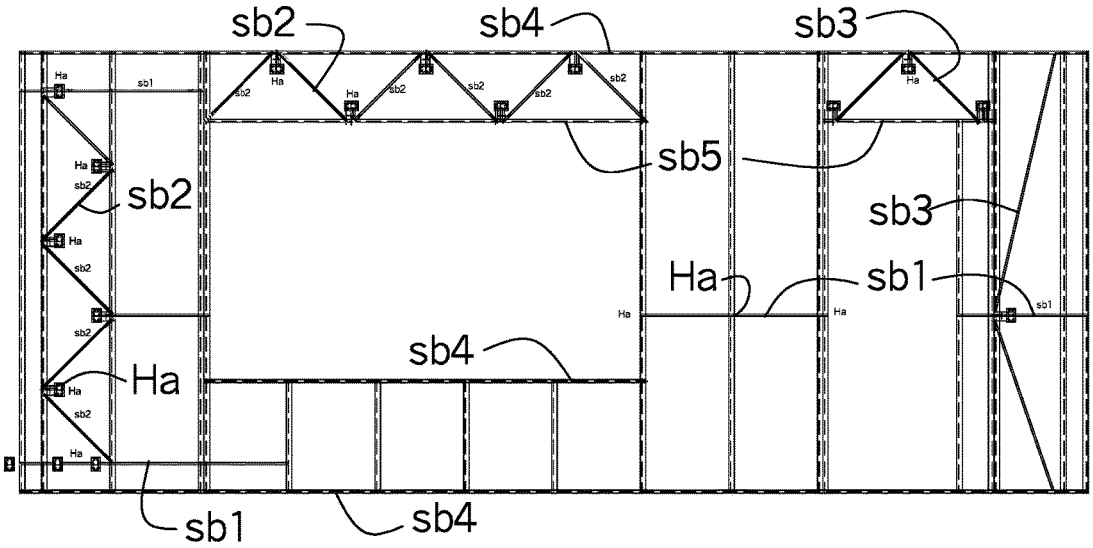
FIG. 2 shows an elevation of a standard metal framed wall or a metal framed wall that has a curvilinear shaped wall using different framing components to form the curved wall.

FIG. 2 shows the elevation view of a metal framed wall. The vertical support members are connected at the holes noted as Hb1 or 36 with various shaped spacer braces shown as sb1, sb2, sb3, sb4 or sb5 shown in other numerous views. The wall elevation could be a straight wall or the framed wall could have a curvilinear shape by installing the metal support members into a serpentine configuration. There are various ways to secure the horizontal bracing member to the support members so the spacer braces can form a curved wall. The spacer brace sb1 is shown as interior oriented spacer brace passing through any of the notch configurations shown through the drawings. The hole 36 can be configured in many different shapes with various hole notches 126*h* and or various spacer braces configurations.

Figure 3:
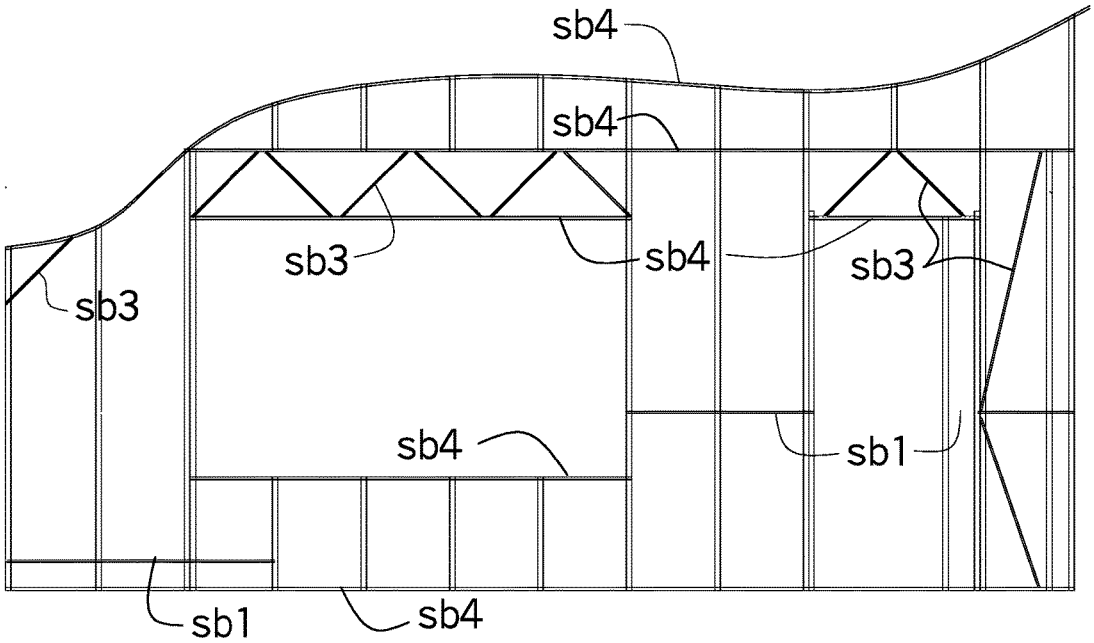
FIG. 3 shows an elevation of the metal framed where the top spacer brace is undulating vertically creating an arched looking framed wall showing door and window framed opening with a curvilinear top spacer brace plate.
Figure 18:
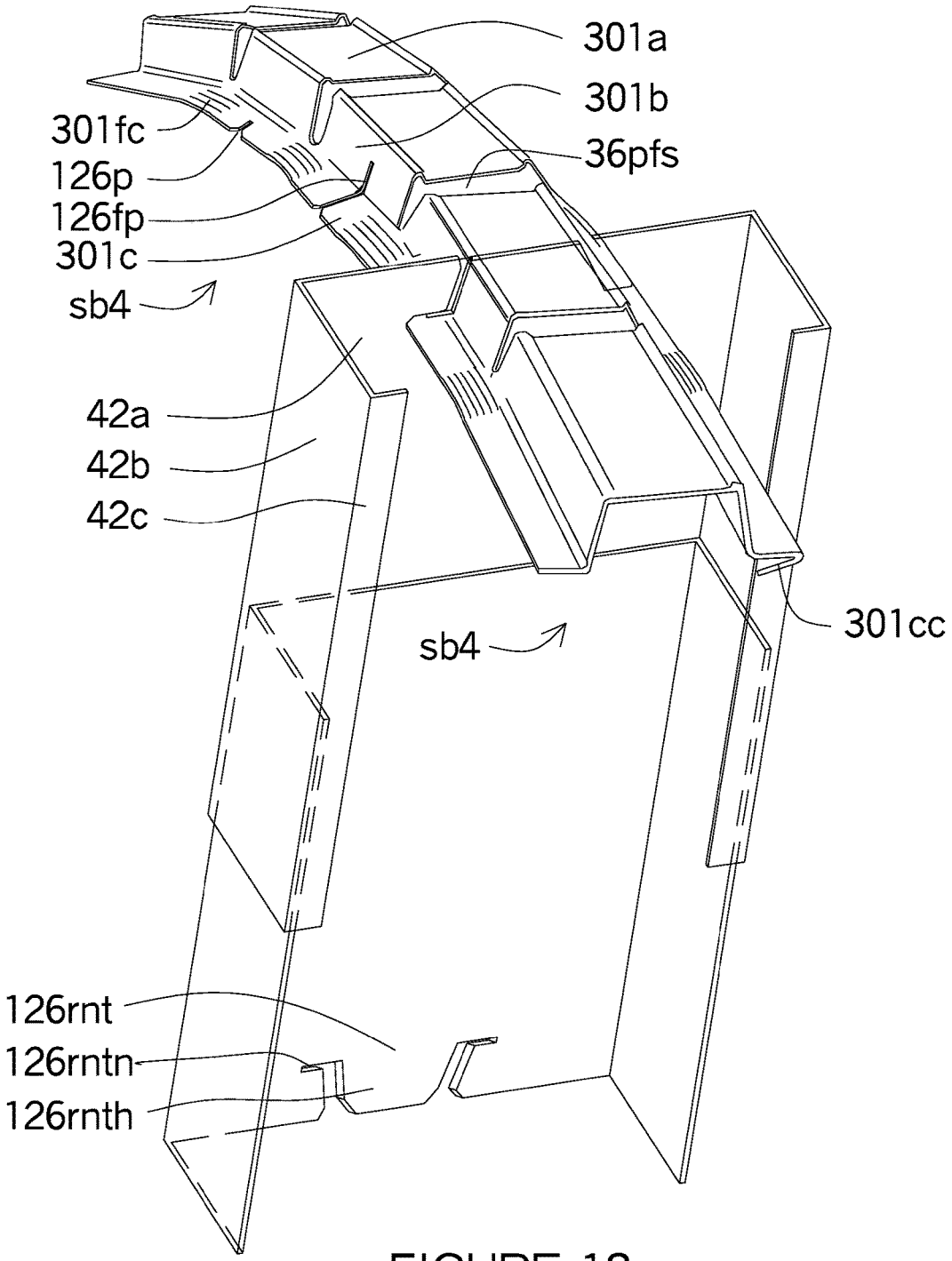
FIG. 18 shows the L-shaped notch with slope side at the bottom end of the support member of a U shaped support member and is fitting into the interior side of the C shape support member where the top end has a reverse profile of the L-shaped notch, with a curving profile where the web and flanges have an open cut and the lips are allowed to bend. The left lip shows the lip notch with flare ends, another lip notch where the lip notch is extended into the flange notch.
Figure 21:
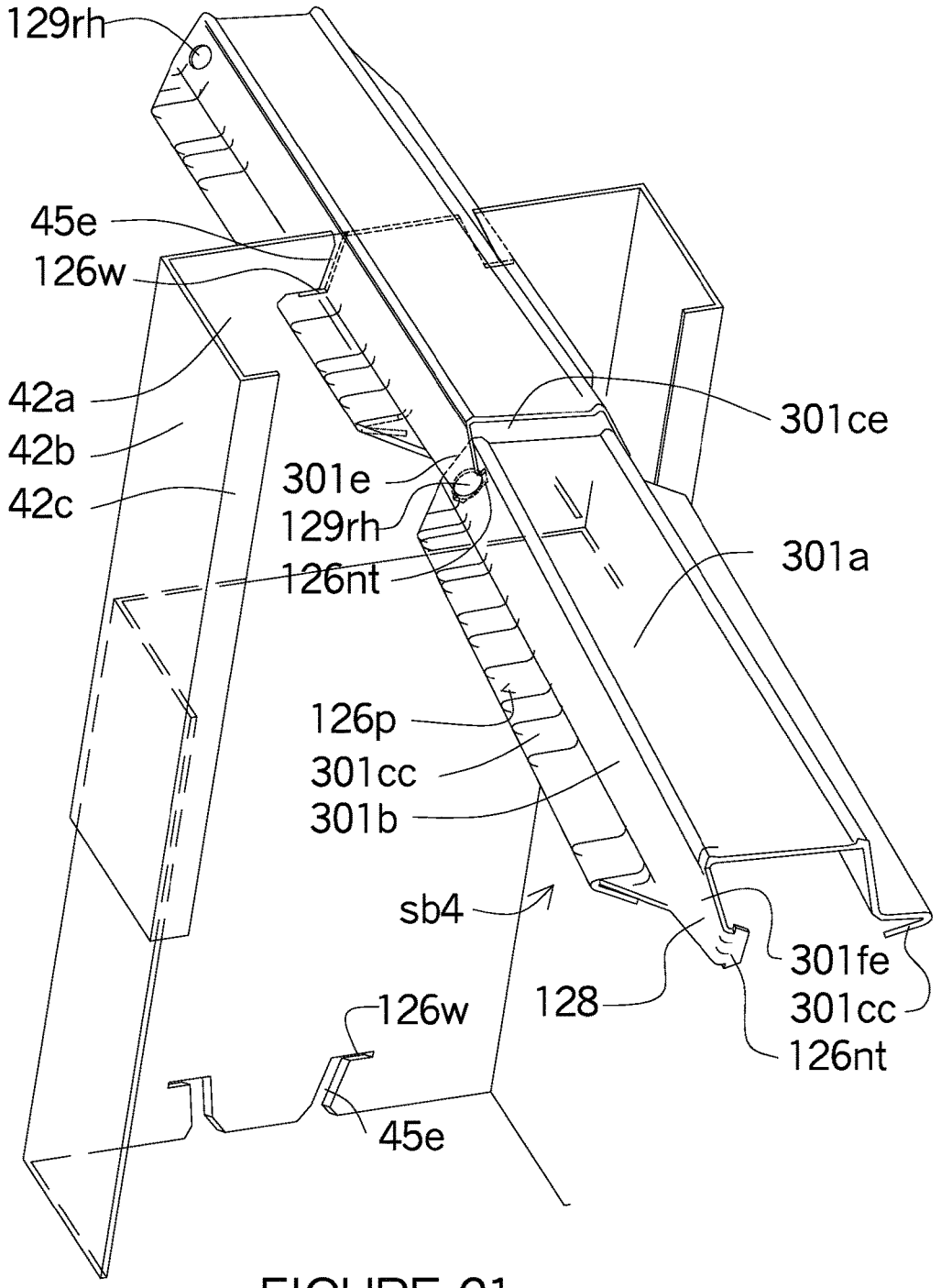
FIG. 21 show the flange extension or the hooked tongue with its notched-tab extending inward toward the opposing lip for the notched-tab to fit into the receiver hole on the flange of the adjacent spacer brace.

FIG. 3 shows a similar wall elevation as FIG. 2, however the top of the wall is arched in a vertical direction allowing the spacer braces to either be bent or have pivot points so the spacer braces can be connected to support members as shown in FIGS. 18 & 21. The vertical arching at the top of wall can be connected as shown while all other metal framing can be completed as shown in FIG. 2.

Figure 4:
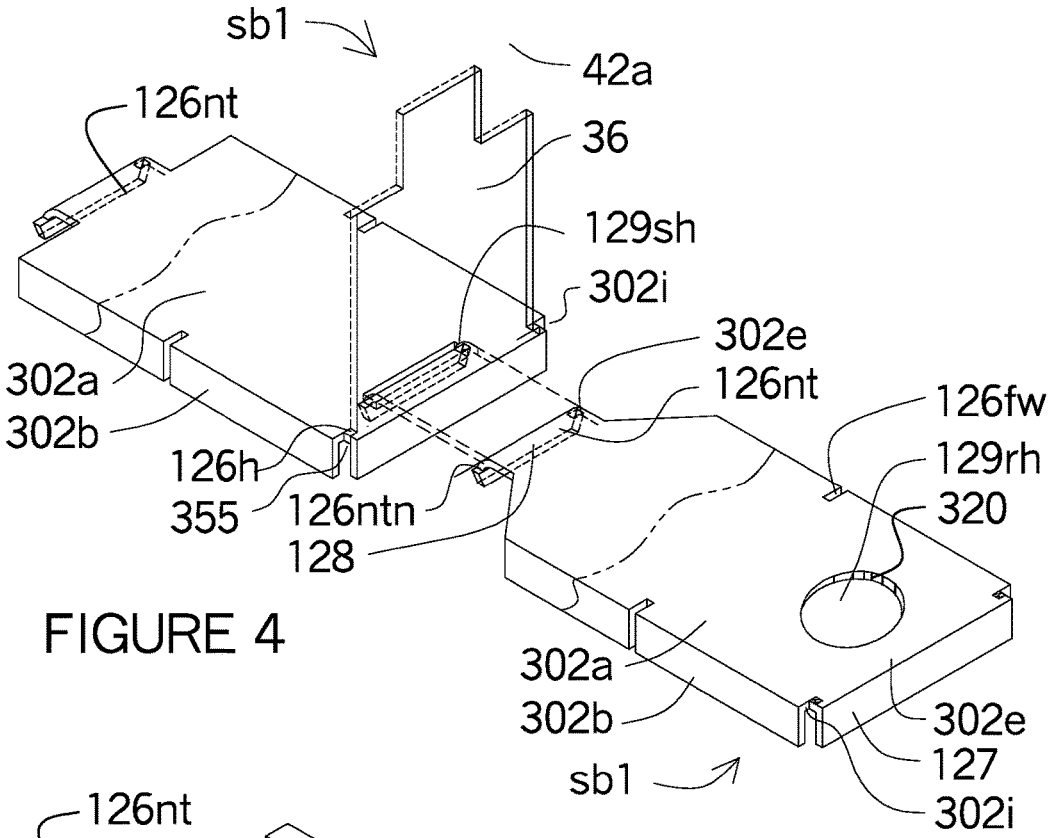
FIG. 4 shows the space brace being connected to an adjacent spacer brace having one end engaged at the hole with a hook tongue having a notched-tab extend into the slot hole receiver. A round receiver hole shows the opposing end having angular extension allowing the spacer brace to be angled horizontally for an undulating framing wall.

FIG. 4 shows two U shaped spacer braces 302 having a web 302*a* with two flanges 302*b* extending downward from the longitudinal sides of the web 302*a*. The left U shaped spacer brace 302 shows a notched-tab 126*nt* extending downward from the web extension 302*we*. The opposing end of the web 302*a* shows a receiver slot hole 129*sh* located near the hole bottom edge 36*be*. The web 302*a* is indented 302*i* at the hole 36 with the indentation 302*i* extending into the flanges 302*b*. The flanges 302*b* and the web 302*a* rest against the plane of the web 42*a* of the support member on one side and the web 302*a*, and the web 302*a* forms a hook finger 127 that extends over the hole bottom edge 36*be* which is the anchor space 355 for the inside plane of the hook finger 127 to rest against from the opposing side of the web 42*a* from the support member. The right spacer brace 302 has a hook tongue 128 with a notched-tab 126*nt* extending downward, however the extension 302*we* has tapered side edges. The tapered side edges are angled so the notched-tab 126*nt* can fit into the round-hole receiver 129*rh* as shown in the web 302*a* on the opposite end of the right U shaped spacer brace 302. The round-hole receiver 129*rh* has ridges 320 at the side edges of the round-hole receiver 129*rh*. The ridges 320 are spaced at intervals to allow the notched-tab 126*nt* to fit between the ridges 320 to stop the notched-tabs from rotating. The right U shaped spacer brace 301 has the tapered side edges to rotate when the notched-tab 126*nt* is inserted into the round-hole receiver 129*rh*. Once the notched-tab 126*nt* is located at the proper angle between adjacent U shaped spacer braces 302 the head 126*nth* can be bent having the head 126*nth* being secured in the round-hole receiver 129*rh*. The web extension can be short or long and the receiver hole can be a receiver slot hole 129*sh* or a round-hole receiver 129*rh* so the notched-tab 126*nt* can be swiveled to be oriented at an angle. Additional round-hole receivers 129*rh* can be added to the web 302*a* so additional hook tongues 128 having notched-tabs 126*nt* (not shown) could be inserted from a crossing spacer brace from a perpendicular wall having support members. Any shape spacer brace could be used to form the pivotal configuration as explained above. For example (but not shown) a C shaped spacer brace 303 could be used and a notched-tab 126*nt* could be installed in the support member or the floor spacer brace could just have a groove at the flanges for the web 42*a* of a support member to fit into. The receiver slot hole 129*sh* with the notched-tab 126*nt* can be used as an end connections between abutting lengthy spacer braces between support members not just short segmented section to form curvilinear walls. When the U shaped spacer braces 302 are wider than the hole 36, the plane on both side of the hole 36 can be inserted into the flange-web notch 126*fw* in the flange 302*b* and web 302*a* of the spacer brace 302. If the spacer brace was a reverse lip spacer brace 301 the lip notches 126*p* would also give additional support at the hole 36 intersection. Another alternative solution in FIG. 4 shows the flanges 302*b* and the web 302*a* (referred to also as a web-flange notch 126*fw* that shows the hook FIG. 127 where the web 302*a* has an extension 301*e* that extended over the hole bottom edge 36*be* and the hook finger 127 extension downward. The hole bottom edge 36*be* and the hole side edge 36*se* form a hole notch 126*h* at the corners of the hole 36. When the web 302*a* of the U shaped spacer braces 302 extends into the hole notch 126*h*, the U shaped spacer brace 302 will not move up and down within the hole notch 126*h*.

Figure 5:
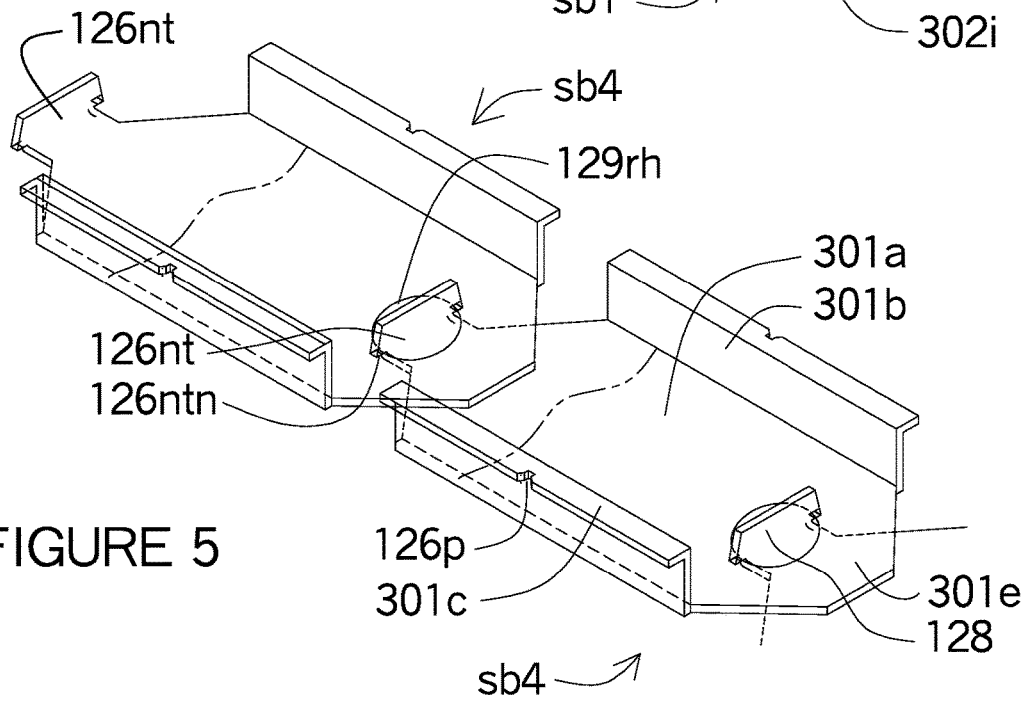
FIG. 5 is similar to FIG. 4 except the spacer brace is shown as a reverse lip spacer brace having a web, two longitudinal walls with extending longitudinal lips with notches extending inward from the free edge with the lips facing upward and the web extension being a hook tongue with the notched-tab facing upward with both webs having an extension having tapered sides for the notched-tab to fit into the receiver hole forming the vertical wall can have an undulating wall configuration.
Figure 37:
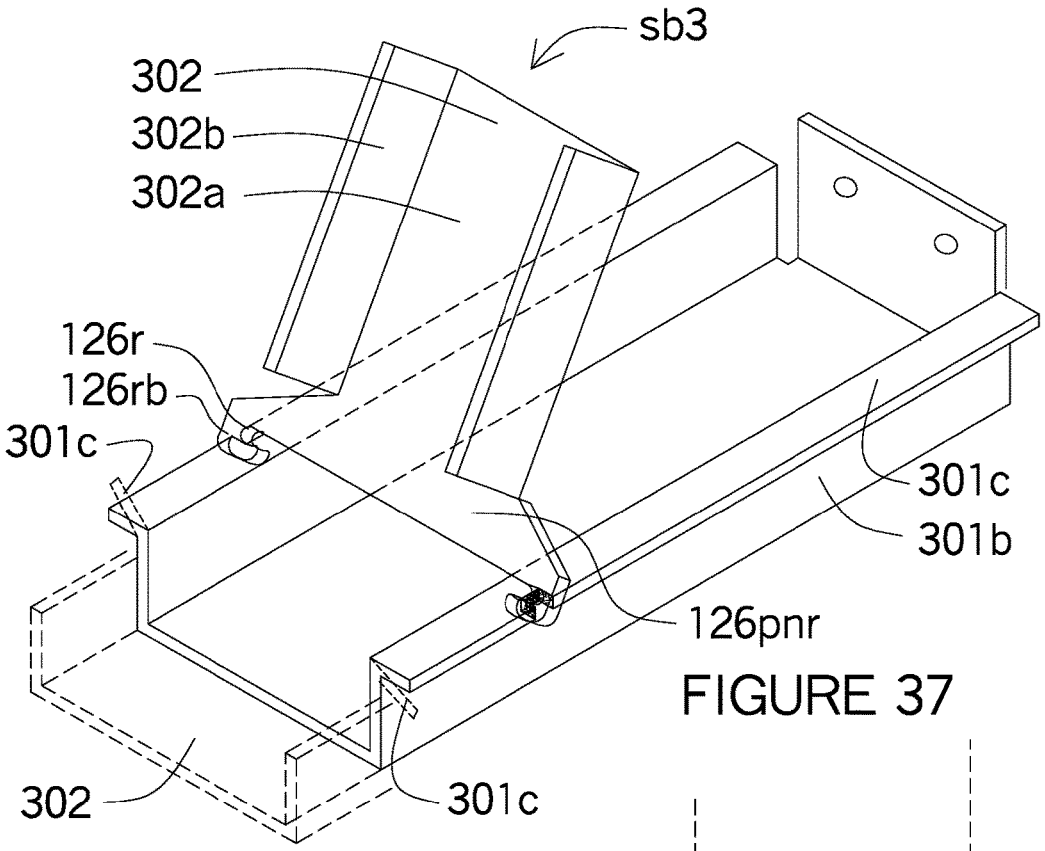
FIGS. 37-38 The reverse lip spacer braces show the lips extending upward and downward at an angle to additional strength for the lip notched receiver, plus have the reverse lip spacer brace shown as a bracket to allow the bracket to slide so the lip notched receiver can have a tighter fit and be connected with fasteners.

FIG. 5 is similar to FIG. 4 except the spacer brace is shown as a reverse lip spacer brace 301 where the underside of the web 301*a* is against a floor and the flanges 301*b* extend upward with lips 301*c* extending outward. The lips 301*c* are shown having lip notches 126*p* shown previously being installed in the web notches 126*w* of the support member. The reverse lip spacer braces 301 are shown having an extension 301*e* at both ends of the web 301*a* with the left end having a notched-tab 126*nt* extending upward with the opposite end having a round-hole receiver 129*rh* located near the extension 301*e*. Both extensions 301*e* are tapered so when the notched-tab 126*nt* is inserted into the round-hole receiver 129*rh*, the notched-tab 126*nt* is allowed to swivel within the round-hole receiver 129*rh*. The head 126*nth* can be bent once the reverse lip spacer brace 301 is oriented to the desired angle to then be secured to the floor for installation of the support members that fit into the lip notches 126*p* and into the web notches 126*w* in the L-shaped gap 45*e*. When completed drywall or other types of wall board can be mounted to the support members to form a curved wall. On the other hand, the hook tongue 128 and the receiver slot hole 129*sh* can be used at the end of a reverse lip spacer brace 301 in lieu of the notched-slide extension 126*se* at the web 301*a* that connects to hole side edge 36*se* as shown in FIG. 37.

Figure 6:
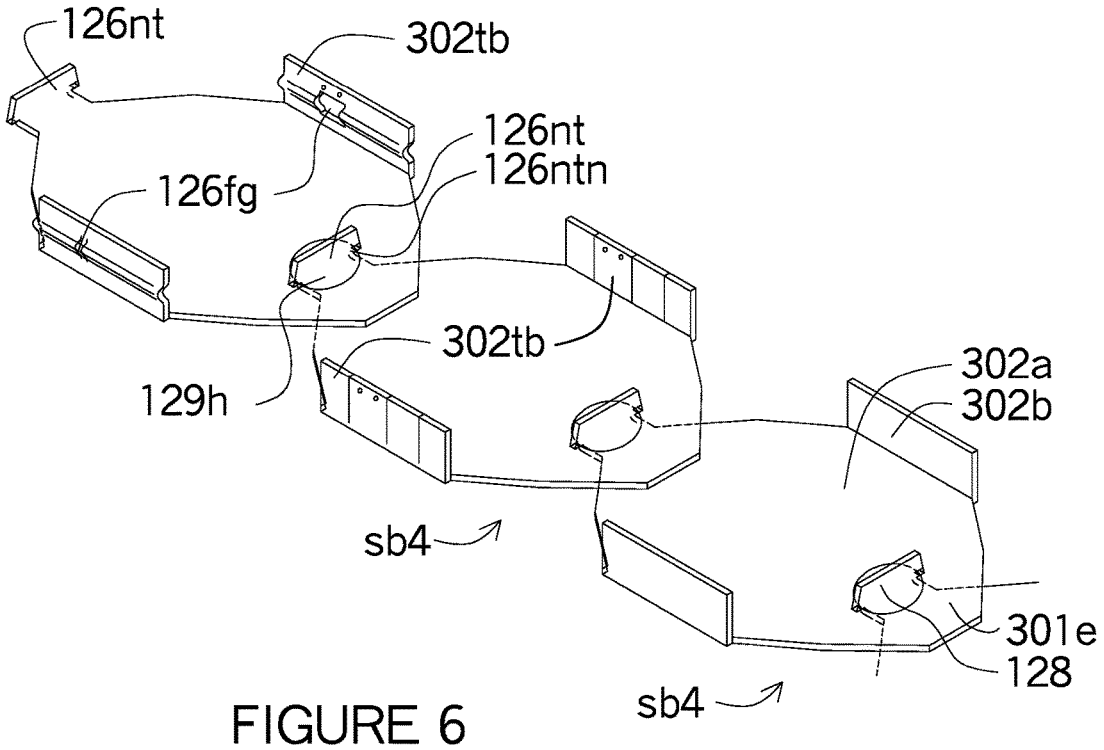
FIG. 6 is similar to FIGS. 4 & 5 showing a U shaped spacer brace where the flanges extend on the outside edges of the vertical flanges of the support member, but the extensions of the longitudinal spacer braces are shorter so the notched-tabs with the receiver holes are between the vertical support members allowing the undulating wall to pivot in the receiver holes having the notched-tabs be the pivots.

FIG. 6 is similar to FIG. 5 except a U shaped spacer brace 302 has a wider web 302*a* than the web 301*a* of the reverse lip spacer brace 301 in FIG. 5. The middle U shaped spacer braces 302 shows the base of a support member between the flanges 302*b* bearing on the web 302*a* of the U shaped spacer brace 302*a*. The U shaped spacer brace 302 can be manufactured in short segments or longer lengths where additional support members can be installed to the U shaped spacer brace 302 by fastening screws (not shown) from the support member flanges 42*b* into the flanges 302*b* of the U shaped spacer brace as standard metal framing are presently connected. The longitudinal ends of the U shaped spacer brace 302 are shown having web extension 302*we* extend from the webs 302*a* to notched-tabs 126*nt* extending upward from the hook tongue at one end and a receiver hole 129*h* installed in the web extension 302*we* at the opposing end. The web extensions 302*we* can have receiver holes 129*h* or notched-tab 126*nt* at both ends depending on the configuration of the wall framing. In addition, the flanges 302*b* can be formed as tabs 302*bt* that can be bent inward to secure the lip 42*c* and web 42*a* between the bent tabs or have a flange-bulge notches 126*fg* in the flanges 302*b* to correspond to the flanges 42*b* of the support member to the flange-bulges notches 126*fg* in the flanges 302*b* of the U shaped spacer brace 302. The three short U shaped spacer braces 302 can be used to form serpentine curvilinear walls or just connecting different wall framing segments together.

Figure 7:
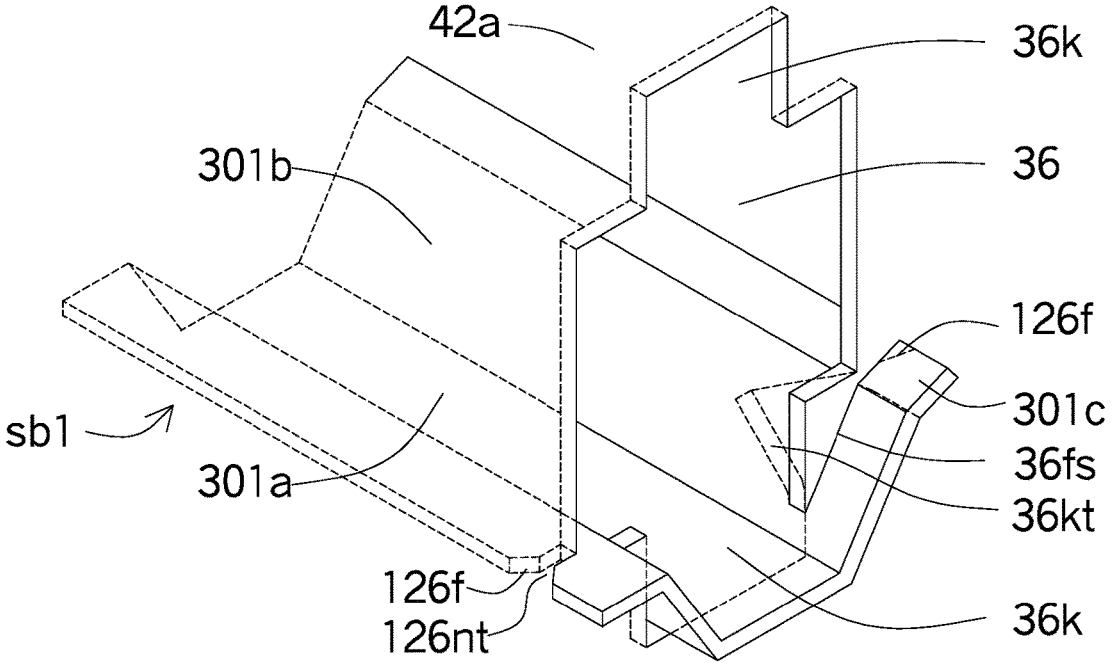
FIG. 7 shows the shows the same reverse lip spacer brace as shown in FIG. 8 except the right side shows an angled lip and flange where the lip flange and lip notch can be installed face up or face down.
Figure 8:
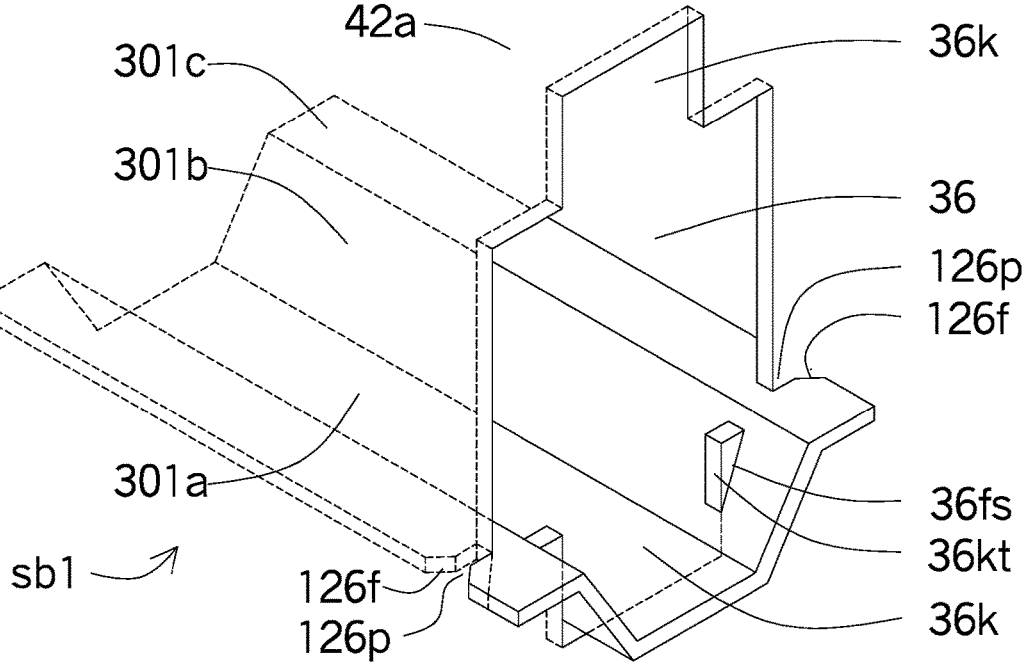
FIG. 8 shows the reverse lip spacer brace having the angled flange with a flange notch or slot hole where the key hole bottom edge and the key hole have their edges fit into the flange slot hole in the flanges along with the lip notches of the reverse lip spacer brace at the holes side edges reverse lip spacer brace hole opening fits into the slot hole and the lip has an extension and the extension has a lip notch to secure the reverse lip spacer brace.

FIG. 7 and FIG. 8 are similar as both are a reverse lip spacer brace 301 where the web 301*a* is resting on the hole bottom edge 36*be* of the support member, but at the bottom edge of the key hole 36*k*. Both FIG's show the angled flanges 301*b* and have lip notches 126*p* at the free edges of the lips 301*c* along with flare edge 126*fe*. FIG. 5 shows a flange slot hole 36*fs* in the middle of the flanges 301*b* so the hole bottom edge 36*be* and the side edge of the key hole 36*k* can fit into the flange slot holes 36*fs*. The edges of the key hole 36*k* have key tabs 36*kt* that protrude through the flange slot holes 36*fs* and are long enough so the key tabs 36*kt* can be bent to secure the reverse lip spacer brace 301 to the support member. Additional spacer braces (not shown) could be stacked and secured above the reverse lip spacer brace 301 by bending the key tab 36*kt* over the flange slot holes 36*fs* of both spacer braces. On the other hand FIG. 7 shows a large flange slow hole 36*fs* that extends from the flange slot hole 36*fs* into and through the lip notch 126*p* making a continuous flange-notch 126*f*. The right lip 301*c* in FIG. 7 is bent at an angle forming another angled flange or just called a lip 301*c*. The angled lip 301*c* gives additional flexibility.

Figure 9:
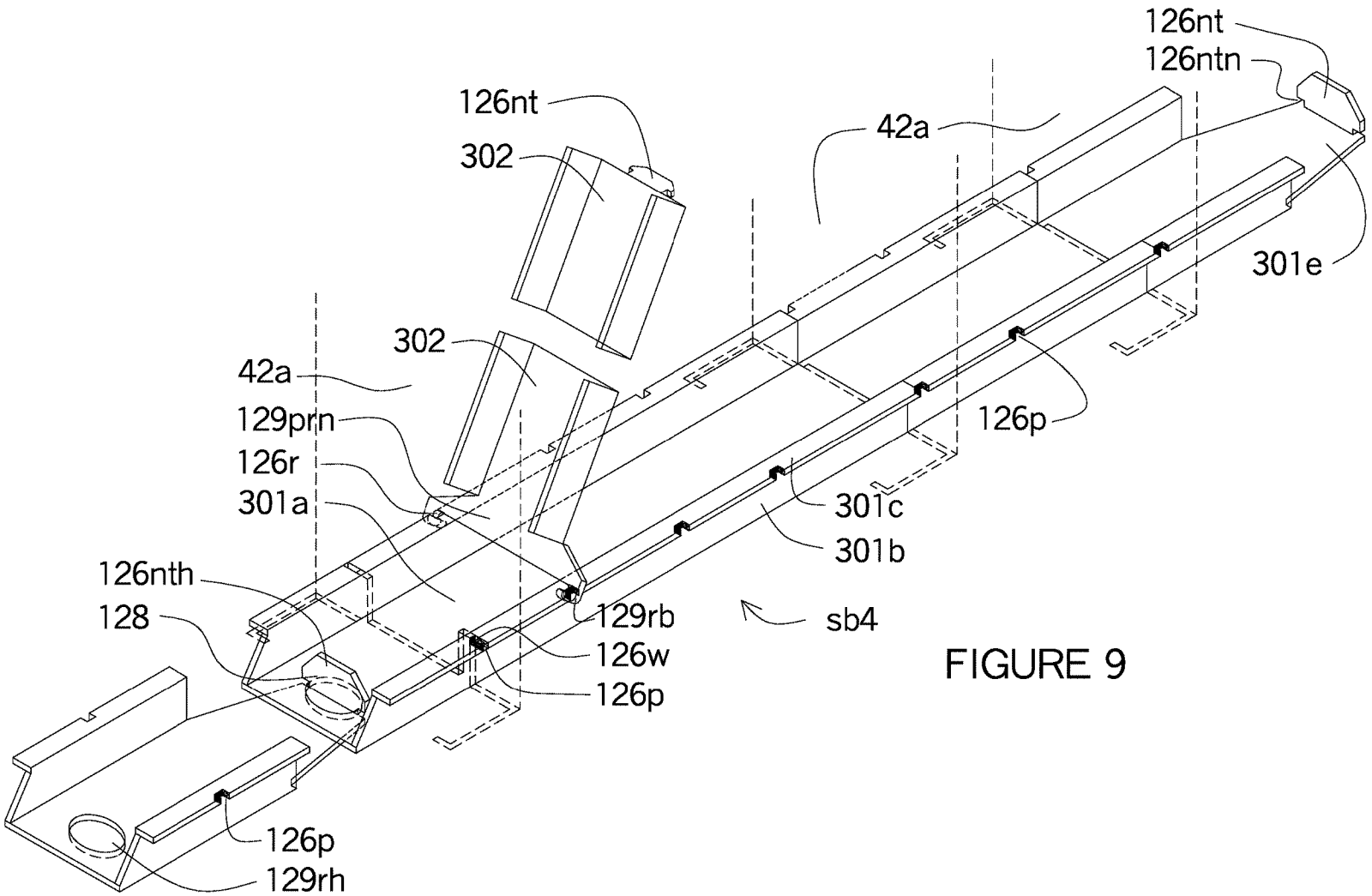
FIG. 9 shows the reverse lip spacer brace having the bottom side on a floor with the support members and a diagonal spacer brace intersecting at the lip notches where the notched-tab extends upward from the hook tongue at the web with the receiver hole is at the opposing end of the web.
Figure 10:
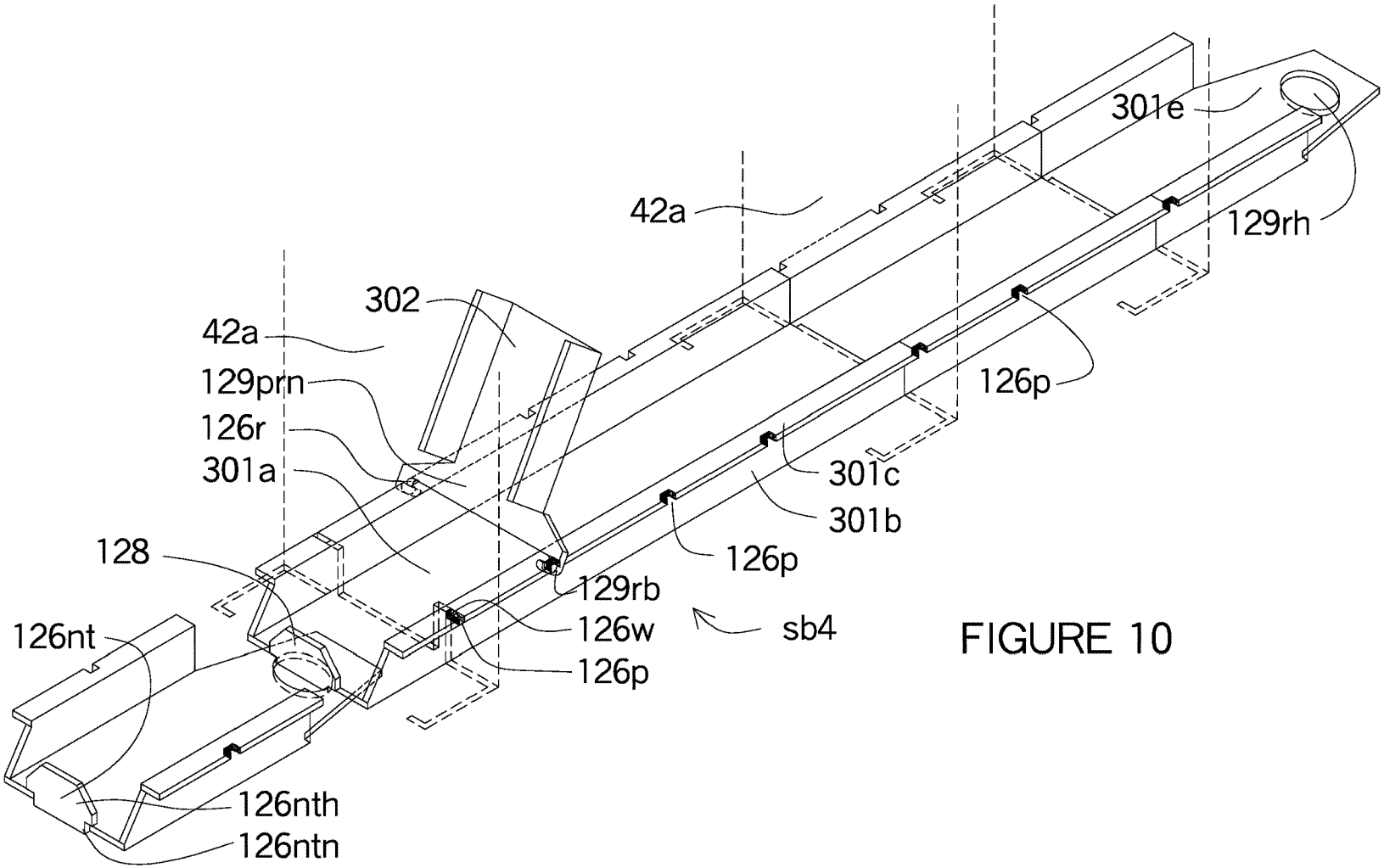
FIG. 10 is similar to FIG. 9 except the notched-tab is directly attached to the web having the extension at the notch and the notched-tab extends upward and the opposing web has the extension with the receiver hole.

FIGS. 9 & 10 both show a horizontally oriented reverse lip spacer brace 301 having a longitudinal web 301*a* with the outside plane of the web 301*a* facing a floor with the side walls extending upward the length of the web 301*a* with lips 301*c* extending from the flanges 301*b* outward lips 301*c* and having lip notches 126*p* extending inward from the outer longitudinal edges. One end of the longitudinal web 301*b* shows an extension 301*e* with a hook tongue 128 having a notched-tab 126*nt* at the end extending upward with notches 126*ntn* and a notched-tab head 126*nth* being wider that width of the notched-tab 126*nt* so the notched-tab head 126*nth* extends over beyond the notched-tab notches 126*ntn*. The opposing end of the web 301*a* shows a round-hole receiver 129*rh* near the end of the opposing end. The round-hole receiver 129*rh* shows a notched-tab 126*nt* from an adjacent reverse lip spacer brace 301 extending above the round-hole receiver 129*rh* so the notched-tab notches 126*ntn* extend through the round-hole receiver 129*rh* so the notched-tab head 126*nth* extends above the web 301*a* with the top edge of the notched-tab notch 126*ntn* extending over the web 301*b*. The notched-tab head 126*nth* can be bent to allow for the adjacent reverse lip spacer brace 301 to be securely fixed to the web 301*a*. The edges of the receiver hole 129*h* has ridges to keep the reverse lip spacer brace 301 from moving. Support members are shown (in ghost) as C channels 42 being connected via the web gaps 45*w* and secured at the web notches 126*w* and the lip notches 126*p* of the reverse lip spacer brace 301. In addition a lip notched-receiver 129*pnr* is shown being connected to the lip notches 126*p* and further described in FIG. 32. FIG. 10 is similar to FIG. 9 except the pivot point of the notched-tab 126*nt* is at the end of the web 301*a* and the receiver hole 129*h* is located at the extension 301*e* with its tapering side edges at the opposing end of the web 301*a*. By located the notched-tab 126*nt* near the support member and directly attached to the web 301*a* the notched-tab 126*nt* has additional strength. Many notched-tabs 126*nt* are located along the lips 301*c* for additional support members or closer spacing of the support members. There are several lip-notched receivers that are shown in FIGS. 31-38 that will be explained later.

Figure 11:
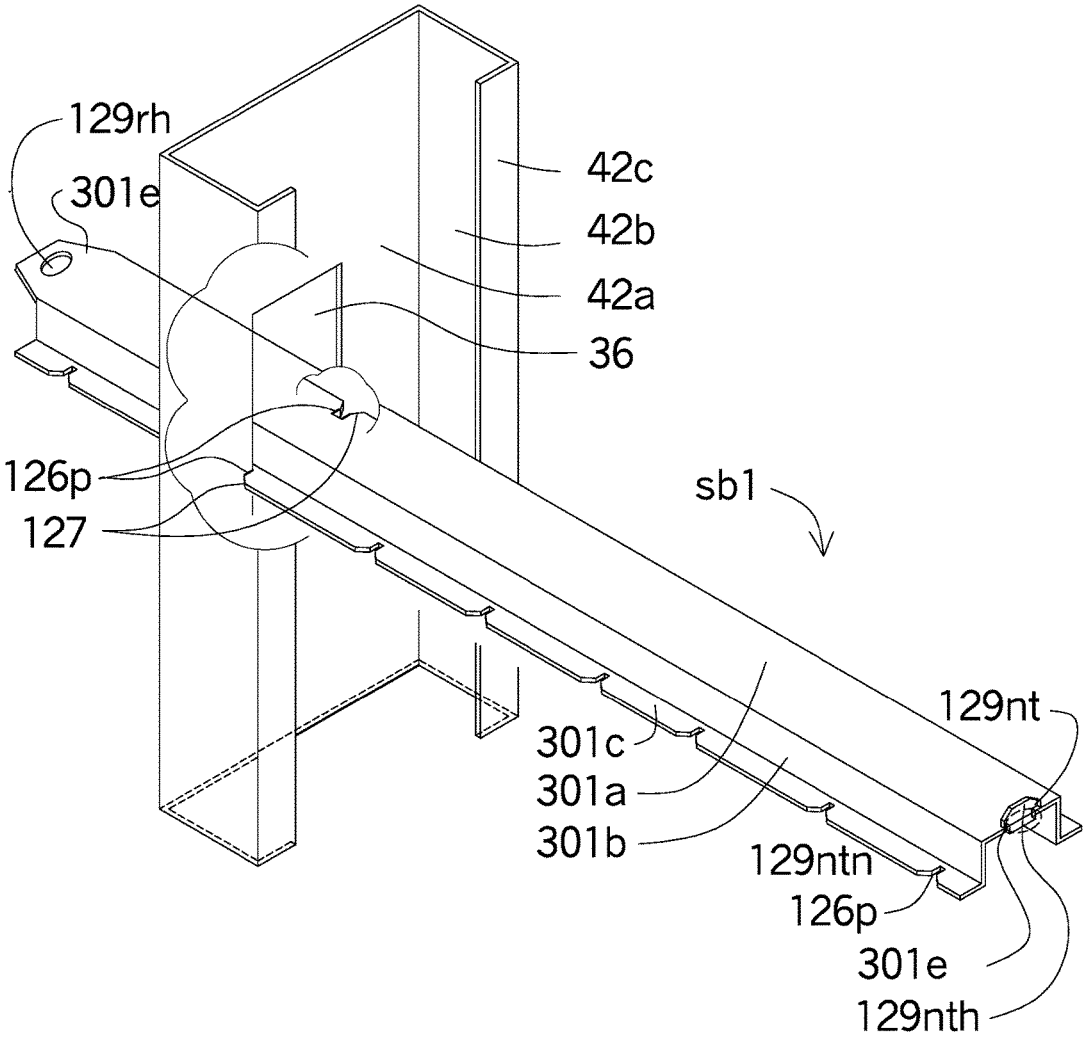
FIG. 11 shows the same profile of the reverse lip spacer brace in FIG. 10 except the reverse lip spacer brace is facing downward and the lip notches are installed in the hole notches at the hole side edges and the notched-tab at the longitudinal end of the web is extending upward and the receiver holes at the opposing end has a web extension where the receiver holes are located so an adjoining reverse lip spacer braces with its notched-tab can fit into the receiver hole and the adjacent reverse lip spacer brace can be oriented at a diagonal.

FIG. 11 shows the same profile of the reverse lip spacer brace 301 in FIG. 10 except the interior side if facing downward and the lips 301*c* are resting on the hole bottom edges 36*be* with the lip notches 126*p* extending into the hole notches 126*h* formed by the holes bottom edge 36*be* and the hole side edges 36*se*. The longitudinal reverse lip spacer brace 301 is shown having numerous lip notches 126*p* for addition support members to be installed into the lip notches 126*p*. At the longitudinal ends at the web 301*a* shows a nt-extension 126*nte* extending outward then upward toward the head 126*nth* of the notched-tab 126*nt*. The nt-extension 126*nte* becomes part of the nt-notch 126*ntn* and the nt-head 126*nth* becomes to top side of the nt-notch 126*ntn* of the notched-tab 126*nt*. The nt-extension 126*nte* not only connects the nt-head 126*nth* of the notched-tab 126*nt*, but is extended long enough for an adjoining reverse lip spacer brace 301 to extend over the notched-tab 126*nt*. The reverse lip spacer brace 301 shows the opposing end also having a web extension 301*e*, however the extension is the width of the web 301*a* then tapered to allow for a receiver hole 129*h* to be installed in the web extension 301*ae*. The receiver hole 129*h* extends over the notched-tab 126*nt* of an adjacent reverse lip spacer brace 301. The tapered sides of the web extension 301*ae* allows for the adjacent reverse lip spacer brace 301 to be horizontally oriented at an angle at the web extension 301*a* at the notched-tab 126*nt*. After installation of the notched-tab 126 into the receiver hole 129*h* the nt-head 126*nth* can be bent to more firmly secure the nt-head 126*nth* to the web 301*a* plus the receiver hole 129*h* has ridges 180 previously shown to additionally secure the notched-tab 126*nt*.

Figure 24:
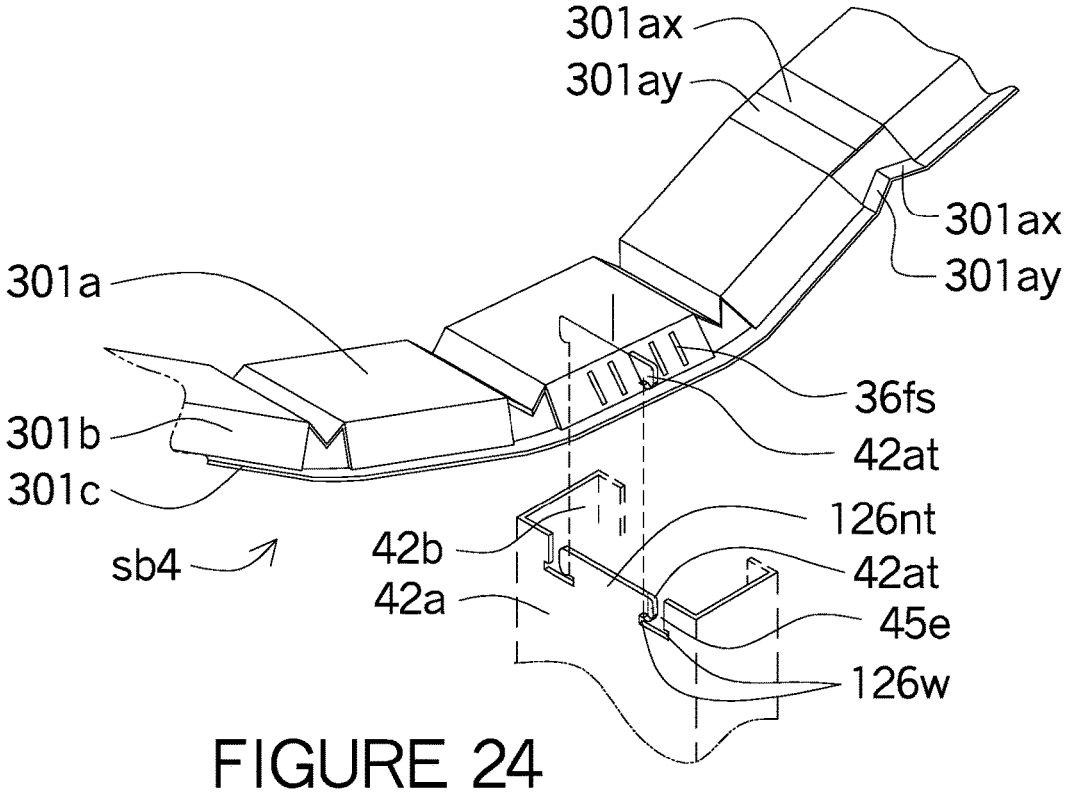
FIG. 24 shows the web of the support member having a notched-tab profile at the interior side edge of the two L-shaped gaps where the web notches fit into the lip notches of the longitudinal spacer braces where the flanges have slot holes for the head of the notched-tabs can fit into.
Figure 25:
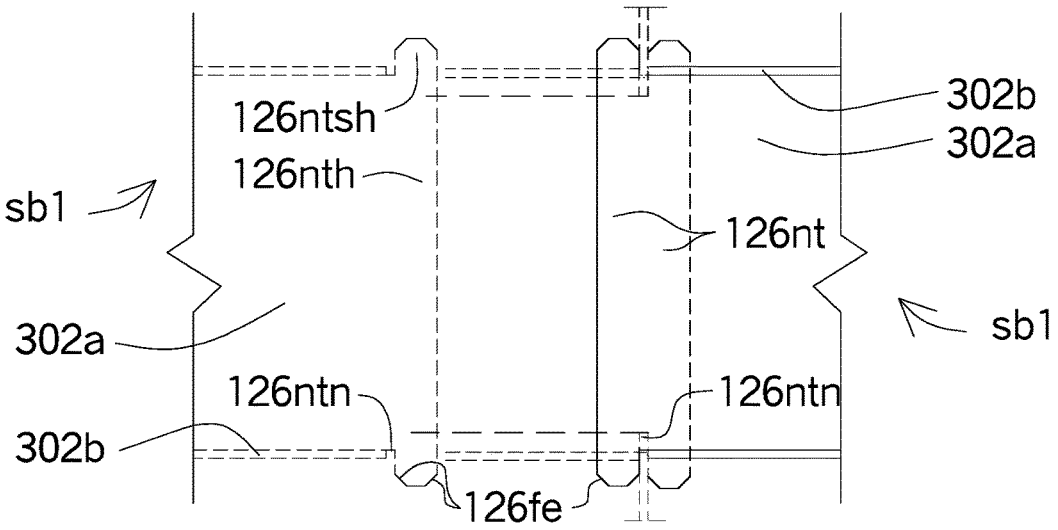
FIGS. 25-28 shows different views of the notched-tab at the ends of the spacer brace most clearly shown in FIG. 25 having the web extend through the holes of the support member with notches extend around both side planes of the hole with the head of the notched-tab extending through to the opposite side of the hole opening. When the head of each notched-tab extends through the hole in opposite directions, the notched-tabs are basically level between each other and secured together by the notches in the notched-tab. On the other hand
Figure 26:
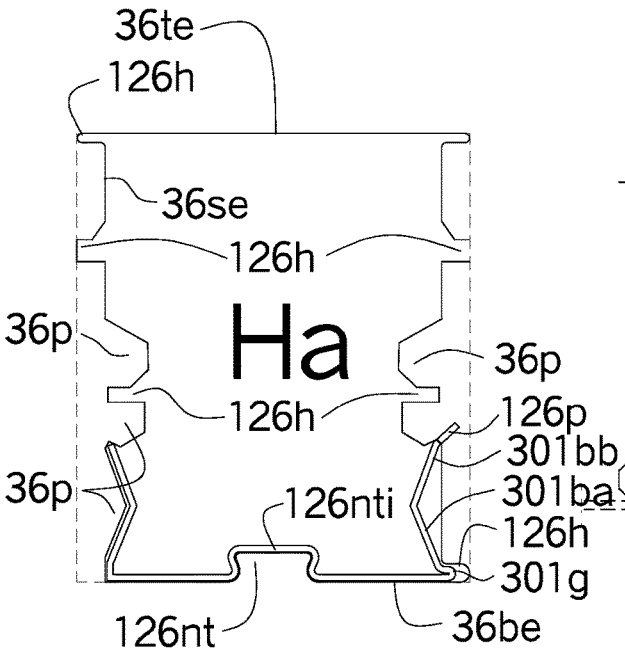
Figure 27:
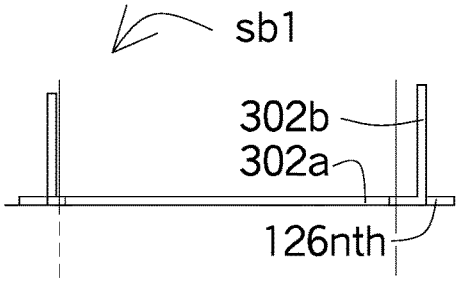
Figure 28:
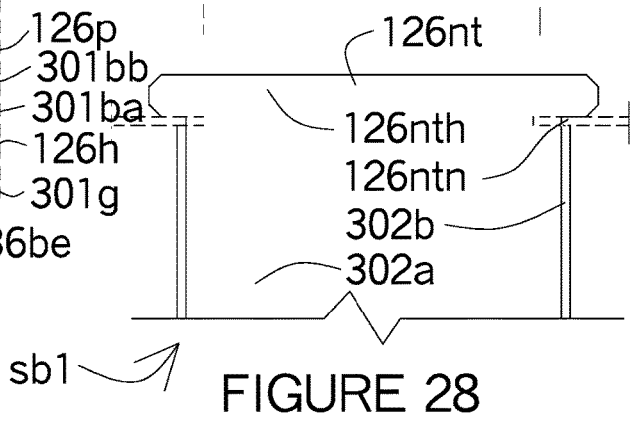

The web extension 301*e* with the receiver hole 129*h* at a spacer brace can be installed over the notched-tab 126*nt* shown at the hole bottom edge 36*be* as shown in FIG. 26 or at the end of a support member as shown in FIGS. 24 and 26. Two adjacent spacer braces having the receiver holes 129*h* can be installed over the same notched-tab 126*nt* within the hole 36 or stacked on the notched-tab 126*nt* at the end of a spacer brace. The stacking of receiver holes 129*h* will require a deeper notch 126*ntn* at the notched-tab 126*nt*.

Figure 12:
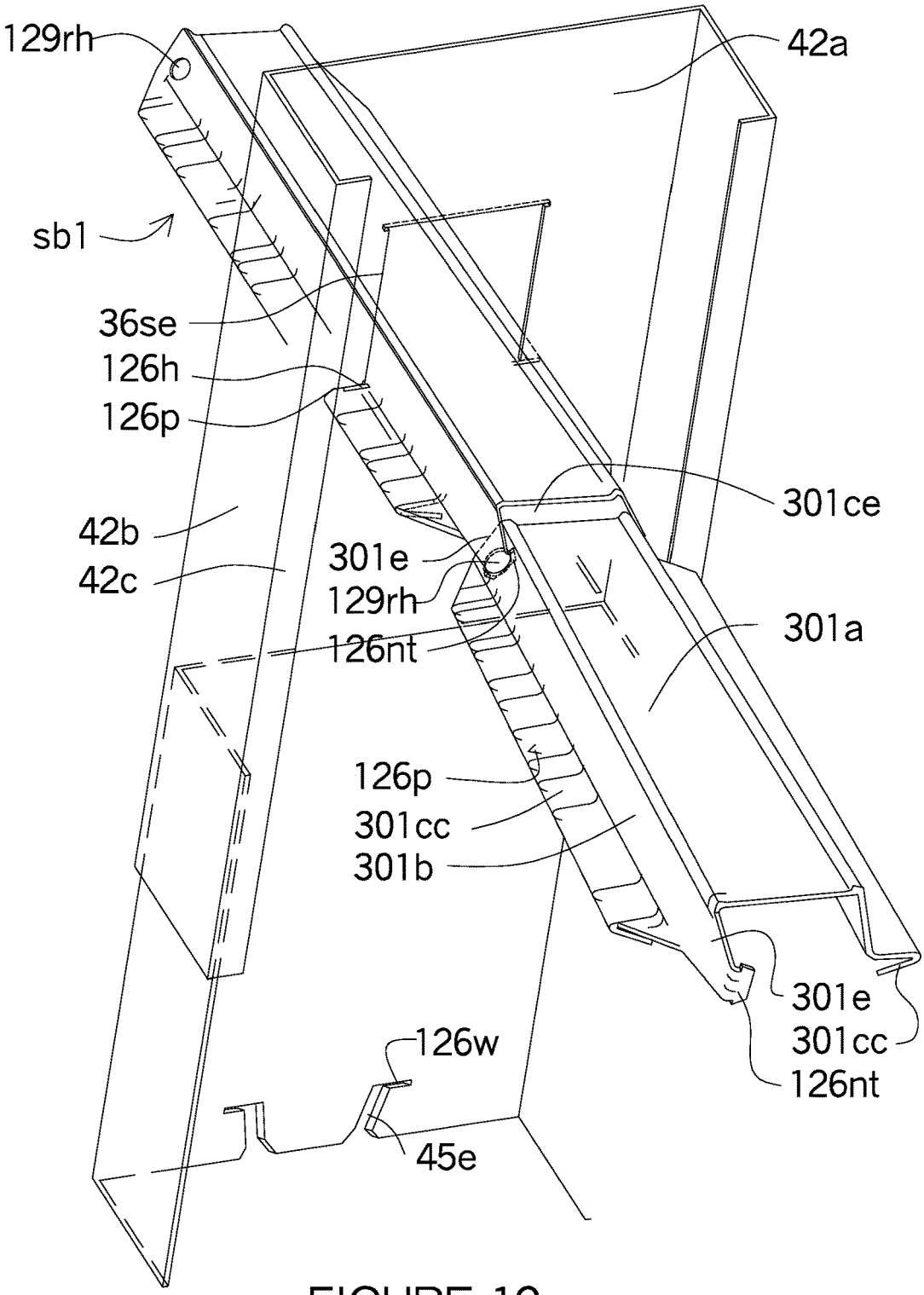
FIG. 12 shows the space brace with the lip notches at the free end of the lip connected to the hole notches in the hole side edge in the support member with a hook tongues extending from the flanges with notched-tabs at the longitudinal end being inserted into the hole round receivers at the pivot points for the adjacent spacer brace to be turned upward or downward.
Figure 13:
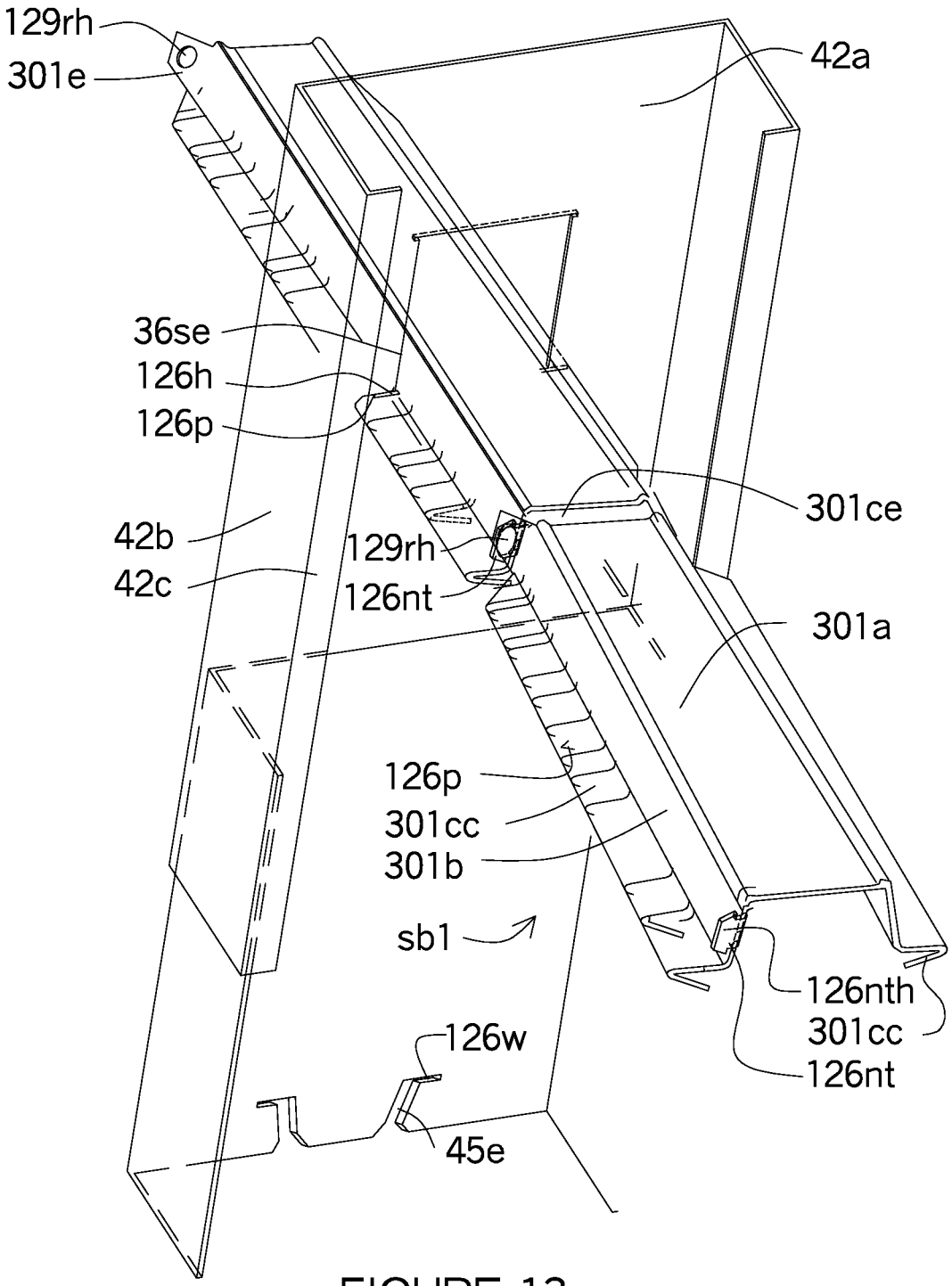
FIG. 13 is similar to FIG. 12 except the notched-tabs at the longitudinal ends extends outward and the receiver holes are located on the flange extensions.
Figure 15:
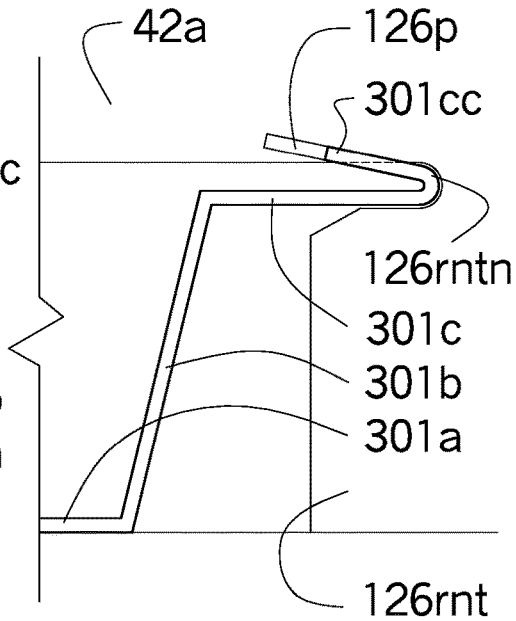

FIG. 11 is similar to FIGS. 12 & 13 as they are all longitudinal spacing-bracing members comprising a longitudinal web 301*a* with first and second opposing sides shown as flanges 301*b* extending the length of the longitudinal web 301*a* and being connected to the longitudinal lips 301*c* with lip notches 126*p* extending inward so the hole side edges 36*se* can extend into the lip notches 126*p*. FIGS. 12 & 13 show the flanges 301*b* at an angle and the hole 36 is slightly smaller so the hole side edges 36*se* extend into the flange notches 126*f* as well as the lip notches 126*p*. The lip notches 126*p* in FIG. 13 shows the lip notch 126*p* at the end of the double lip 301*cc* as shown in FIG. 15, but the longitudinal lip 301*c* extends downward. In FIG. 11 the notched-tabs 126*nt* extended from the web 301 at the extensions 301*e*, but in FIG. 12 the notched-tabs 126*nt* extend from the flanges 301*b* at the flange extensions 301*e*. The flange extensions 301*e* are sometimes referred to as hook tongues 128 and are bent inward at the nt-notch 126*ntn* then extends wider at the nt-heads 126*nth*. The opposing end of the reverse lip spacer brace 301 shows receiver hole 129*h* at the flanges 301*b* for the nt-head 126*nth* to fit into the receiver hole 129*h*. The receiver hole 129*h* has grooves 131 at the side edges of the receiver hole 129*h* for the notched-tab head to have additional means of friction to secure the notched-tab 126*nt* into the receiver hole 129*h*. The receiver holes 129*h* has a vertical orientation, so when the notched-tabs 126*nt* are inserted into the receiver holes 129*h*, the notched-tab 126*nt* are pivot points so the reverse lip spacer brace 301 can be oriented at an angle. The reverse lip spacer braces 301 can be connected individually to each support member or several reverse lip spacer braces can be connected to form a continuous row of reversed lip spacer braces 301 by using notched-tabs 126*nt* and receiver holes 129*h* as the connection means to form an arched wall. The extension 301*e* at the web 301*a* can be bent at the bent extension 301*be* to form an arched wall. FIG. 13 is similar to FIG. 12 except the notched-tab 126 has the hook tongue 128 at the edge of the flanges 301*b* and the notched-tab 126 extends outward. The receiver hole 129*h* at the opposing end is installed in the flange extension 301*e* so the notched-tab 126*nt* has room to pivot vertically upward or downward to the desired angle. The extension in the horizontal spacing-bracing member can be configured with the web 301*a* or the flange 301*b* can have a hook tongue 128 with its notched-tab head 126*nth* or the receiver end with its receiver slot hole 36*rs* in the extension. The extension can also be bent depending on the curvature of the wall shown in FIGS. 2 & 3.

Figure 14:
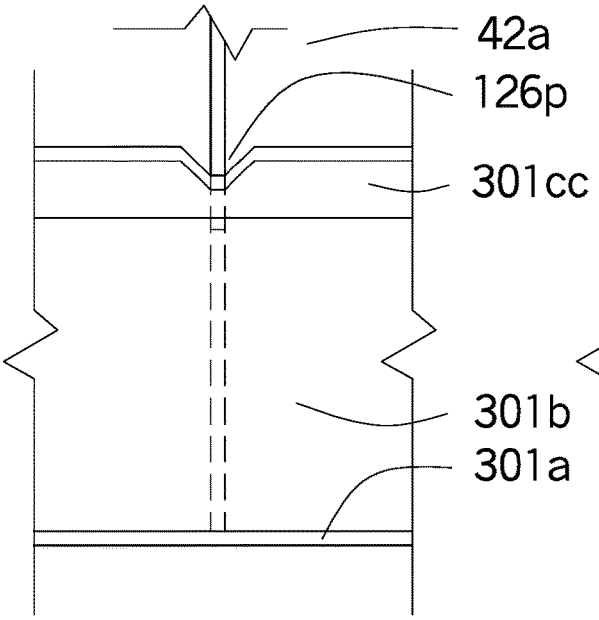
FIG. 14-15 show a longitudinal cross section of a spacer brace and FIG. 15 shows a cross section of the reverse lip spacer brace, except here the lip has a double lip where the double lip extends upward and the lip notches are at the side edges of the lip notches the engage the web of the support member above the hole notches.

FIG. 14 is a longitudinal cross section of a reverse lip spacer brace 301 and FIG. 15 is a cross section of the reverse lip spacer brace 301 at the intersection of web notch 126*w* at the floor or a hole side edge 36*se* having a hole notch 126*h* at the web 42*a* of the support member. FIG. 14 shows the lip 301*c* having a double lip 301*cc* where the double lip 301*cc* extends upward so the free edge has a lip notch 126*p* engage into the upper edge of the web opening for the double lip 301*cc* to fit into. The lip notch 126*p* secures the reverse lip spacer brace 301 from moving horizontally engaging the web 42*a* of the support member above the web notches 126*w* shown in the L-shaped gap 45*e* of the support member and the bend of the double lip 301*cc* engages the web notch 126*w* to reduce vertical movement. The flange 301*b* is shown angular, but is not limited to that angle.

Figure 16:
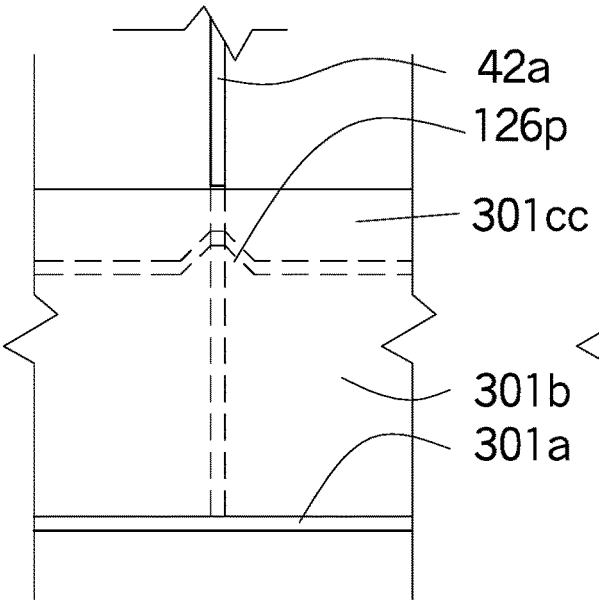
FIG. 16-17 is similar to FIGS. 14 & 15 except
Figure 17:
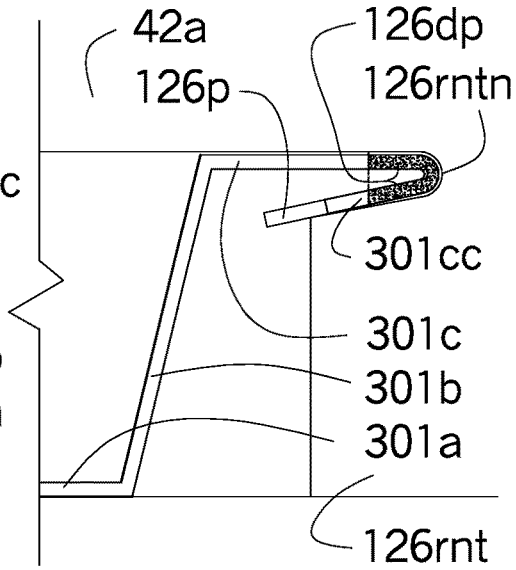

FIG. 16 and FIG. 17 are similar to FIGS. 14 & 15 except the double lip 301*cc* is facing downward toward the dorsal side and the lip notches 126*pp* is double thick as both the upper and lower portion of the double lips 301*cc* have the lip notch 126*p* forming an extra strength lip notch 126*p*. The web notch 126*w* is larger since the double lip notch 126*pp* has each side of the double lip notch 126*pp* engage the side planes of the web 42*a* of the support member.

FIG. 18 shows the same L-shaped gap 45*e* profile as shown in FIG. 13 at the bottom end of the support member of a U shaped channel 41. The dorsal side fitting into the ventral side of the C channel 42 also a support member where the top end also has an L-shaped gap 45*e* for a reverse lip spacer brace 301 to fit into. The L-shaped gap 45 profile is labeled slightly different to help understand the configuration. The web notch 126*w* reflects the profile of the reverse lip spacer brace 301 as the lip notch 126*p* is inserted into the reverse lip notched-tab notch 126*rntn* and tab shown between the L-shaped gaps 45*e* is shown as a reverse lip notched-tab 126*rnt* with the head shown as a reverse lip notched-tab head 126*rnth*. The profile of the notched-tab indentation 126*nti* as shown in FIG. 26 can be installed at the end of the reverse lip notched-tab head 126*rnth* so the web 301*a* of the reverse lip spacer brace 301 can be inserted into the head opening. The reverse lip spacer brace at the top shows a cut edge 301*ce* at the web 301*a* and flanges 301*b* so the flexible lip 301*fp* and bend in a ventral direction to form a curving profile. FIG. 18 shows the lip notch 126*p* in the middle between short segments of the reverse lip spacer brace 301 for strength at the joint connection of the L-shaped gap 45*e*. On the other hand, should the support member be aligned at the flexible lip 301*fp* the lip might not require a lip notch 126*p* if the bend is at an acute angle that the support member would not move longitudinally along the direction of the reverse lip spacer brace 301.

Figure 19:
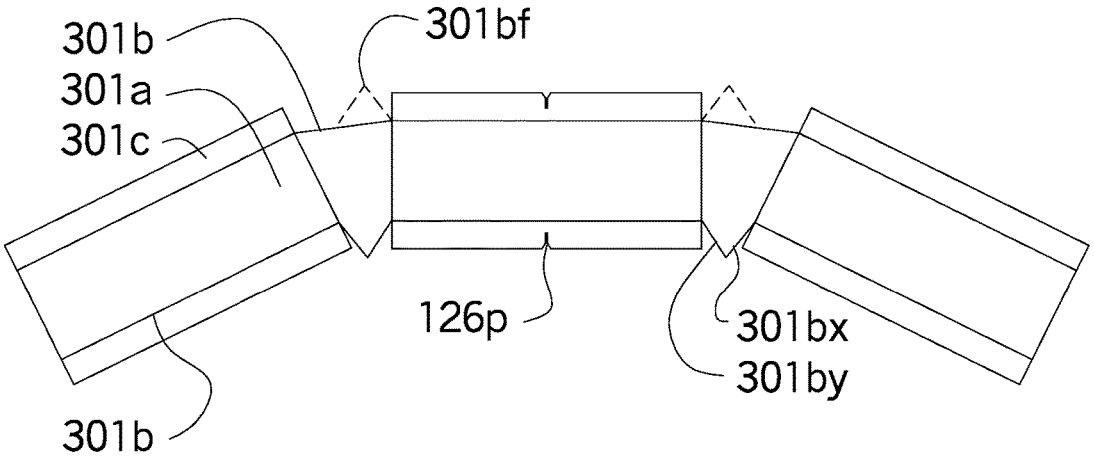
FIG. 19 shows a similar profile as FIG. 17 except here the web and lips have been removed and the flanges are allowed to bend so the spacer brace can be curved but in a horizontal orientation.

FIG. 19 shows a reverse lip spacer brace 301 where a horizontal movement can occur between segments of the reverse lip spacer brace 301. In FIG. 329 the cut edge 301*ce* occurs at the web 301*a* and the lip 301*c* allowing the flange to bend at the midpoint by installing a crease or notch (not shown) to allow the flange 301*b* to bend at a predetermined point. FIG. 19 shows a horizontal radial arch where the inside diameter is shown a bend at the flange x-plane 301*bx* and the flange y-plane 301*by* become at acute angles to the plane of the continuous segmented sections of the reverse lip spacer brace 301 while the opposing side flange 301*b* are shown in a straight line. The lip notches 126*p* are shown at the longitudinal exterior side edge of the lip 301*c*.

Figure 20:
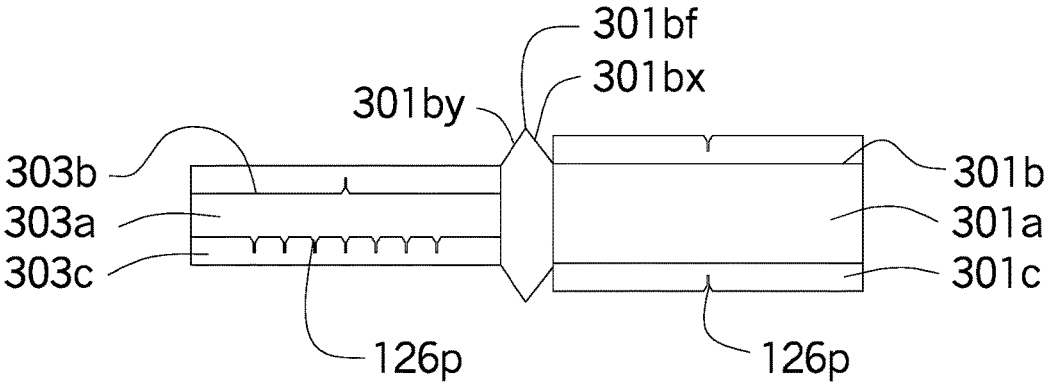
FIG. 20 is similar to FIG. 19 except here the spacer brace has a C shaped profile and the lip notches are oriented inward toward between the opposite side lips.

FIG. 20 shows a similar profile as FIG. 19 however one space brace is shown as a C shaped spacer brace 303 where again the flanges 303*b* bend and the web 303*a* and lip 303*c* have the cut to allow for the bending. In this case a notched-tab from the end of a support member would be inserted between the lips and inserted into the lip notches 126*p* at the longitudinal side edge of the lip 303*c*.

Figure 22:
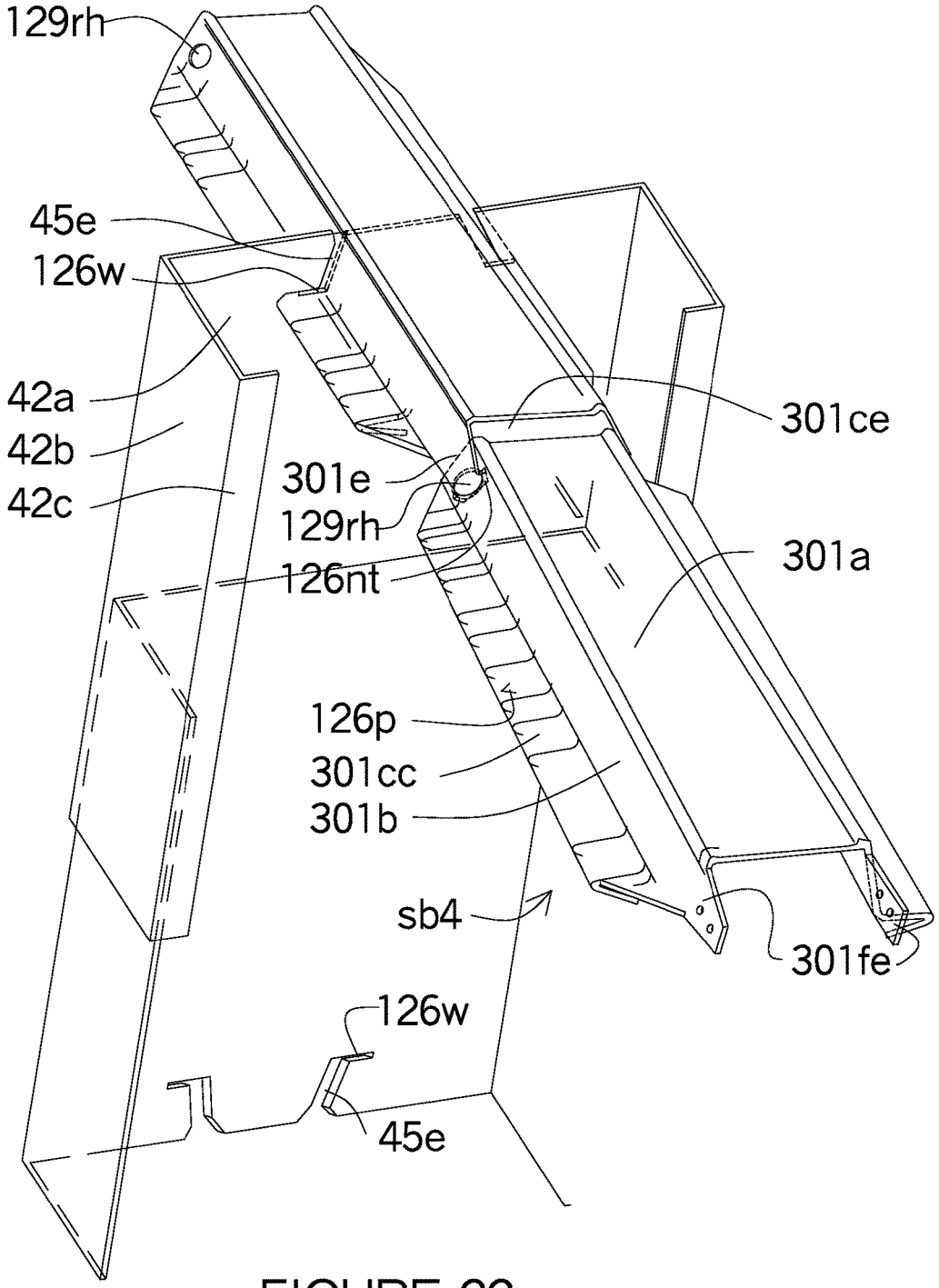
FIG. 22 shows two different longitudinal connections, one with the flange extensions overlap the flanges and another where the hook tongue has a notched-tab at the end to be inserted into the receiver hole at the opposing end of an adjacent spacer brace.

FIGS. 21 & 22 both show the reverse lip spacer brace 301 installed at the top end of the web 42*a* of the support member with the top plane of the reverse lip spacer brace 301 similar to the FIGS. 12 & 13 where the reverse lip spacer brace 301 were installed in the hole 36 in the web 42*a*. The bottom edge of the web 42*a* shows the L-shape gap 45*e* along with the web notch 126*w* where the lip notch 126*p* fit into. Both FIG's show the double lip 301*cc* for extra strength. The notched-tab 126*nt* and the receiver holes 129*h* as shown in FIGS. 12 & 13 are shown at the top of the web 42*a* so the adjacent reverse lip spacer braces 301 can pivot at the notched-tabs 126*nt*. A smaller U channel is shown installed between the web 42*a* so the C channel 42 can more easily be installed in place. FIG. 22 shows one end having extensions 301*e* with holes so fasteners (not shown) can be installed through the flanges 301*b* of an adjacent spacer brace 301.

Figure 23:
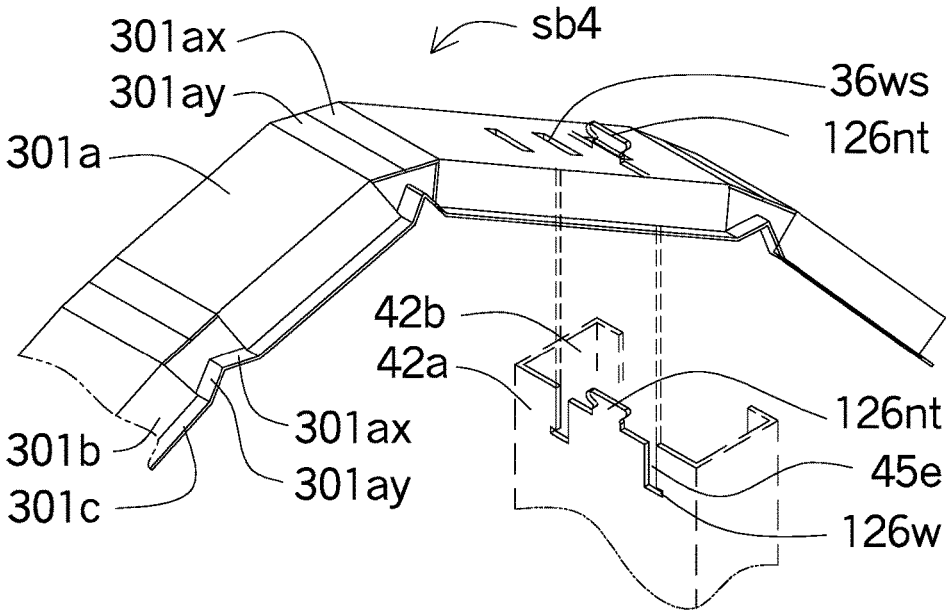
FIG. 23 shows the web having a notched-tab at the end of the web of the support member and another aspect of the invention shows the web and lips of the crossing spacer brace having bent webs and lips so the spacer brace can be angled or bent between the support members forming a curved concave profile at the top of the metal support channel.

FIGS. 23 and 24 also show the reverse lip spacer brace 301 being connected to the end of the C channel 42. FIG. 22 shows the L-shaped gap 45*e* at the bottom edge of the web 42 along with the web notch 126*w* where the lip notch 126*p* is installed. In FIG. 24 the L-shaped gaps 45*e* have a web section between the two L-shaped gaps 45. The web section has the same profile shape as a notched-tab 126*nt* where another web notch 126*w* is shown at the bottom edge of the L-shaped gaps 45*e*. These sides of the L-shaped gap 45*e* has web tabs 42*at* that extend over web notches 126*w* forming a notched-tab 126*nt* at the web section between the two L-shaped gaps 45. These web-tabs 42*at* are part of the notched-tab 126*nt*. The reverse lip spacer brace 301 has the angled flanges 301*b* with flange slot holes 36*fs*. The web tabs 42*at* extend through the flange slot holes 36*fs* and if the web tabs 42*at* are long enough they could be bent across the flange slot holes 36*fs* making a tighter fit. FIG. 23 is similar to FIG. 24 except the web 301*a* of the reverse lip spacer brace 301 has web slot holes 36*ws* and the top edge of the web 42*a* of the support member has a notched-tab 126*nt* at the end that can extend through the web slot holes 36*ws*. In FIG. 23 the slot holes in the web are referred to as web slot holes 36*sh*, while in FIG. 4 the holes in the web are shown as receiver slot holes 129*sh*. By installing a round or oval shaped as the receiver slot holes 129*sh*, additional receiver slot holes will be added to the web 301*a* or 302*a* allowing the web extensions 301*e* or 302*e* having a hook tongue 128 with a notched-tab 126*nt* to extend into the receiver slot holes 129*sh*, therefore allowing a notched-tab 126*nt* be engage an additional receiver slot hole 129*sh* from an another adjoining spacer brace. The profile that will be discussed in FIG. 26 showing a notched-tab 126*nt* at the web 42*a* of the support member along with the notched-tab shadow profile at the notch-tab indentation 126*nti* can be used interchangeably with the configurations used FIGS. 23 & 24. The profile of the reverse lip spacer braces 301 are also similar to FIGS. 19 & 20.

Figure 53:
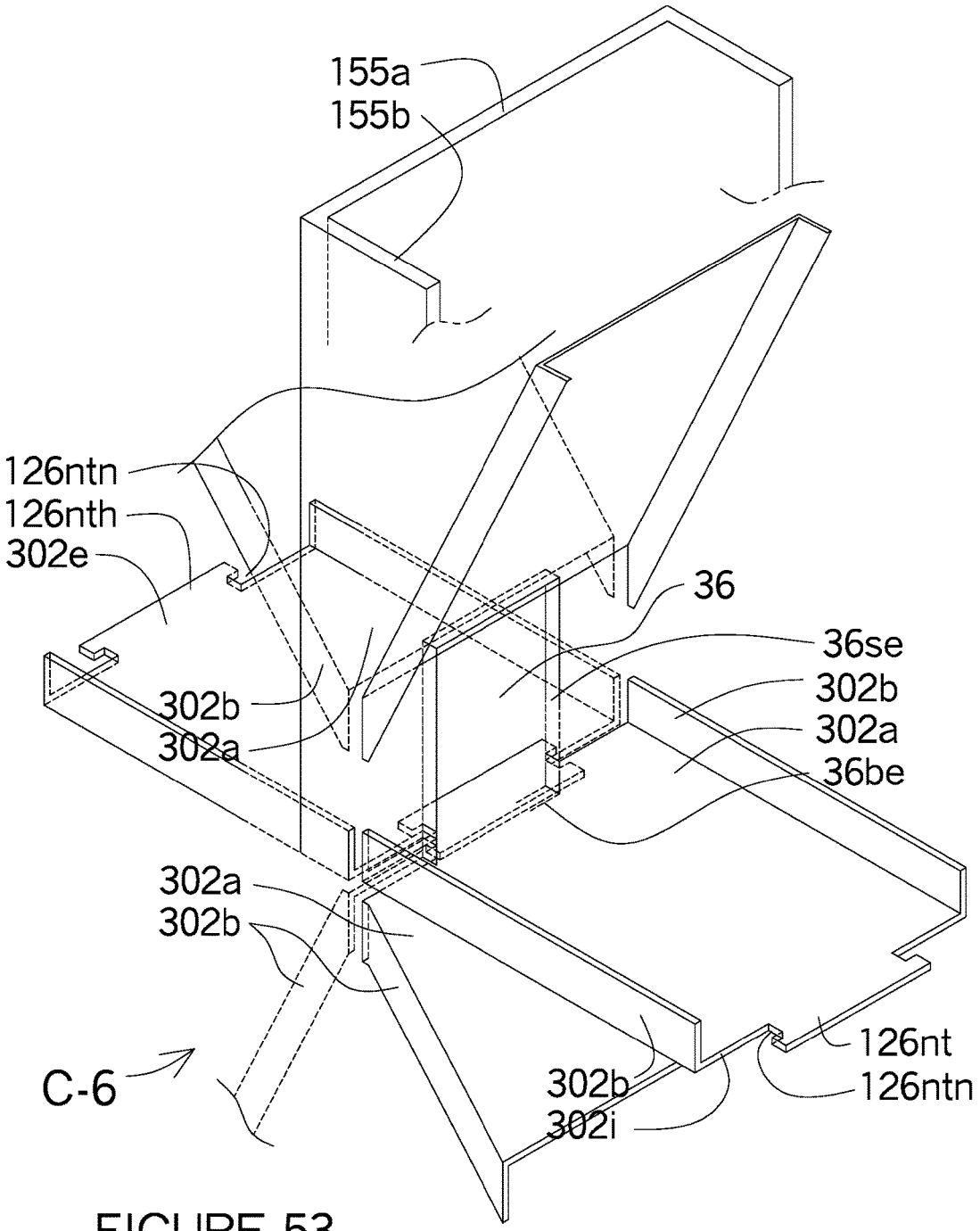
FIG. 53 shows the notch tab at both ends with the tabs extending over the opposing side of the U shaped spacer brace with the notch extends through the aperture of the framing member and the web and flange of the U shaped spacer brace braces the opposing side of the notch.
Figure 54:
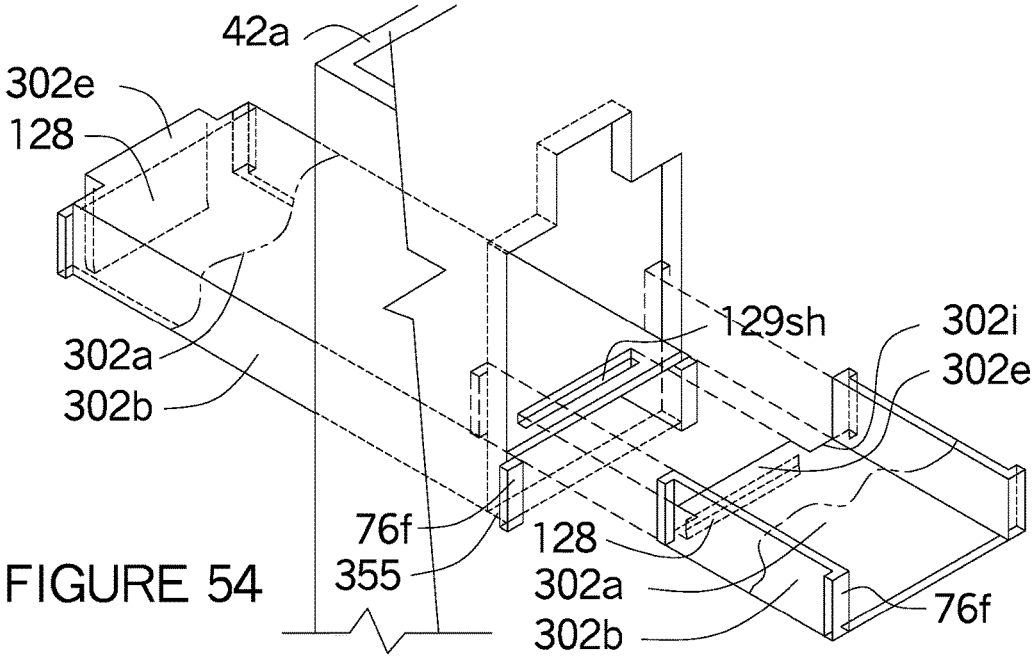
FIG. 54 is similar to earlier spacer braces where the web of the U shaped spacer brace has an extension that extends through the aperture of the framing member with a hook tongue extending into the receiver hole in the web of an adjoining spacer brace, however here one U shaped spacer brace has upward oriented flanges and the adjacent U spaced spacer brace has downward oriented flanges and where the ends of the flanges has flaps that extend through the aperture and brace the framing member on the interior edge of the flap at the aperture.
Figure 55:
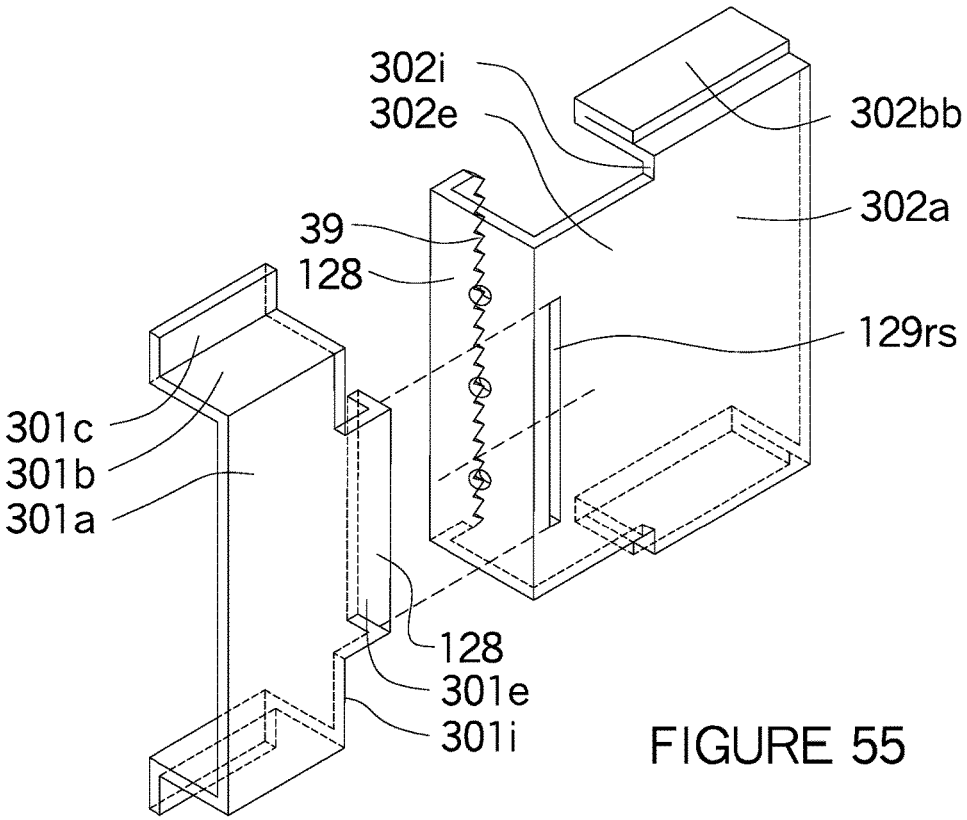
FIG. 55 also shows and enlargement of the hook tongue being inserted into the receiver slot hole.
Figure 56:
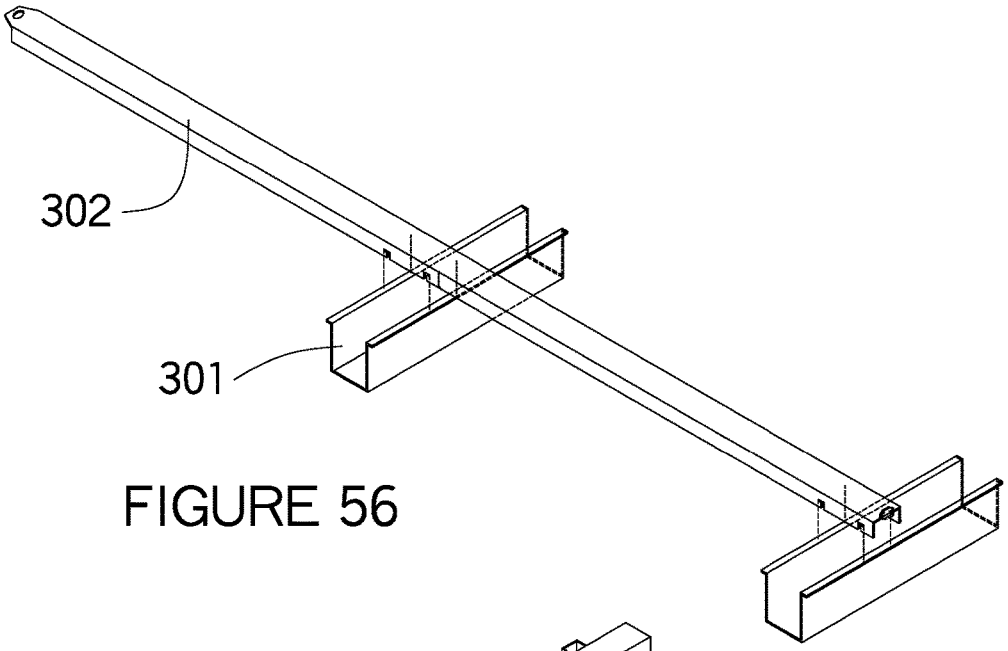
Figure 57:
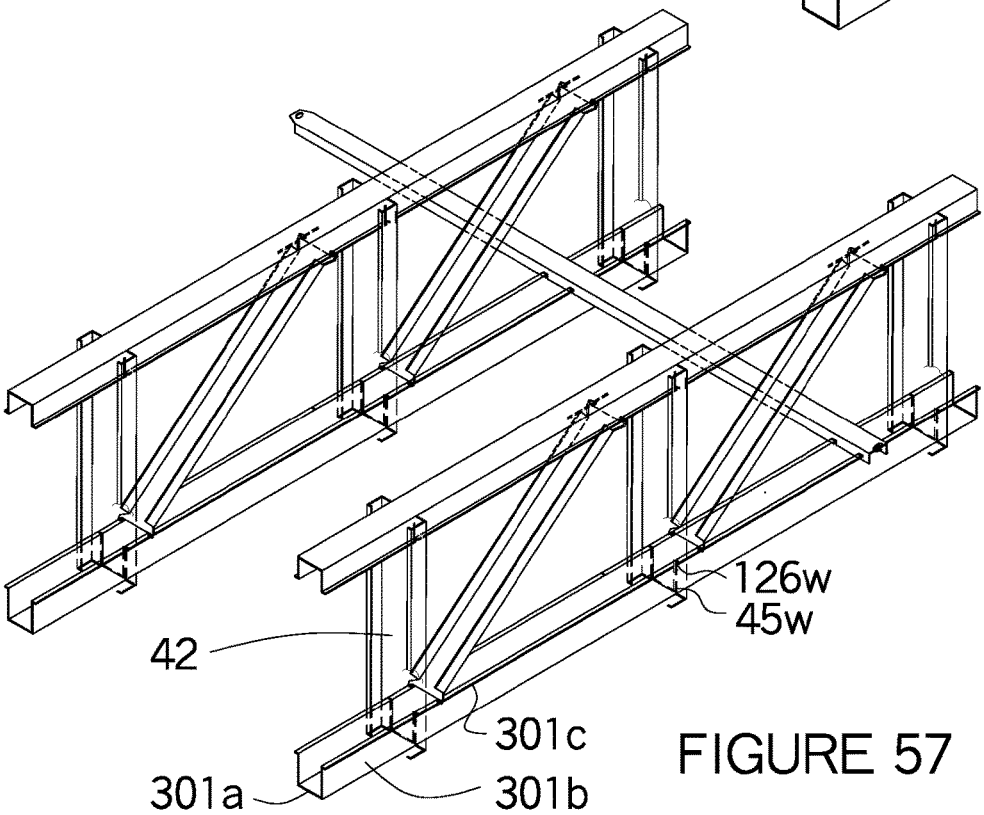
FIG. 57 shows a metal truss having horizontal reverse lip spacer braces at the top and bottom chord with the flanges connecting to the lips of the bottom chord of the metal truss which is shown as an enlargement in FIG. 56.
Figure 58:
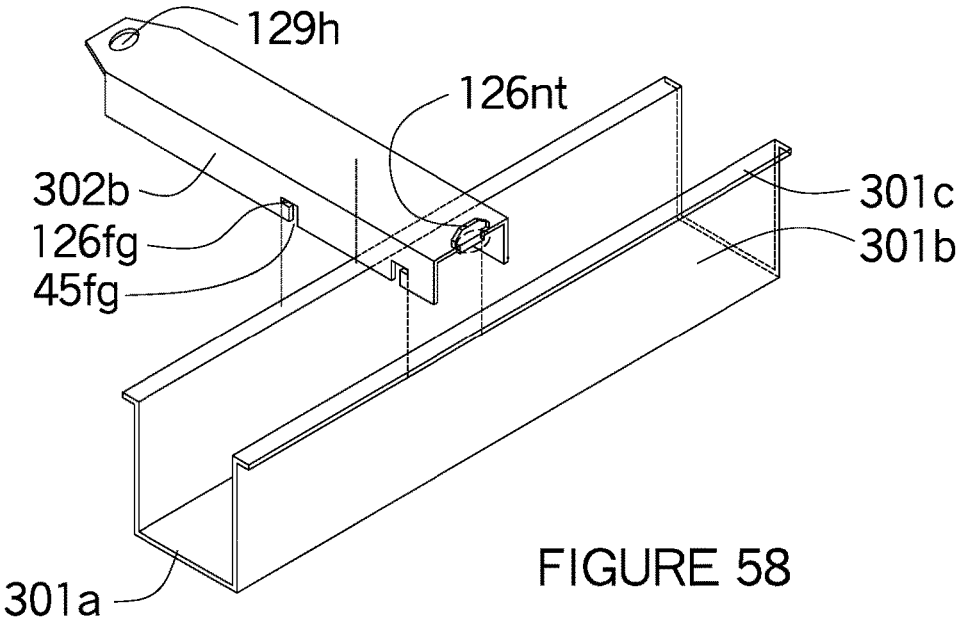
FIGS. 58 & 59 both show the U shaped spacer brace with the flange gap connected to the flange-gap notch that secures the lip notch together.
Figure 59:
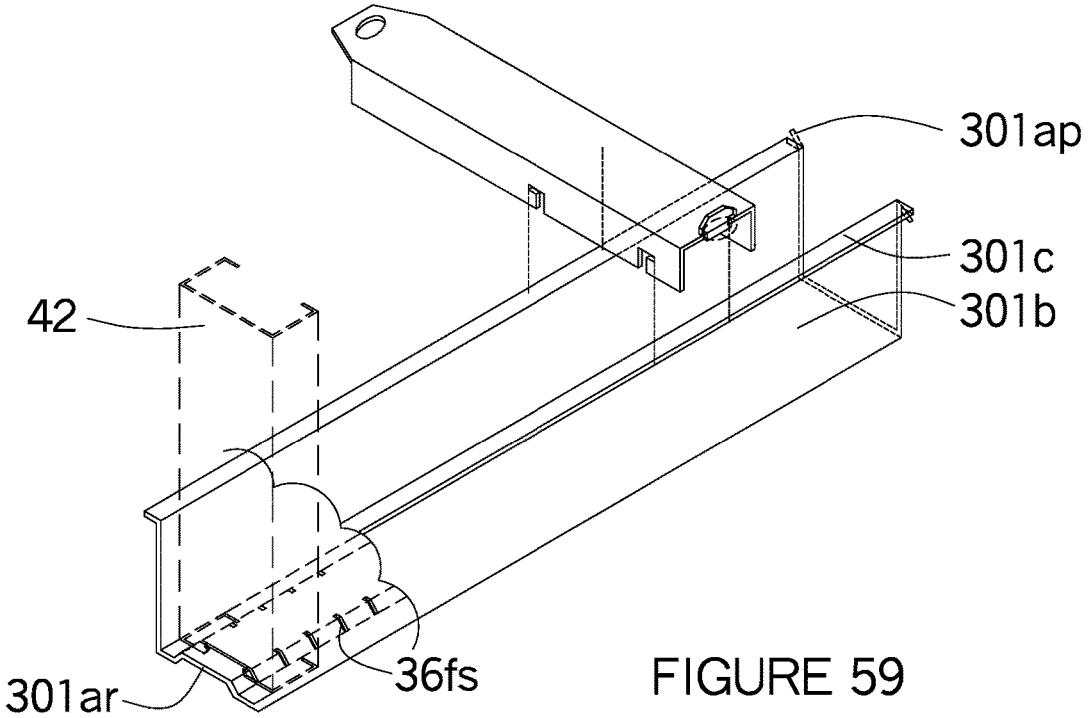
Figure 60:
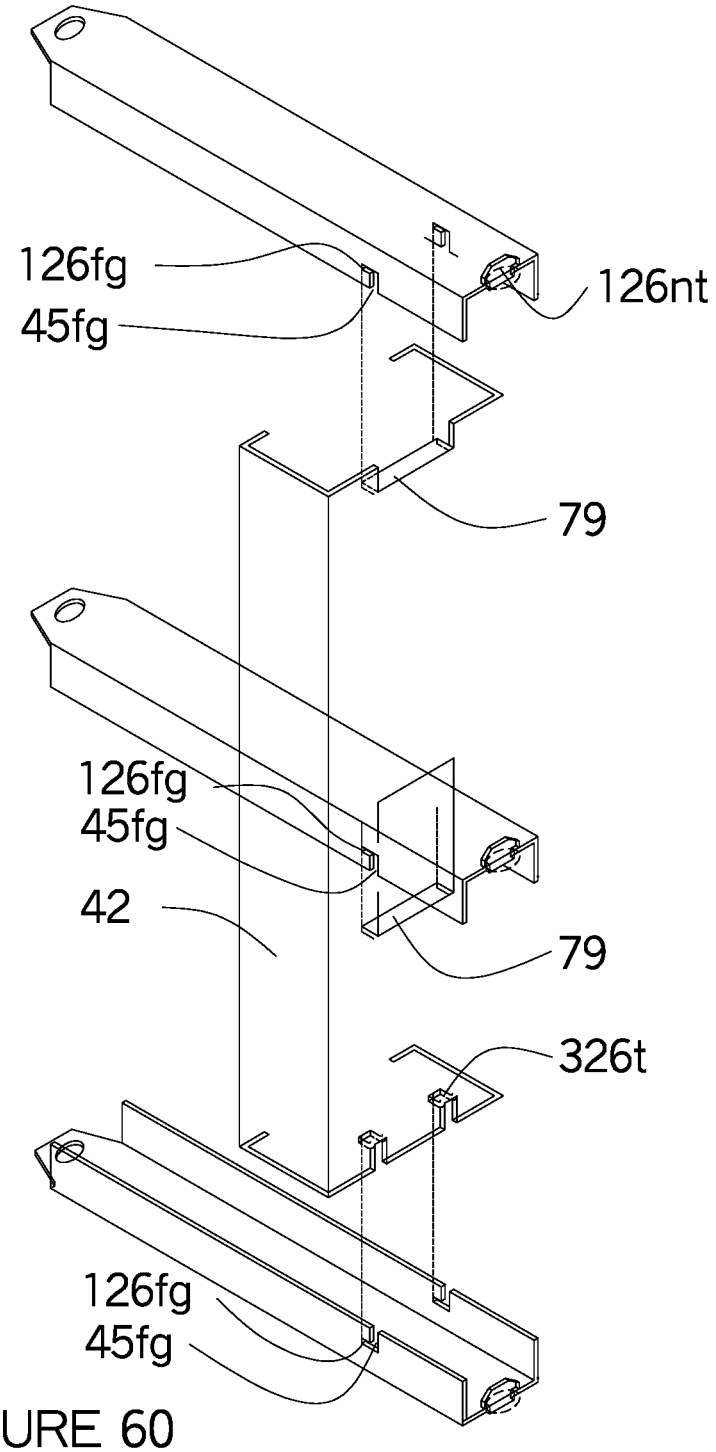
FIG. 60 shows the U shaped spacer brace with the flanges having a flange gap with a flange notch that intersects the ledge at the top of the framing member or the punch-out tab at the bottom of the framing member.
Figure 61:
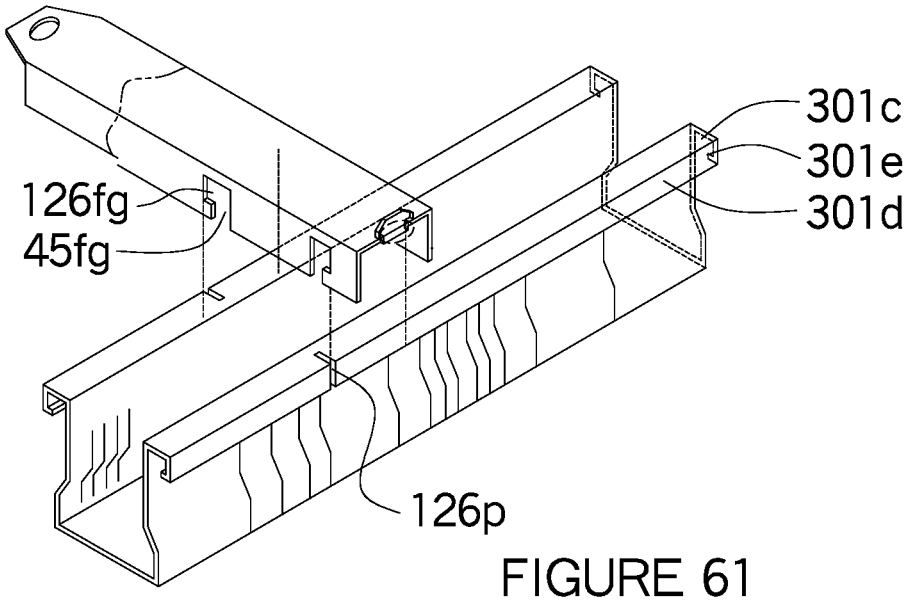
FIG. 61 is similar to FIG. 58 the reverse lip spacer brace has lips with three planes where the flange gap with the flange notch have to fit over the lips having three planes.
Figure 62:
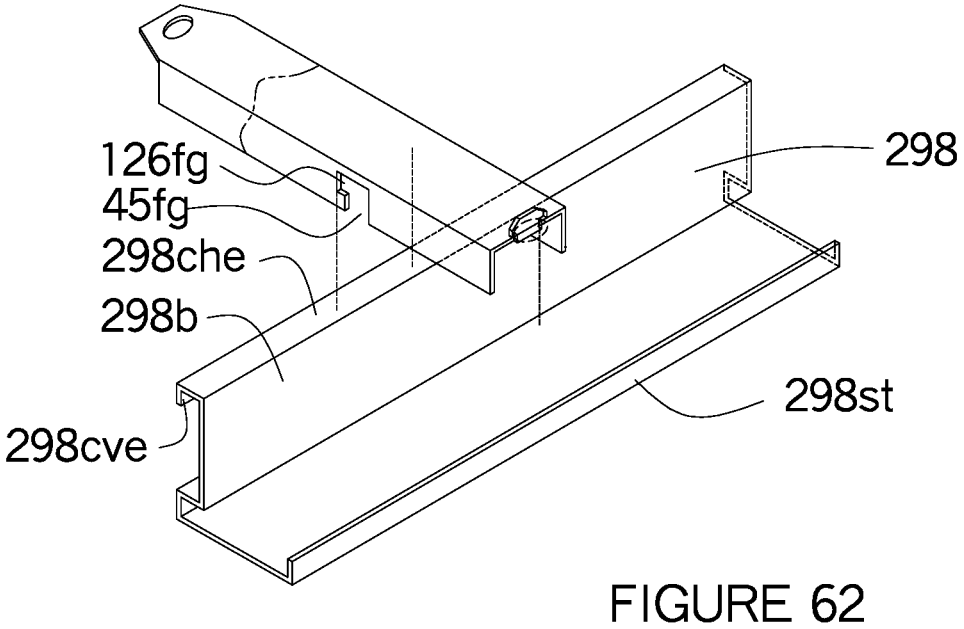
FIG. 62 is similar to FIG. 61 except the crossing spacer brace only has one flange where the lip has 3 planes as described in FIG. 61.

FIGS. 25-28 show two longitudinal U-shaped spacer braces 302 having a longitudinal web 302*a* with two side walls or flanges 302*b* extending from the longitudinal free edges the length of the web 302*a* with notched-tabs 126*nt* extending from the longitudinal ends. The notched-tabs 126*nt* can have extension 301*ae* or 302*ae* that can be bent as shown in FIG. 1. The notched-tab 126*nt* has previously been shown to extend from the web 301*a* or the flanges 301*b* extending directly from the web or flanges or from hook tongues 128 that extend into receiver holes 129*rh*. In FIG. 1 the web 42*a* in the support member shows notched-tabs 126*nt* extending through web slot holes 36*ws* in the web 301*a* or angled flanges 301*ba* having flange slot holes 36*fs* of the reverse lip spacer brace 301. FIG. 1 also shows the notched-tabs 126*nt* shown at the hole bottom edge 36*be* extending into web slot holes 36*ws* or lip notches 126*p* of longitudinal spacing bracing members. In FIGS. 25-28 and in the isometric drawing in FIG. 53 the notched-tabs 126*nt* are shown overlapping at a hole 36 noted as shape Ha on the elevations in FIGS. 2 & 3. The notched-tabs 126*nt* are used to reduce vertical bending of the support members as well as lateral movement horizontally or diagonally within the wall framing. The nt-notches 126*ntn* within the notched-tab 126*nt* have the nt-notches 126*nt* parallel to both side edges of the plane of attachment. The nt-notches 126*ntn* can be formed by using the longitudinal edge of the flange 301*b* with the web 301*a* being the rear back edge of the nt-notch 126*ntn* and the opposing side of the flange 301*b* side edge, the nt-side head 126*ntsh* extends beyond the hole side edges 36*se* and around the side of the opposing side plane of the web 42*a*. The nt-side heads 126*ntsh* are the side edges of the notched-tab head 126*nth* that extend longer than the width of the opening or hole 36 and similar to the web tabs 42*at* as shown in FIG. 24. The nt-side heads 126*ntsh* can have rounded side edges or can have flare edges 126*fe* at the notched flange notch 126*ntn* and another flare edge 126*fe* at the longitudinal end of the notched-tab head 126*nth*. The nt-notches can also just have a deeper depth notch to form a stronger nt-notch 126*ntn*. The nt-notches 126*ntn* can have a greater depth, so that hole notches 126*h* can be installed into the hole side edges 36*se* to eliminate any vertical movement within the hole 36. The nt-notches 126*ntn* of the notched-tab 126*nt* fit into the back vertical side of hole notch 126*h* with the sides of the head 126*nth* extend wider than the depth of the hole notch 126*h* as shown in the plan view in FIG. 28 and the cross section view of the U shaped spacer brace 302 along with the plan view FIG. 25.

Figure 40:
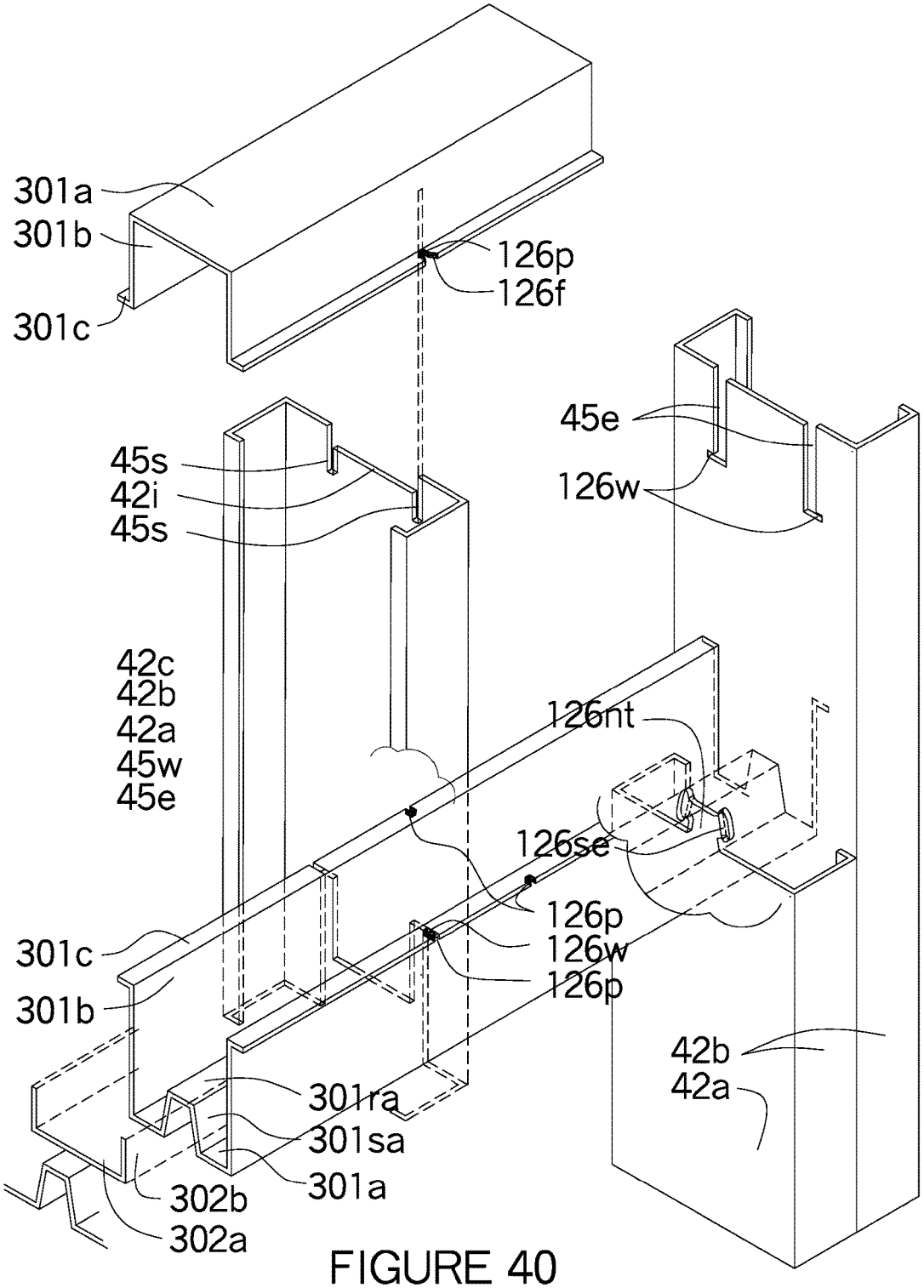
FIG. 40 shows the reverse lip spacer brace being installed into the support member where the reverse lip spacer brace is used as a header above a door or window and the flange is shown deeper. The web of the reverse lip spacer brace is shown having a raised web with slot holes for a cripple and a support member are joined both being C channels, but where the web of the cripple is shown having a notched-tab that extends into the slot holes of the header.
Figure 41:
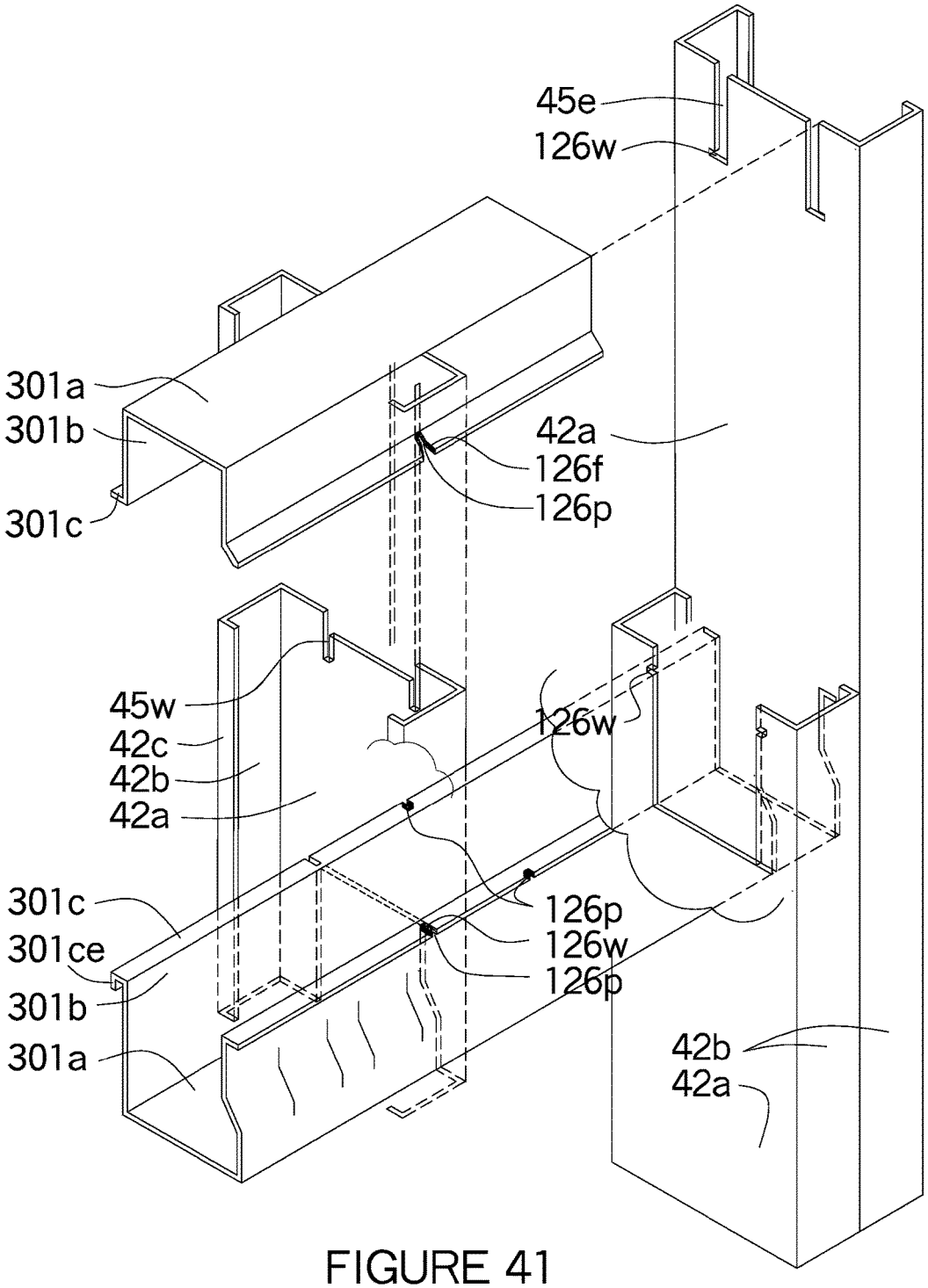
FIG. 41 is similar to FIG. 43, however the reverse lip spacer brace as the header does not have a raised web and the cripple is shown having a cut-out with web notches at the sides for the web and flanges can fit into the cut-out and the lip and lip notches can fit into the web notches of the cripple.
Figure 42:
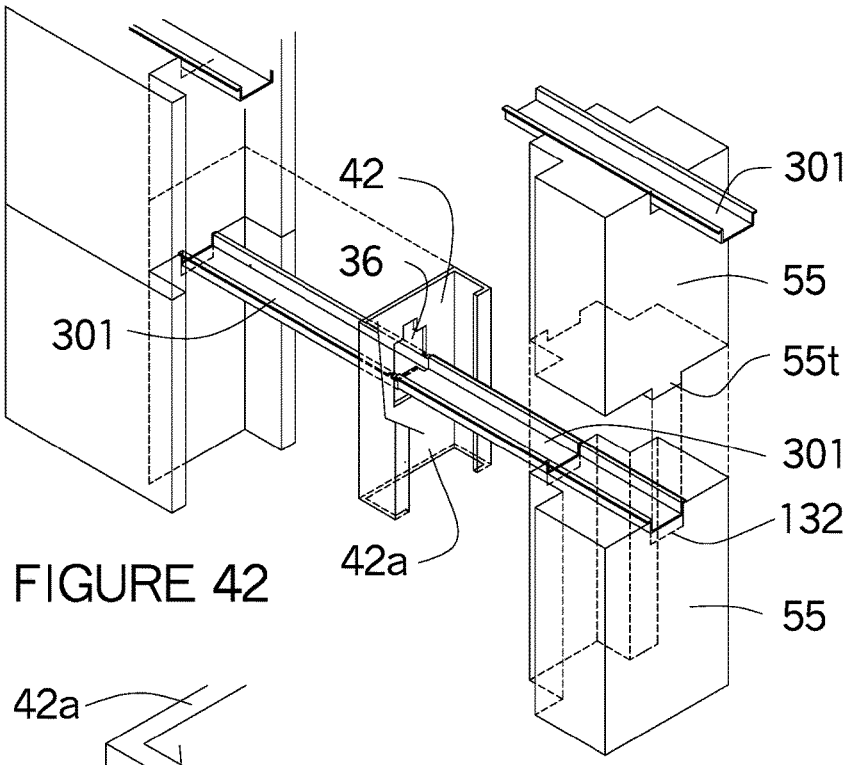
FIG. 42 shows spacer blocks being connected by a hook tongue of one spacer brace being connected into the receiver slot hole of an adjacent spacer brace with upward oriented flanges and extending lips.
Figure 43:
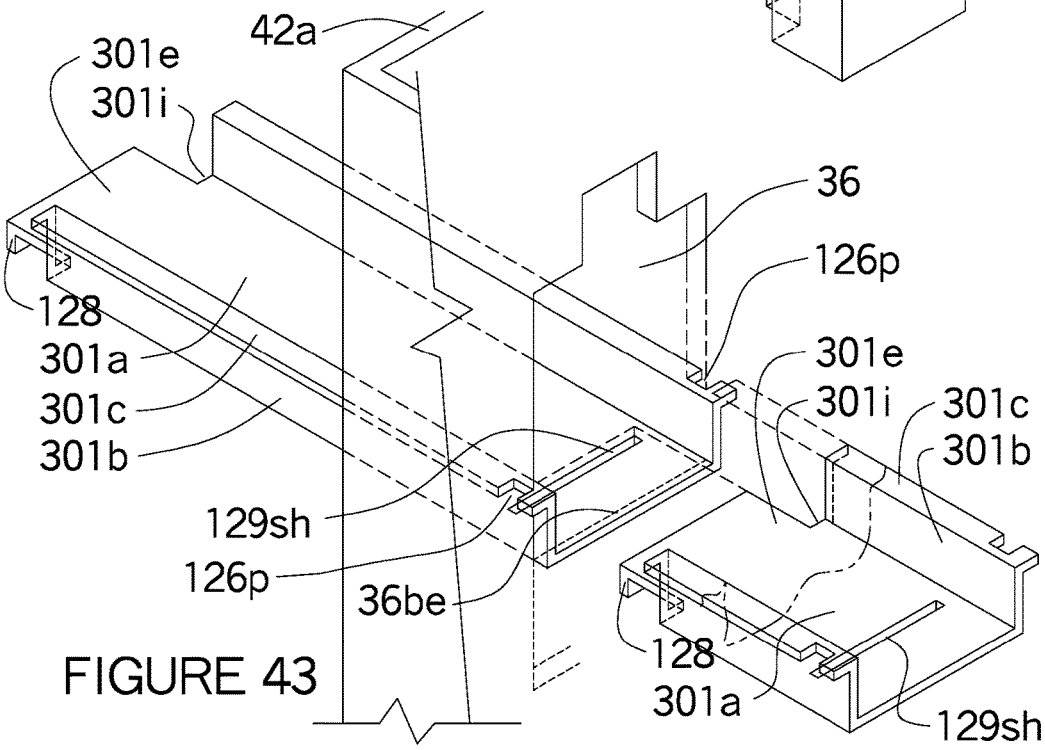
FIG. 43 shows an enlargement of FIG. 42 also showing the lip notches engaging the hole side edges.
Figure 44:
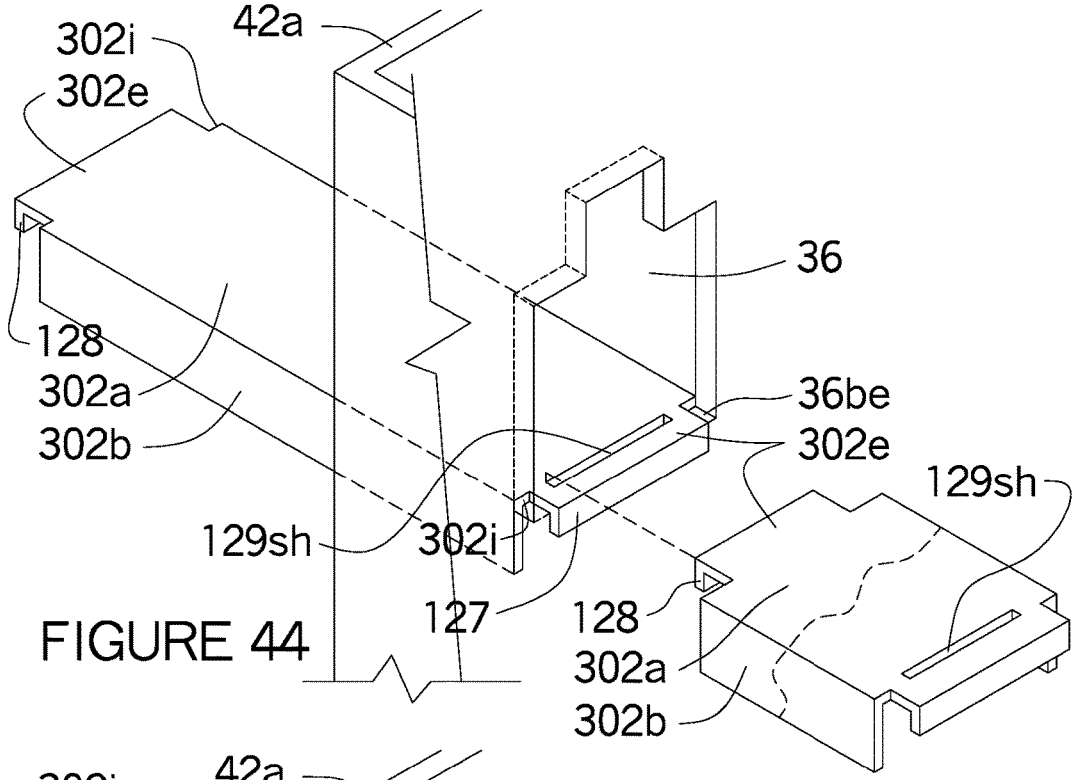
FIG. 44 shows downward oriented flanges with the flanges and web indented so the extension of the web crosses the hole with the finger extending downward over the hole and the hook tongue from an adjacent spacer brace extending into the slot hole in the web of the first spacer brace.
Figure 45:
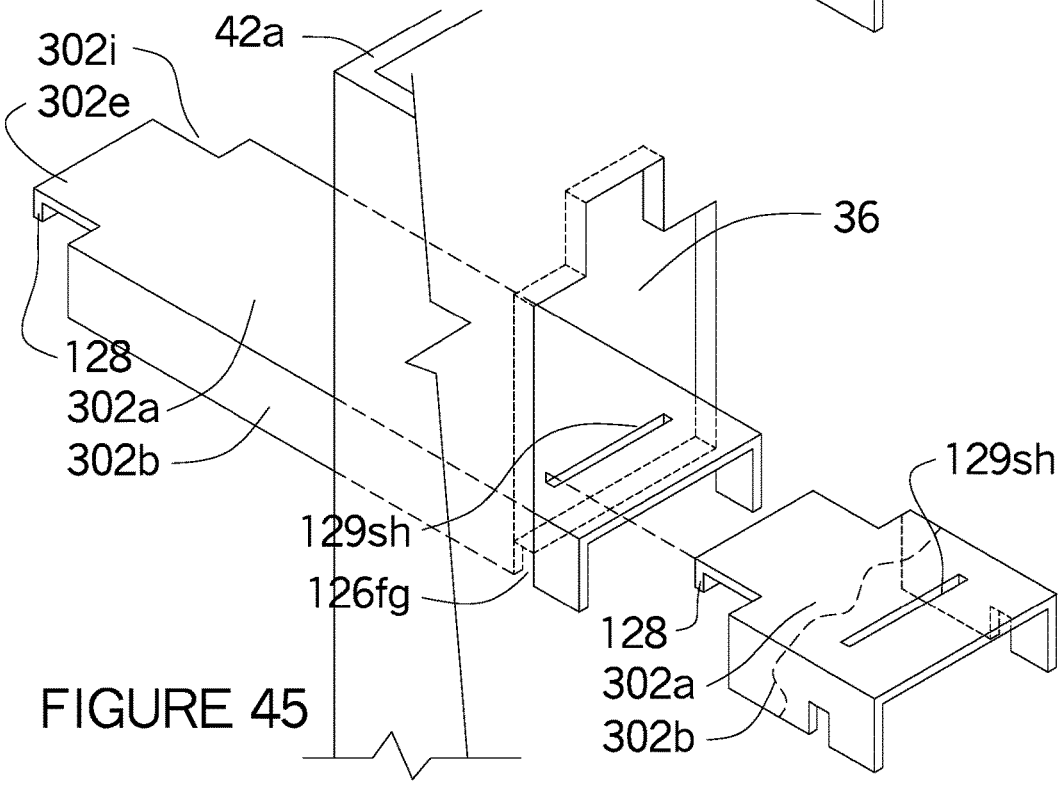
FIG. 45 also shows a downward oriented flanges with the web having a receiver slot hole for the hook tongue of an adjacent spacer brace to fit into and the first spacer brace having flange notches to engage the hole bottom edge.
Figure 46:
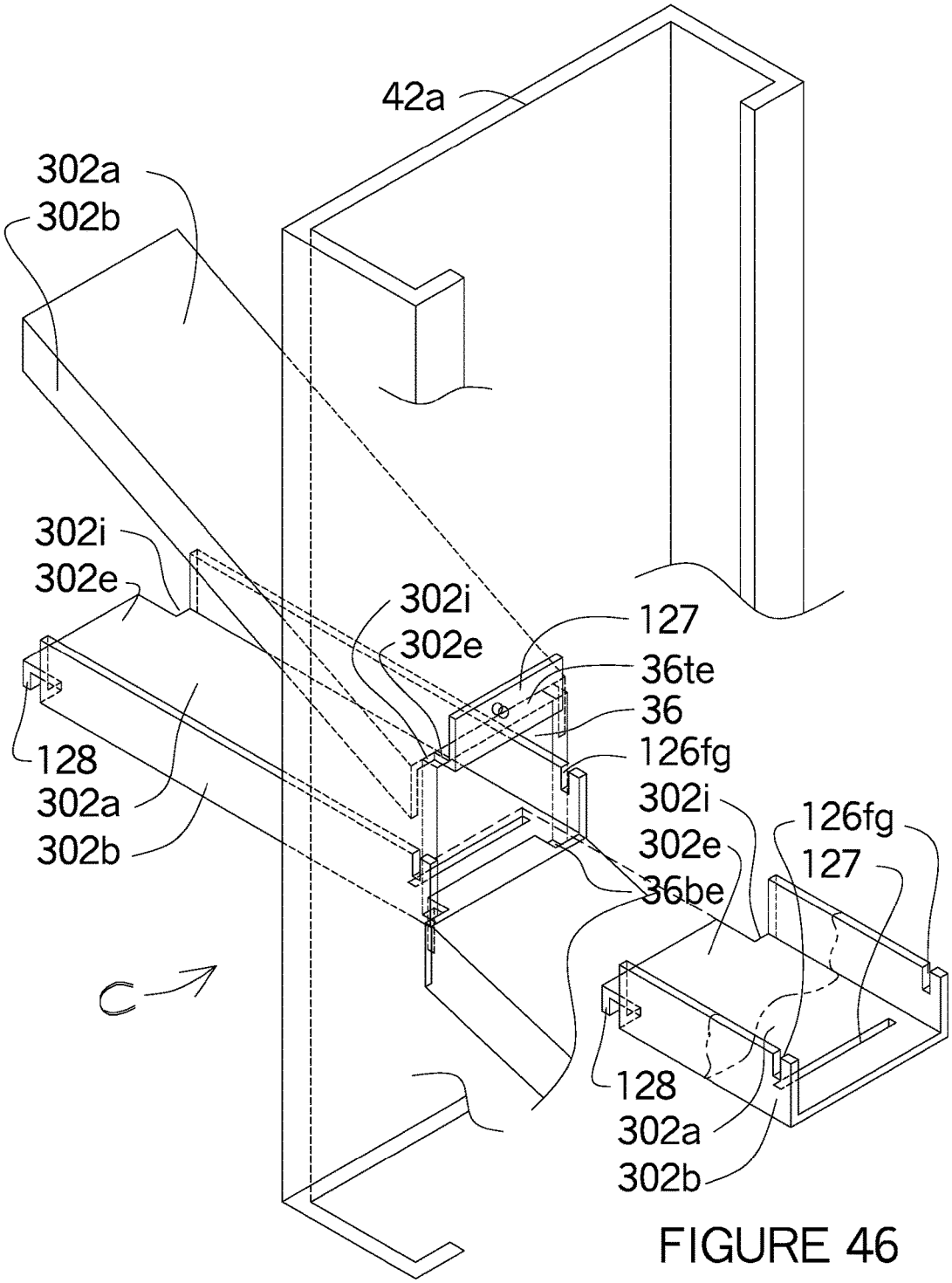
FIG. 46 shows an upward oriented flanges fitting between the side edges of the hole in the framing member with a slot hole in the web and an adjacent upward oriented flanges in a U shaped spacer brace having an indentation in the flanges and web where the web with a hook tongue extends over the first spacer brace and into the receiver slot hole.
Figure 47:
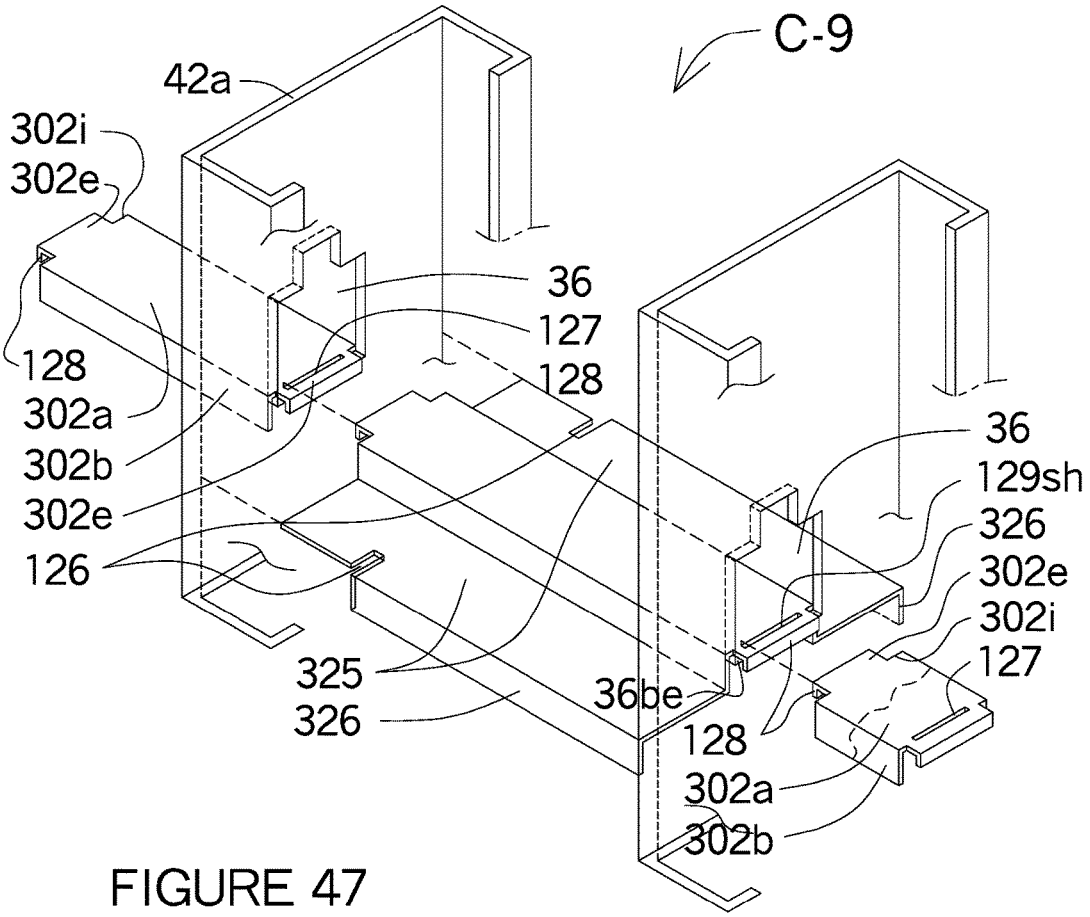
FIG. 47 is similar to FIG. 44 except the downward oriented flanges has another flange extending outward parallel with the plane of the web and a lip extending downward being flush with the flanges of the framing member and again being interlocked with the hook tongue and receiver slot hole.
Figure 48:
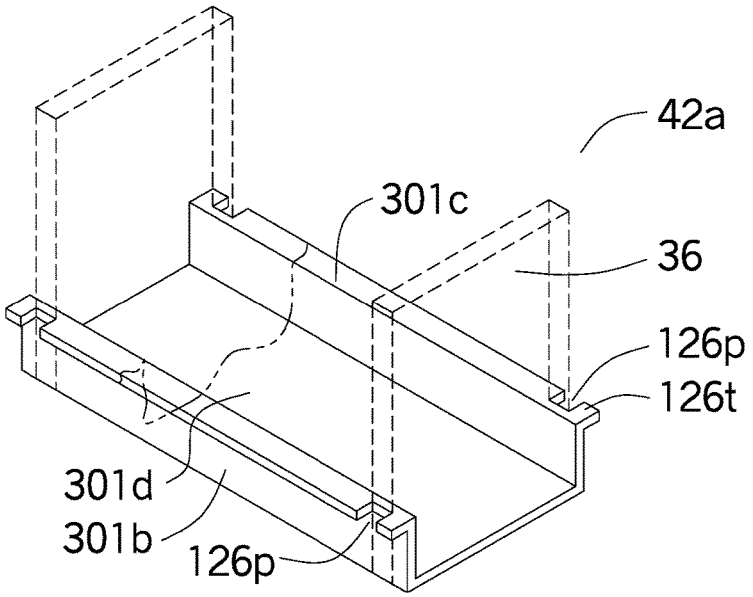
FIG. 48 shows the lip notches extending into the hole side edges.
Figure 49:
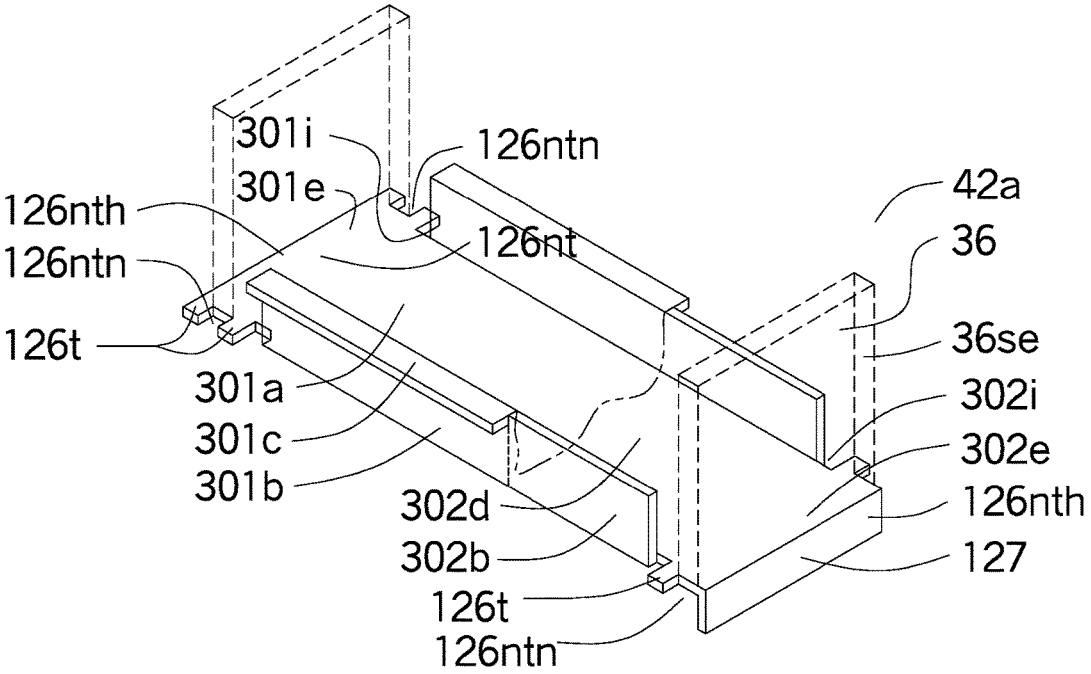
FIG. 49 shows the U shaped spacer brace facing upward and another reverse lip spacer brace the left end shows a notched tabs connection with the tabs on both sides of the aperture in the framing member the right side also having a notch tab where the spacer brace side has a tab with an extension through the hole with a finger on the opposing side.
Figure 50:
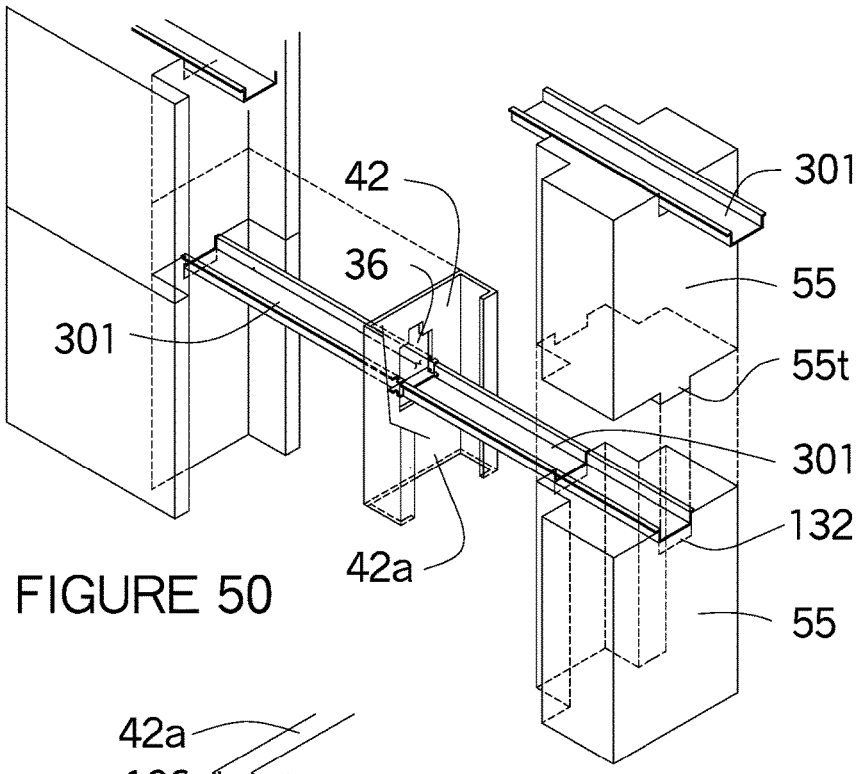
FIG. 50 shows two spacer braces connected with spacer blocks interlocking between the framing members and FIG. 51 shows an enlargement where the left side has a notch tab end with tabs on both sides of the notch with the notch indentation engaging the holes side edges and the right side having the lip notches also engages the hole side edges.
Figure 51:
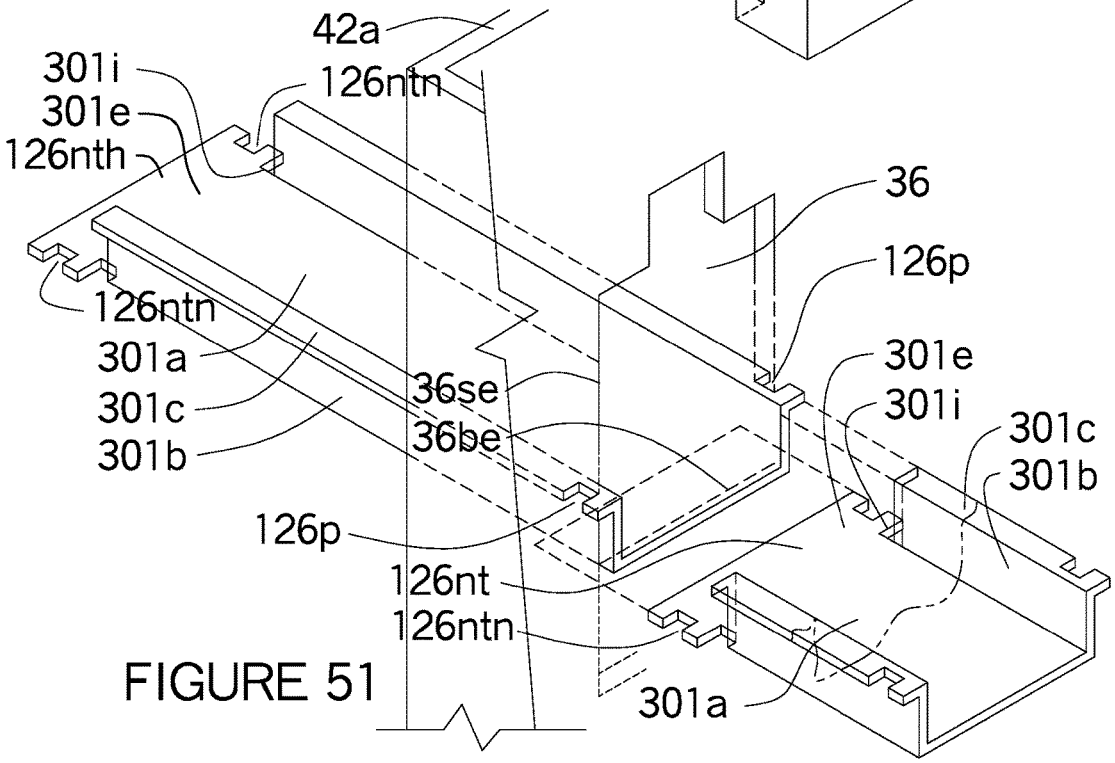
Figure 52:
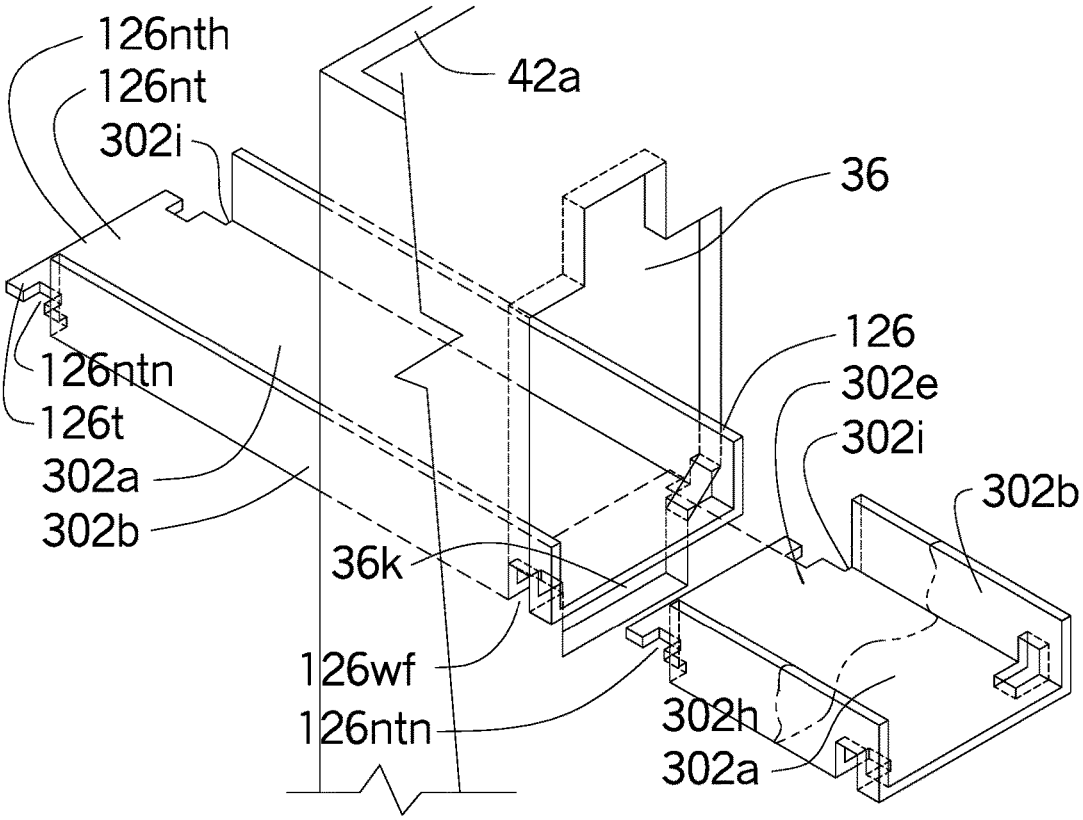
FIG. 52 is similar to FIG. 51 with the notch tab is on the left side, however the notch of the notch tab extends around the side edges of the hole side edges which slopes at a diagonal and the hole side edges extending into the web-flange notch at the corner between the web and flanges.

FIG. 26 shows the hole 36 with many different hole notches 126*h* and various configurations so the edges of a horizontal spacing-bracing channel can intersected any of the hole edges to secure the horizontal spacing-bracing member from moving vertically or horizontally within the hole 36 opening. The hole bottom edge 36*be* shows a notched-tab 126*nt* extending upward into the hole 36 from the web 42*a* of the support member. The outside plane of the web 302*b* of the reverse lip spacer brace 301 has a notched-tab indentation 126*nti* corresponding to a shadow profile of the notched-tab 126*nt* at the hole bottom edge 36*be* so the two metal crossing members interlock together. The shadow profile allows the reverse lip spacer brace 301 to be installed anywhere along the shadow profile. The lip notches 126*p* can also be installed anywhere along the longitudinal length of the lips and the combination of interlocking connections allows the lip notches 126*p* to be installed by any tradesmen installing the metal framing components. A longer length reverse lip spacer brace 301 are first installed at an angle aligning the lip notches 126*p* at the side edges of the hole 36 of several support members before apply pressure at the shadow profile of the web 302*a* connecting the notched-tab 126*nt* at the hole bottom edge 36*be*. The notched-tab shadow profile at the notched-tab indentations 126*nti* can also be installed in the web 301*a* when the reverse lip spacer brace 301 is installed at the top and bottom ends of the support members as shown in many early FIGS. 23 & 24 or in other FIG's when the profile could be turned upside down. In other FIG's the shadow profile is shown at the header and cripple when installing a beam above a door or window as shown in FIGS. 40 & 41. Many of the spacer brace profiles and tongue and receiver ends can be interchangeable between configurations. The size of the hole 36 in support members have standard hole dimensions, because the structural strength of the support member is based on a specific size of a hole. The hole variations are based on reducing the interior hole dimensions by adding protrusions, not by removing portions of the web 42*a* to form the hole 36 configurations. In other FIG's the reverse lip spacer brace 301 are shown in reverse with the lips 301*c* adjacent to the hole bottom edge 36*be* similar to FIG. 30. When this occurs the web 301*a* is installed below the hole protrusions 36*p* located at the hole side edges 36*se* securing the reverse lip spacer brace 301 within the hole 36 vertically and the lip notches 126*p* extending around the hole side edges 36*se* or hole bottom edge 36*be* secure the reverse lip spacer brace 301 from horizontal movement. The installation of the reverse lip spacer brace 301 under the hole protrusions 36*p* and along with the lip 301*c* or the lip notches 126*p* requires the bracing channel to be rotated between the hole edges allowing the reverse lip spacer brace to obtain better angled leverage for easier installation as well as give flexibility to the metal properties of the reverse lip spacer brace 301. The same configurations of the various notches and horizontal spacing-bracing members can be applied to other connection criteria used to hole the two crossing framing members together. So by making the hole smaller by adding hole protrusions 36*p*, the hole is now smaller, but large enough to install hole notches 36*n* in the hole protrusions 36*p* without having to retest the structural capacity of the support member. Some hole protrusions 36*p* use one side of the hole protrusion 36*p* as a hole notch 126*h* and the existing hole side edge 36*se* as another surface to form a hole notch 126*h*.

Figure 29:
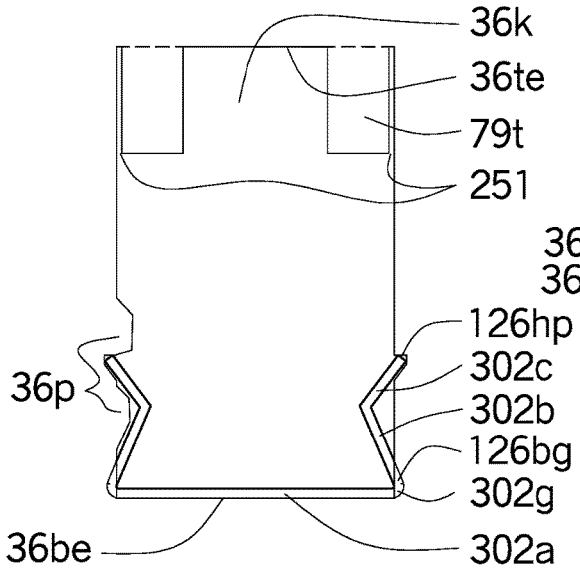
FIGS. 29-31 shows how the hole side edges or protrusions can extend into the hole side edges to form other spacer brace configurations. The figures show how the bulges between the web and the flanges can create an indentation to secure the spacer brace into the hole side edges or how the bulges can have an indentation or notch to slide within the hole side edges and how the flanges can be bent and the lip also bent to create a different configuration of the spacer brace.
Figure 30:
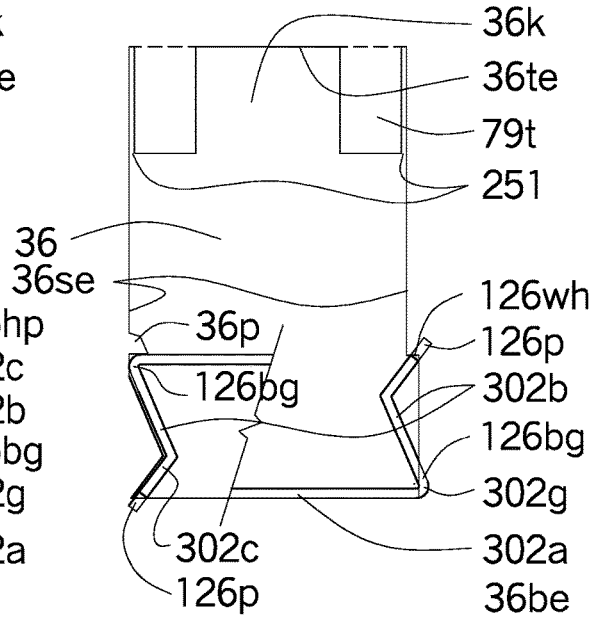
Figure 31:
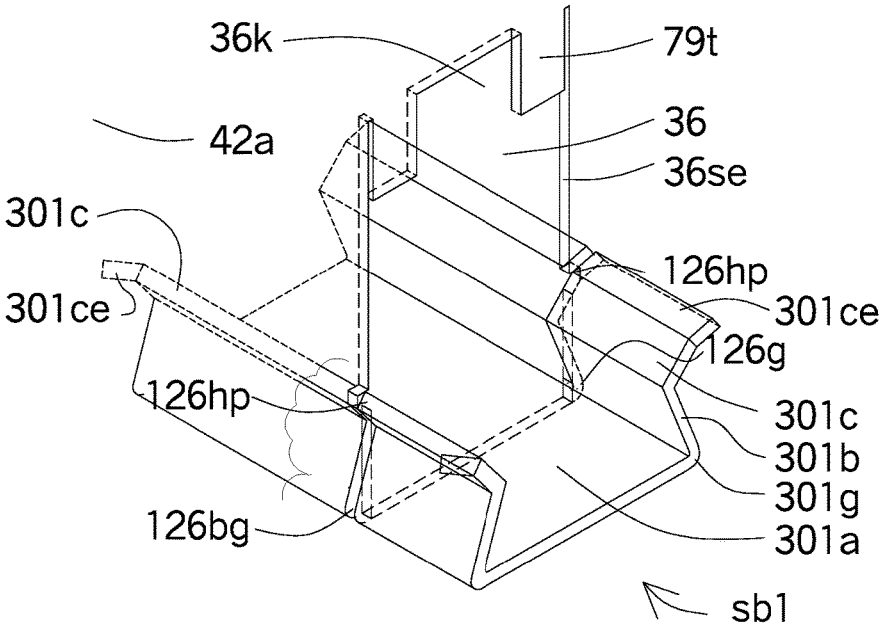

FIGS. 29 & 30 show two hole elevations and FIG. 31 shows an isometric view similar to the reverse lip spacer brace 301 shown in FIG. 26. The reverse lip spacer brace 301 is shown having the plane of the web 301*a* resting on the hole bottom edge 36*be* with the side planes extending upward at an angle sloping inward at an acute angle forming a bulge 301*g* at their intersection. The bulge 301*g* can be formed to have a bulge notch 126*g* where the web 301*a* and a portion of the flange 301*b* have a combined notch referred to as a bulge notch 126*g* or the bulge 301*g* has no notch at all. The longitudinal edge of the flanges 301*b* have lips 301*c* that bend outward toward the hole side edge 36*se* as shown in FIG. 29. The free edge of the lip 301*c* abuts a hole protrusion 36*p* as shown on the left hole side edge 36*se* or indented shown as a lip hole notch 126*hp*. The structural integrity of the hole 36 should be at the furthest indentation at the lip hole notch 126*hp*. The left side of the hole side edge 36*se* in FIG. 30 shows an inverted reverse lip spacer brace 301 as shown on the right hole side edge 36*se* also described in FIG. 26. By having the left side inverted, the web 301*a* have both the longitudinal sides extending downward and the flange-bulges 126*fg* at the corner of the flanges 301*b* and the web 301*a* and are braced by hole protrusions 36*p* that extend above the web 301*a*. The longitudinal sides have lips 301*c* extending the length of the flanges 301*b* with lip notches 126*p* extending inward from the free edges. The angled flanges 301*b* and lips 301*c* are the same on both the left and right sides of the holes 36. The left side is held in place by the lip notches 126*p* extending around both the side planes of the web 42*a* and the web 301*a* has its top plane fitting under the hole protrusion 36*p* keeping the reverse lip spacer brace 301 secured within the hole 36. The right side shows a wide hole notch 126*wh* where hole side edges 36*se* are wider at the reverse lip spacer bracer 301 being indented the hole side edges above. In the isometric view FIG. 31 shows an extended lip 301*ce* that is also angled. The extended lip 301*ce* has the lip notch 126*p* extending inward from the free edge of the extended lip 301*ce*. FIG. 30 could also be a U-shaped spacer brace 302 having flange notches 126*f* extend into the hole protrusion 36*p* or on the hole bottom edge 36*be*, because the hole protrusion 36*p* gives the U-shaped spacer brace 302 an entirely new invention as the hole protrusion 36*p* keep the U-shaped spacer brace 302 from moving vertically within the hole 36.

In FIG. 31 shows an isometric view of the reverse lip spacer brace 301 having a flat plane as the web 301*a* while FIG. 26 shows the notched-tab indentation 126*nti* at the web 301*a* that reflects the mirror image of the notched-tab 126*nt* at the hole bottom edge 36*be* being inserted into the notched-tab indentation 126*nti*.

Figures 32, 33, 34:
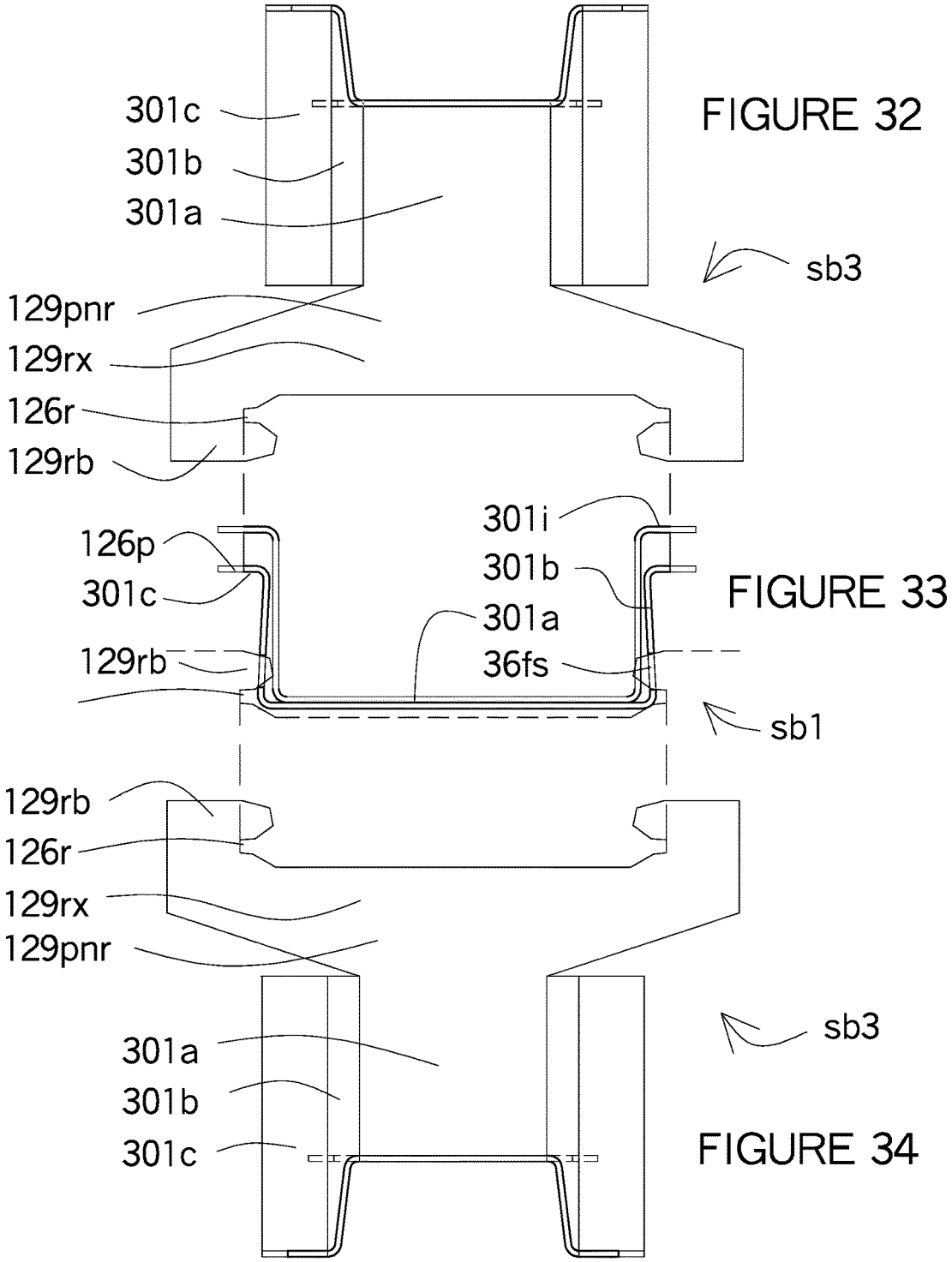
FIGS. 32-34 show the lip notched receiver section in FIGS. 32 & 34 being connected to a smaller and larger reverse lip spacer braces where the spacer brace in FIG. 32 is being connected to the upper spacer brace at the notched lips and the spacer brace in FIG. 34 is being connected into the flange slot holes of the larger reverse lip spacer brace.
Figures 35, 36:
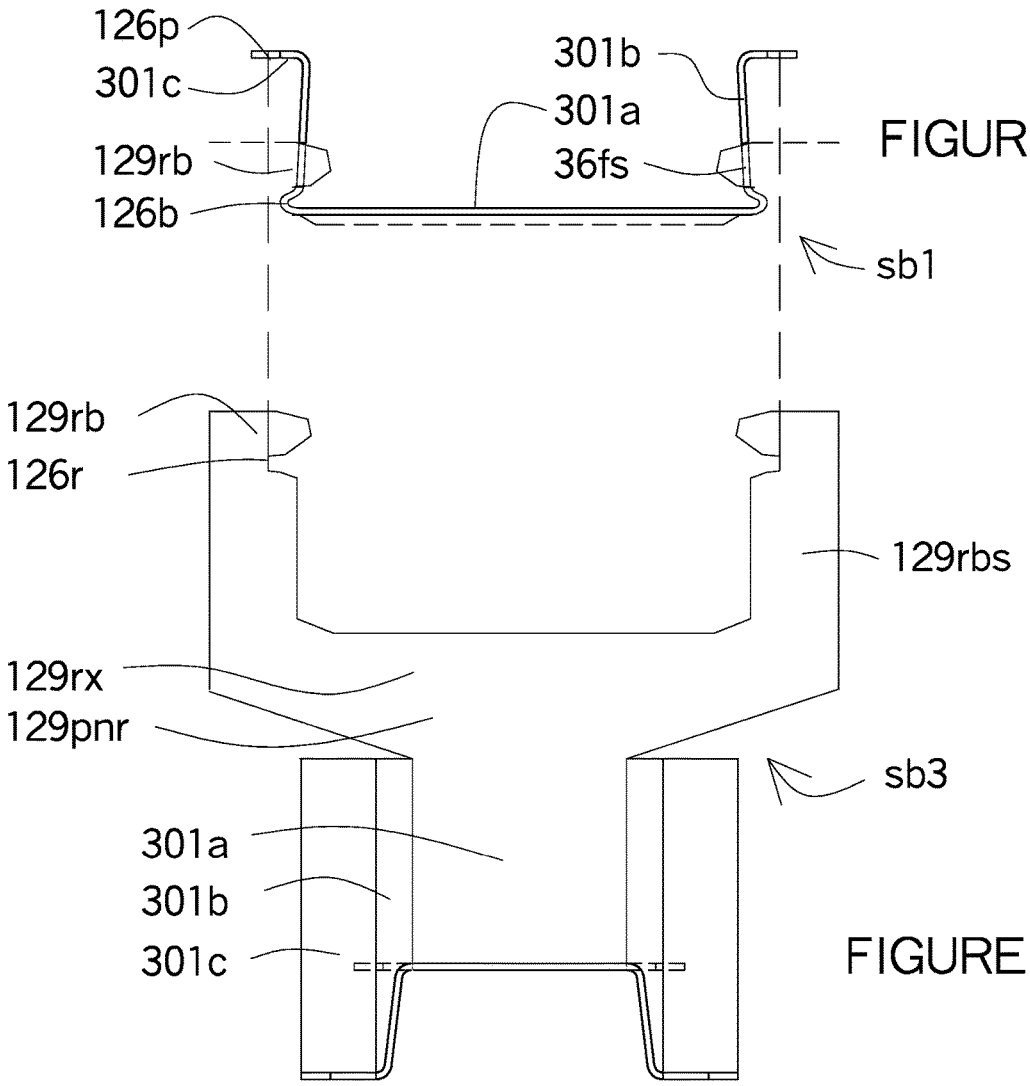
FIGS. 35 & 36 shows the reverse lip spacer brace having slot holes in the flanges and FIG. 36 shows the lip notched-receiver having receiver notches to connect to the lip notches in FIG. 35.

FIGS. 32, 34 & 36 shows a plan view of the lip-notched receivers 129*pnr* being attached to a reverse lip spacer brace 301 shown in FIGS. 33 & 35. FIGS. 33 & 35 reverse lip spacer brace 301 have the side planes extending upward from the web 301*a* at a slight inward angle and the flanges 301*b* have vertically oriented flange slot holes 36*fs*. In FIG. 26 the web 301*a* or the horizontal spacing-bracing member showed an indented web 301*ai* having a notched-tab profile, however two reverse lip spacer braces 301 with different shaped indented webs 301*a* can interlock at the webs to connect or just slide between each other forming a more versatile connection. FIG. 33 also shows the connection between the diagonal spacing-bracing members and the inserted reverse lip spacer brace 301 to slide horizontally within the larger reverse lip spacer bracer 301. The vertical flange slot holes 36*fs* are shown in FIG. 1 where the lip-notched receivers 129*pnr* are installed at a diagonal securing two horizontal spacing-bracing channels together to reduce shear between framing members. FIG. 32 shows a reverse lip spacer brace 301 with the longitudinal end is shown as a lip notched receiver 129*pnr*. The lip notched receiver 129*pnr* has the web 301*a* form a receiver extension 129*rx* which wraps around the lips 301*c* of a crossing reverse lip spacer brace 301 shown in section so the receiver notches 126*r* are secured into the lip notches 126*p* of the crossing reverse lip spacer brace 301. FIGS. 34 & 36 also show the lip notched receiver 129*pnr*, however the lip notched receiver 129*prn* is installed from the underside or the outside for the web 301*a* or the crossing reverse lip spacer brace 301. The receiver extension 129*rx* extends around the outside of the web 301*a* and receiver elbow 129*rb* extends into the vertically oriented flange slot holes 36*fs* while the opposing end could be secured to the lip notches 126*p* of the lips 301*c* as explained above.

FIG. 36 is similar to FIG. 34 except the lip notched-receiver 129*pnr* has a stem 129*rbs* at the receiver elbow 129*rb* that extends around the flange 301*b* of a reverse lip spacer brace 301 shown in FIG. 35. The receiver-stem 129*rbs* can extend around a receiver bulge 129*rb* or pass through a bulge notch 126*g* for added strength and rigidity. The receiver stem 129*rbs* extends into the receiver notch 126*r* that is secured into the lip notch 126*p* at the lips 301*c* or the reverse lip spacer brace 301 shown in FIG. 34.

Figure 38:
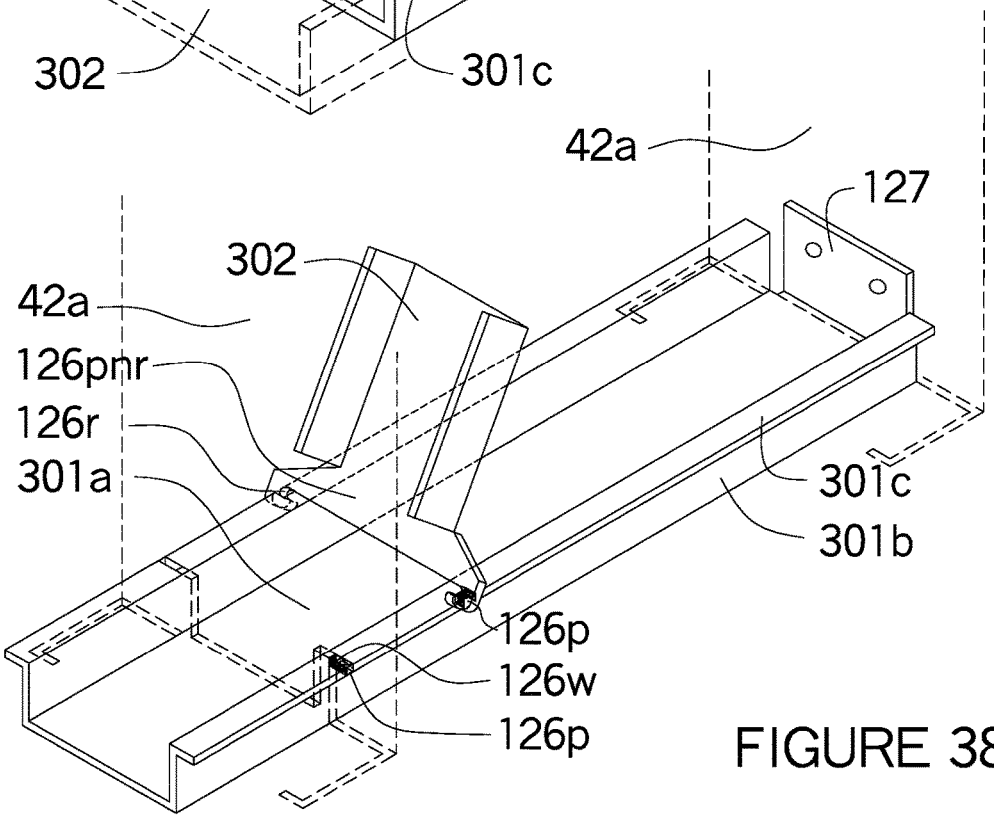
Figure 39:
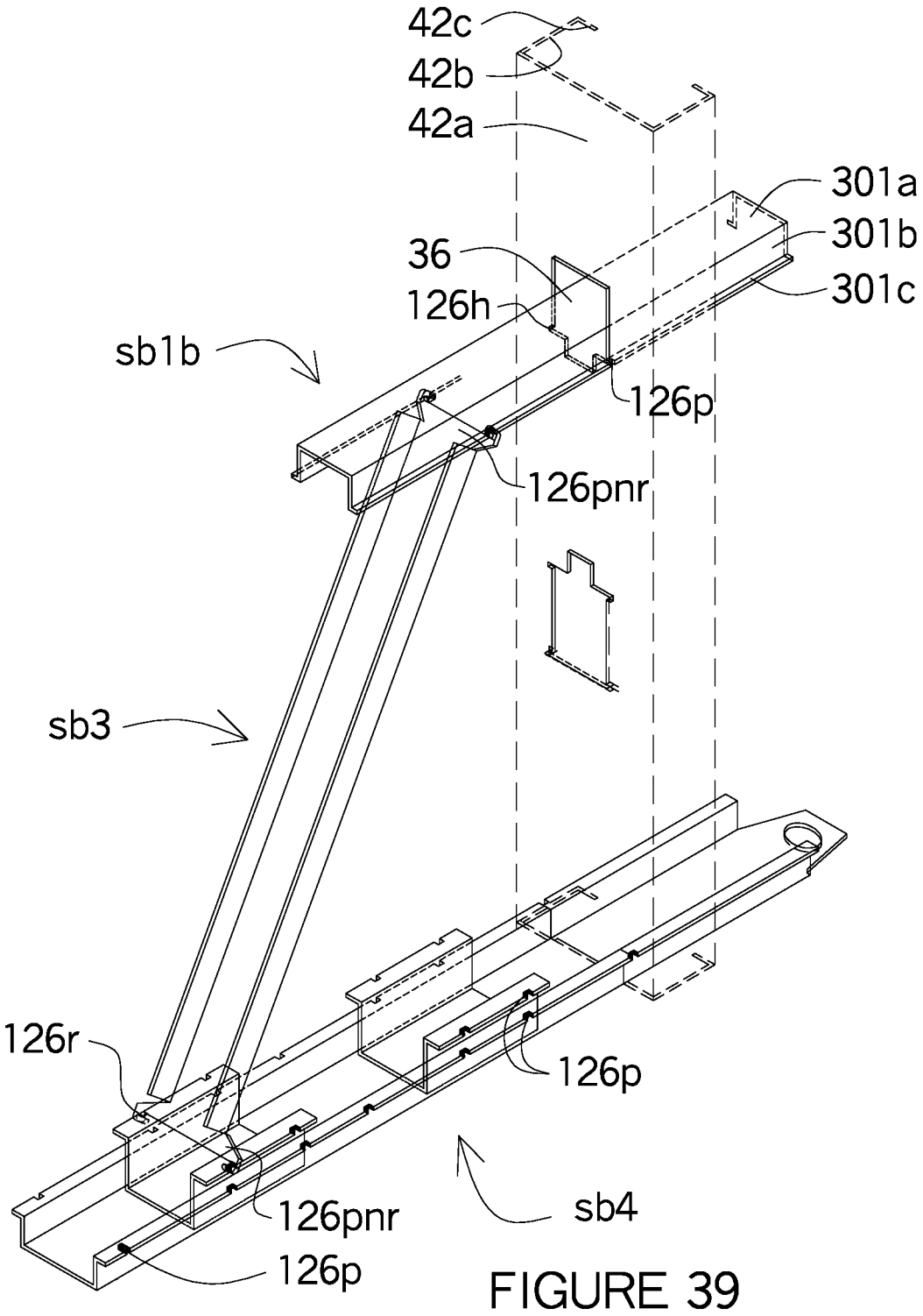
FIG. 39 shows a wall support member having a spacer brace passing through the hole and another spacer brace at the floor, however another reverse lip spacer brace is between the flanges that can slide between the flanges and where the lips can be connected to a diagonal spacer brace forming a tight fit.

FIGS. 37-38 shows an isometric view of the longitudinal spacing-bracing member intersecting the support members at the web 42*a* of the C channel 42 as shown in FIGS. 9 & 10. FIG. 38 shows the web 42*a* extend under the web 42*a* of the support member and connected by the hook finger 127 at the end of the reverse lip spacer brace 301. FIG. 37 shows an enlargement the of lip notched receiver 129*prn* with the receiver extension 129*rx* extend from the web 301*a* and the receiver elbow 129*rb* extend around the lips 301*c* so the receiver notches 126*r* extend into the lip notches 126*nt* of the reverse lip spacer brace 301. The lips 301*c* are shown bending at an angle upward or downward giving additional strength and resistance to the connection. In addition the reverse lip spacer brace 301 can be shorter for example as shown in FIG. 1 where the reverse lip spacer brace can slide between a larger U shaped spacer brace 302 to possibly make a tighter fit between the diagonal reverse lip spacer brace 301 and the U shaped spacer brace 302. FIG. 39 also shows another reverse lip spacer brace 301 passing through the hole 36 with the lip notches 126*p* interlocking to the hole notches 126*h*. Then the reverse lip spacer brace 301 continues through the hole 36 where the lip notches 126*p* at the underside of the reverse lip spacer brace 301 are connected to the receiver notches 126*r* in the lip notched receiver 129*pnr* completing a diagonal intersection between metal framing members.

FIGS. 40 & 41 show two partial isometric views of metal framing members forming a beam between vertical support members. Both FIG's show C channels 42 as vertical support members with a shorter vertical support member known as cripples adjacent to both the vertical support members. The beam spans between the cripple and attaches to the support members. In FIG. 40 the beam is shown as a reverse lip spacer brace 301 having a web 301*a* with longitudinal extending flanges 301*b* and lips 301*c* extending outwardly and longitudinally from the flanges 301*b*.

The web 301*a* of the reverse lip spacer brace 301 has a raised web 301*ra* with flange slot holes 36*fs* located on both the sloped web edges 302*sa*. The top edge of the web 42 of the support member has a notched-tab 126*nt* extending above the web 42*a* as shown in FIG. 23, however the nt-heads 126*nth* extend through the flange slot holes 36*fs* are similar to FIG. 24. In lieu of the raised web 301*ra* shown in FIG. 40, a shadow profile of the notched-tab 126*nt* can be installed as a notched-tab indentation 126*nti* in the web 301 as discussed in FIG. 26.

In FIG. 41 the web 42*a* of the horizontal spacing-bracing member has the profile of a lip notch 126*p* at the outside plane of the web 301*a* which is the same shape of a lip notched receiver 129*pnr*. The notched-tab 126*nt* from the top of the support member would then extend into the profile of the notched-tab receiver 129*nt* in the web 301*a* of the reverse lip spacer brace 301. The vertical support members above the beam are connected in the web by the web gap 45*w* and the web notches 126*w* or the slide gap 45*s* as previously explained. In FIG. 41 the reverse lip spacer brace 301 shows the left lip 301 *c* with a horizontal lip notch 126*p* that fits into the horizontal web notches 126*w*. In FIG. 40 the top end of the left spacer brace shows two slid gaps 45*s* in the web 42*a* and an indentation 42*i* so the C channel 412 can slide vertically within the slid gaps 45*s* and within in the lip notches 126*p* or the reverse lip spacer brace 301. The lip notches 126*p* in FIG. 41 on the right side shows downward sloping angled lip notches 126*p* with flares 126*f* for an faster and easier installation. On the other the lip notches 126*p* could have an acute angle at the lip notches 126 which would be stronger when connecting to acute angled web notches 126*w*. In FIG. 41, the cripple is shown as a reverse lip spacer brace 301 where one flange 301 *b* has two bends in the flange 301*b* for extra strength. The lip 301*c* is shown having a lip extension 301*ce* extending downward also adding additional strength to the beam. In FIG. 41 the cripple has an indentation 42*i* for the web 301*a* and flanges 301*b* can fit into and the support member has web notches 126*w* for the lips 301*c* along with the lip notches 126*p* to fit into. The reverse lip spacer brace 301 can also be configured using bulges 301*g* or different hole variations can also change the shape of the header. Additional metal framing members can be added as inserts flanges 301*b* and lips 301*c* could have additional framing bends to increase strength. What is important is the reverse lip spacer brace 301 is connected the shorter support member without using fasteners.

FIGURE NUMBER GLOSSARY OF TABLE OF CONTENTS

36 hole: 36*be*—hole bottom edge, 36*se*—hole side edge, 36*k*—key hole, 36*ws*—web slot holes, 36*b*—bracing hole, 36*kt*—key tab, 36*fs*—flange slot holes, 36*p*—hole protrusion

42 C channel: 42*a*—web, 42*b*—flange, 42*c*—lip, 42*at*—web tab, 42*ai*—web indentation

46 gap: 45*e*—L-shaped gap, 45*w*—web gap, 45*s*—slide gap

126 notches: 126*fe*—flare edge, 126*r*—receiver notch, 126*h*—hole notches, 126*p*—lip notch, 126*w*—web notch, 126*g*—bulge notch, 126*nt*—notched-tab, 126*hp*—hole lip notch, 126*fg*—flange notch, 126*pnr*—lip notched-receiver, 126*fw*—flange-web notch, 126*nth*—nt-head, 126*ntn*—nt-notch, 126*pp*—double-lp notch, 126*nte*—nt-extension, 126*se*—notch slide extension, 126*nti*—notched-tab (nt) indentation, 126*ntsh*—notched-tab (nt) side head reverse lip notched-tab—126*rnt,* reverse lip notched tab notch 126*rntn,* reverse lip notched-tab head—126*rnth*

127 hook finger

128 hook tongue

129 hook receiver: 129*t*—hook receiver tab, 129*pnr*—lip notched receiver, 129*rx*—receiver extension, 129*rb*—receiver elbow, 129*sh*—receiver slot hole, 129*rh*—round hole receiver, 129*h*—receiver hole, 129*rbs*—receiver stem, 129*ntp*—notched-tap receiver profile

301 reverse lip spacer brace: 301*a*—web, 301*b*—flange, 301*c*—lip, 301*g*—bulge, 301*ce*—cut edge, 301*fc*—flexible lip, 301*cc*—double lip, 301*bx*—flange x-plane, 301*by*—flange y-plane, 301*e*—extension, 301*ae*—web extension, 301*ce*—extended lip

302 U shaped spacer brace: 302*a* web, 302*b* flange, 302*we*—web extension, 302*i*—indentation, 302*as*—sloped web edge, 302*bt*—tabs

303 C shaped spacer brace: 303*a*—web, 303*b*—flange, 303*c*—lip

320 ridges

355 anchor space

The invention claimed is:

1. A longitudinal spacing-bracing framing member connector comprising: a first framing element having a planar web with an aperture extending therethrough, said web having a first side and a second side opposite said first side and a first end and a second end opposite said first end, said web further having a first flange extending along said first side and a second flange extending along said second side, said first flange and second flange each having a height and being substantially parallel to each other and extending in a direction substantially perpendicular to said web, said first end of said connector having a third flange being coplanar with said web and having a width less than a width of said web, said first end further having a first tab extending substantially perpendicular to said web, said first tab having a first side and a second side opposite said first side, said first tab having a notch on each said first side of said first tab and said second side of said first tab, said first side of said first tab and said second side of said first tab being tapered.

2. The connector of claim 1 wherein said web has a first extension between said web and said third flange and coplanar with said web, and said second end has a second extension coplanar with said web, said first extension and said second extension having opposed side edges that converge in a direction away from said web.

3. The connector of claim 1, further comprising, said second end of said connector has a second tab having a first portion coplanar with web and a second portion extending substantially perpendicular to said web, said second tab having a first notch on a first side edge of said first portion and a second notch on a second side edge of said first portion.

4. The connector of claim 3, further comprising, a support member having an aperture extending therethrough, said notches of said second tab receiving a perimeter edge of said aperture of said support member and a first tab of a second connector substantially identical to said first connector extending through said aperture of said framing member and being received by said aperture of said first connector.

5. The connector according to claim 1 wherein said first flange has a first notch and said second flange has a second notch, each said notch extending from a respective free distal edge of said first flange and said second flange and terminating in said web.

6. The connector according to claim 5 wherein said notch of said first flange and said notch of said second flange engage said aperture in said support member.

7. The connector according to claim 1 wherein said first flange and said second flange each having a lip extending substantially parallel to said web, each said lip extending away from a longitudinal axis of said web.

8. The connector according to claim 1 wherein said first flange has a longitudinal rib on an exterior surface of said first flange and extending a longitudinal length of said first flange.

* * * * *